US008311249B2

(12) United States Patent
Koyama et al.

(10) Patent No.: US 8,311,249 B2
(45) Date of Patent: Nov. 13, 2012

(54) INFORMATION PROCESSING APPARATUS, METHOD AND PROGRAM

(75) Inventors: Hiroshi Koyama, Kanagawa (JP); Reiko Miyazaki, Tokyo (JP); Kazuto Nishizawa, Kanagawa (JP); Taku Sugawara, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 11/854,053

(22) Filed: Sep. 12, 2007

(65) Prior Publication Data

US 2008/0063226 A1 Mar. 13, 2008

(30) Foreign Application Priority Data

Sep. 13, 2006 (JP) ..... P2006-248688

(51) Int. Cl.
*H04R 5/02* (2006.01)

(52) U.S. Cl. ..... 381/306; 381/300; 381/307; 715/700; 715/716

(58) Field of Classification Search ..... 381/300, 381/306–307, 302, 104–105, 109, 119, 58–59, 381/303, 310, 86, 103; 715/700, 716
See application file for complete search history.

(56) References Cited

U.S. PATENT DOCUMENTS

| | | | | |
|---|---|---|---|---|
| 5,646,602 | A * | 7/1997 | Gertz et al. | 340/825.25 |
| 6,798,889 | B1 * | 9/2004 | Dicker et al. | 381/303 |
| 6,954,538 | B2 * | 10/2005 | Shiraishi | 381/105 |
| 6,977,653 | B1 * | 12/2005 | Cleary et al. | 345/440 |
| 6,987,947 | B2 * | 1/2006 | Richenstein et al. | 455/3.06 |
| 7,058,252 | B2 * | 6/2006 | Woodgate et al. | 385/16 |
| 7,412,067 | B2 * | 8/2008 | Koyama | 381/307 |
| 2002/0027995 | A1 * | 3/2002 | Kanai et al. | 381/63 |
| 2004/0258259 | A1 * | 12/2004 | Koyama | 381/307 |
| 2004/0264704 | A1 * | 12/2004 | Huin et al. | 381/59 |
| 2005/0031143 | A1 * | 2/2005 | Devantier et al. | 381/300 |
| 2005/0220309 | A1 * | 10/2005 | Hirata et al. | 381/18 |
| 2005/0226429 | A1 * | 10/2005 | Hollowbush et al. | 381/56 |
| 2005/0265559 | A1 * | 12/2005 | Asada | 381/18 |
| 2007/0019823 | A1 * | 1/2007 | Miyazaki et al. | 381/87 |

FOREIGN PATENT DOCUMENTS

| | | |
|---|---|---|
| JP | 09-130900 | 5/1997 |
| JP | 2005-12534 | 1/2005 |
| JP | 2005-286903 | 10/2005 |

OTHER PUBLICATIONS

Seong-Gu Jang; "sound controller for multi channel sound system", Oct. 2005.*

* cited by examiner

*Primary Examiner* — Disler Paul

(74) *Attorney, Agent, or Firm* — Finnegan, Henderson, Farabow, Garrett & Dunner, L.L.P.

(57) ABSTRACT

An information processing apparatus includes: a speaker setup section that sets up each of a plurality of speakers; and a display control section that controls display of information regarding arrangement of the plurality of speakers and setting of the plurality of speakers set up by the speaker setup section.

14 Claims, 53 Drawing Sheets

SSZ1

N2

CT

LPS

MSTP

EN2

EM4

EN5

Auto Calibration

Error Code:34
Speakers may not be appropriately placed like
the right speakeron the left side. Refer to the instruction manual
(Preparation 1: Arrangement of Speakers) for rearrangement of speakers.

Restart Measurement ~ AC7 Stop Measuring ~ AC8

<Enter>

FIG.18

WN5

Auto Calibration

Error Code:44

Measurement is completed. However, the result shows the reversed phases regarding the following speakers:
Surround Back L
Surround Back R
The terminals of +/− may be connected to the opposite jacks.
In a case where they are appropriately connected, the problem may be attributed to the configuration of the speakers and you can use it as is.

Restart Measurement ~AC13A Stop Measuring ~AC14

<Return> <Enter>

FIG.26

RMC

FAR

EAR

FRAR

ARO

SS1

SS2

SS3

SS4

SS5

SLV1

SDM

SSZ1

SS22

SLV2

SHS1

SHS2

SBL1

SBL2

SBL3

INFORMATION PROCESSING APPARATUS, METHOD AND PROGRAM

CROSS REFERENCES TO RELATED APPLICATIONS

The present invention contains subject matter related to Japanese Patent Application JP2006-248688 filed in the Japanese Patent Office on Sep. 13, 2006, the entire contents of which being incorporated herein by reference.

BACKGROUND OF THE INVENTION

1. Field of the Invention

The present invention relates to an information processing apparatus, method and program, and is preferably applied to a multichannel speaker system, for example.

2. Description of Related Art

There is an audio visual system (also referred to as an "AV system") for audio and video reproduction: The audio visual system includes an audio amplifier with multichannel reproduction functions, a receiver including an audio amplifier with a tuner function and the like. Initial setting (or speaker setting) for each speaker should be done.

Generally, as disclosed in Jpn. Pat. Laid-open Publication No. 2005-12534, the AV system with multichannel reproduction function includes a 5.1 channel speaker system: In line with the 5.1 channel audio format for DVD video for example, the 5.1 channel speaker system includes a left front speaker FL, a right front speaker FR, a center speaker CT, a left surround speaker SL, a right surround speaker SR and a subwoofer SW.

In recent years, the AV system may include a 6.1 channel speaker system, which has a surround back speaker in line with the 6.1 channel audio format such as "DOLBY DIGITAL EX (Registered Trademark)" and "dts-ES (Registered Trademark)", a 7.1 channel speaker system, which has two surround back speakers, or a 9.1 surround speaker system, which has four surround speakers.

Setting up that kind of multichannel AV system should be done to present an appropriate multichannel reproduction environment: The setting items include "Use or Nonuse of Speaker", "Large (a full bandwidth reproduction speaker)/Small (a middle and high bandwidth reproduction speaker)" and the like. Accordingly, the AV system is usually equipped with the speaker setup function.

SUMMARY OF THE INVENTION

However, as for that type of AV system, a user should decide on specifics for the setup items of each speaker placed in the listening space. This is particularly troublesome for the user because there are many setup items.

In addition, the number of the speaker setup items and its setting patterns will increase as the AV system has more channels, like from a 2 channel system to a 5.1, 6.1, 7.1 or 9.1 channel system. Like connecting the speaker with other devices, that kind of setup operation is troublesome for the user.

The AV system is usually equipped with a poor quality display (such as Fluorescent Display) as a user interface, which is usually mounted on acoustic devices such as audio amplifiers. Therefore, the user may have difficulty in specifying those setup items on the display.

The present invention has been made in view of the above points and is intended to provide an information processing apparatus, method and program that allow a user to easily set up a plurality of speakers.

In one aspect of the present invention, an information processing apparatus includes: a speaker setup section that sets up each of a plurality of speakers; and a display control section that controls display of information regarding arrangement of the plurality of speakers and setting of the plurality of speakers set up by the speaker setup section. This allows the user to visually check the arrangement of the plurality of speakers and the setting of each speaker. As a result, the user can set up the plurality of speakers easily.

According to an embodiment of the present invention, the user can visually check the arrangement of the plurality of speakers and the setting of each speaker. As a result, the user can set up the plurality of speakers easily. Thus, the information processing apparatus, method and program according to an embodiment of the present invention allow the user to easily set up the plurality of speakers.

The nature, principle and utility of the invention will become more apparent from the following detailed description when read in conjunction with the accompanying drawings in which like parts are designated by like reference numerals or characters.

BRIEF DESCRIPTION OF THE DRAWINGS

In the accompanying drawings:

FIGS. 14 to 18 are schematic diagrams illustrating an error notification screen;

FIGS. 22 to 26 are schematic diagrams illustrating a warning notification screen;

DETAILED DESCRIPTION OF PREFERRED EMBODIMENTS

An embodiment of the present invention will be described in detail with reference to the accompanying drawings.

(1) Overall Configuration of an AV system

Figure 1:
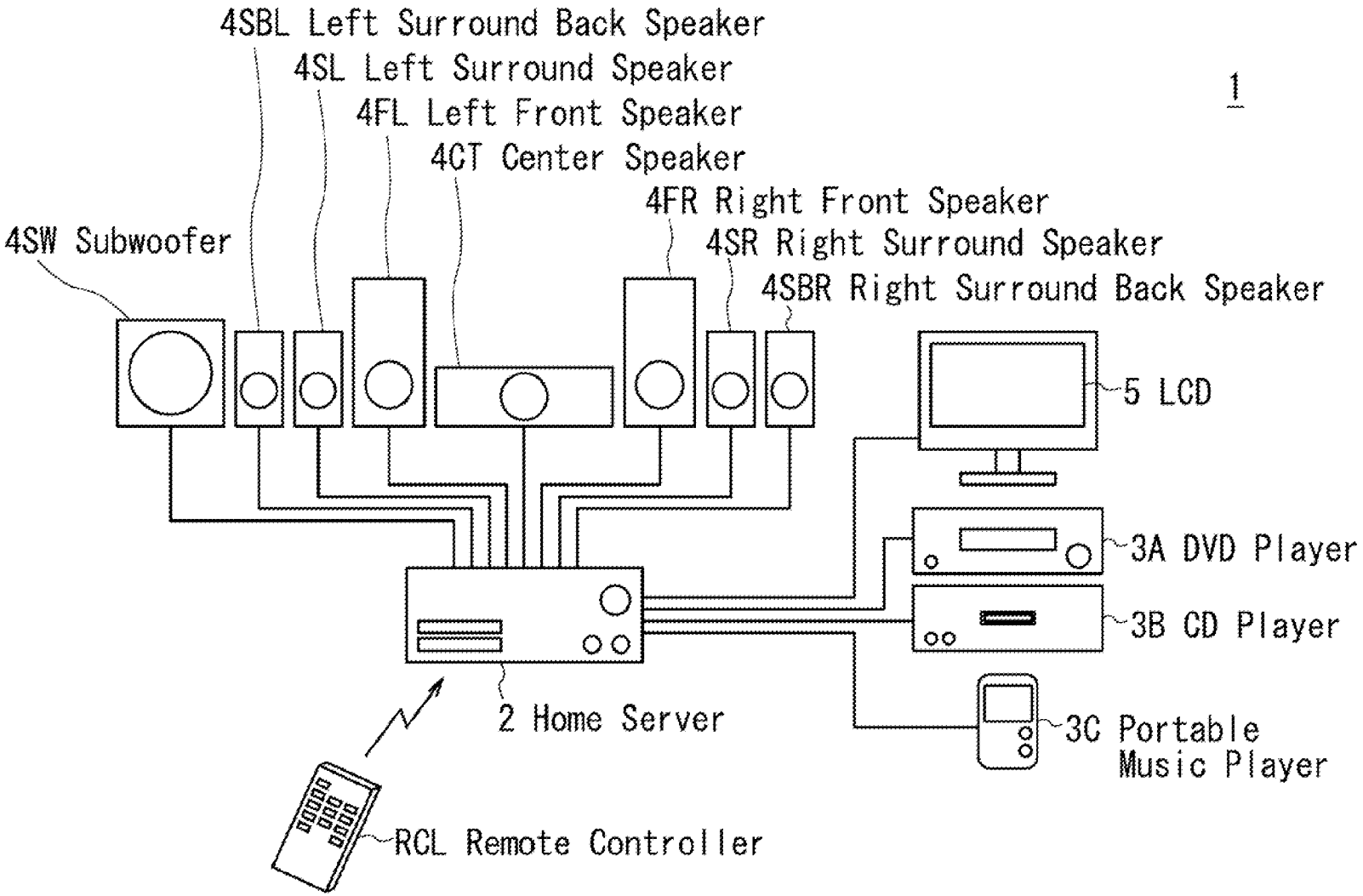
FIG. 1 is a schematic diagram illustrating the overall configuration of an AV system.

With reference to FIG. 1, an Audio Visual (AV) system 1 according to an embodiment of the present invention includes a home server 2 connected to a plurality of reproduction apparatus 3, a plurality of speakers 4 and a display section or a Liquid Crystal Display (LCD) 5.

In this embodiment, the reproduction apparatus 3 include, for example, a Digital Versatile Disc (DVD) player 3A, a Compact Disc (CD) player 3B and a portable music player 3C, each of which is connected to the home server 2.

Moreover, in this embodiment, the speakers 4, as a 7.1 channel surround system, include, for example, a left front speaker 4FL, a right front speaker 4FR, a center speaker 4CT, a left surround speaker 4SL, a right surround speaker 4SR, a left surround back speaker 4SBL, a right surround back speaker 4SBR and a subwoofer 4SW, each of which is connected to the home server 2.

Each speaker 4 (4FL, 4FR, 4CT, 4SL, 4SR, 4SBL, 4SBR and 4SW) is appropriately placed in the listening space to realize a desired acoustic effect.

In addition, the AV system 1 is designed to display on the LCD 5 various setup screens regarding the acoustic field space. The setup content, specified through a remote controller RCL, is stored in the AV system 1, which then constructs the acoustic field environment based on the setup content to allow a user to listen to music.

(2) Configuration of the Home Server

Figure 2:
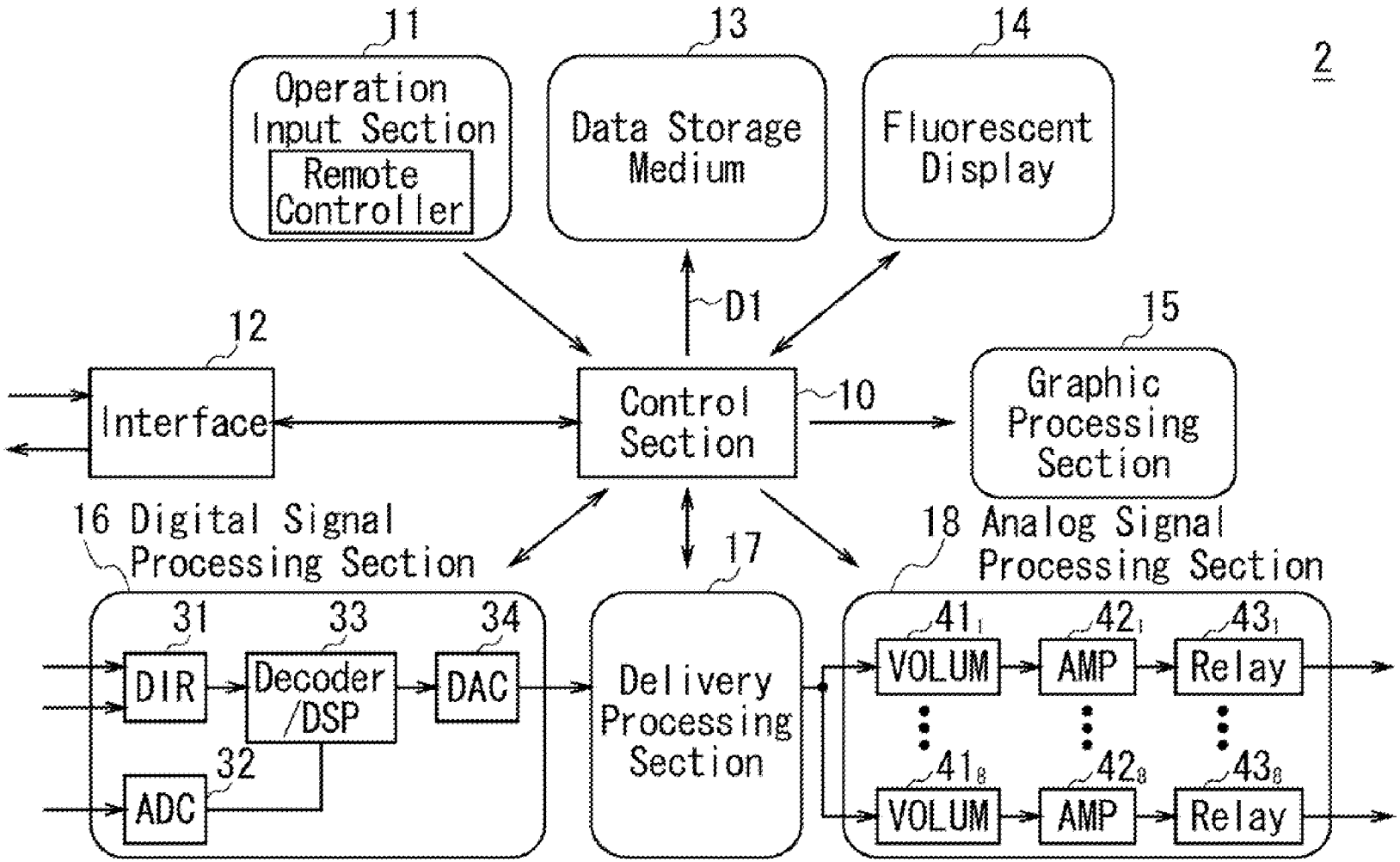
FIG. 2 is a schematic block diagram illustrating the configuration of a home server.

Following describes the circuit configuration of the home server 2. As shown in FIG. 2, the home server 2 includes a control section 10 connected to an operation input section 11, an interface 12, a data storage medium 13, a fluorescent display 14, a graphics processing section 15, a digital signal processing section 16, a delivery processing section 17 and an analog signal processing section 18.

The control section 10 is a micro computer including a Central Processing Unit (CPU) to take overall control of the AV system 1. In addition, the control section 10 includes a Read Only Memory (ROM), which stores various programs such as a basic program and various application programs, and a Random Access Memory (RAM), which serves as a work memory for the CPU.

The operation input section 11 generates control data in accordance with the operation of operation sections (such as an operation button, a rotatable encoder (i.e. a rotatable knob) or the like), which are placed on the surface of the home server 2 and the remote controller RCL (FIG. 1). The operation input section 11 supplies the control data to the control section 10.

The interface 12 is, for example, a Universal Serial Bus (USB). The control data, supplied from the control section 10, is for example transmitted via the interface 12 to the DVD player 3A, the CD player 3B and the portable music player 3C. On the other hand, the control data generated by the DVD player 3A, the CD player 3B or the portable music player 3C is transmitted via the interface 12 to the control section 10.

The data storage medium 13 is for example a Electrically Erasable Programmable Read Only Memory (EEPROM). The data storage medium 13 stores setting data D1, which represent the setup content of the speakers 4 regarding the acoustic field space, and setting screen data D2, which are templates of screens for Graphical User Interface (GUI).

The fluorescent display 14 is mounted on the surface of the home server 2. The fluorescent display 14 displays characters based on the content generated by the control section 10, and other characters indicating the details of the setup items regarding the acoustic field space.

The graphic processing section 15 is designed to receive video signals from the DVD player 3A via a digital video input terminal (not shown), an analog video input terminal (not shown) or a component video input/output terminal (not shown). In addition, the graphic processing section 15 may receive the setting data D1 and the setting screen data D2 from the data storage medium 13.

After receiving the video signal, the graphic processing section 15 performs a signal processing process on the video signal and supplies a resulting video signal to the LCD5 (FIG. 1), which then displays a video image based on the video signal.

On the other hand, when receiving the setting data D1 and the setting screen data D2, the graphic processing section 15 generates a GUI screen data D3 based on the setting data D1 and the setting screen data D2 and supplies the GUI screen data D3 to the LCD 5 (FIG. 1), which then displays a GUI screen based on the GUI screen data D3.

A Digital Interface Receiver (DIR) 31 of the digital signal processing section 16 receives an optical digital audio signal from the DVD player 3A or the portable music player 3C via a digital input/output terminal. An Analog Digital Converter (ADC) 32 of the digital signal processing section 16 receives an analog audio signal from the CD player 3B via an analog input/output terminal.

The DIR 31 electrically converts the optical digital audio signal into a digital audio signal and then supplies the digital audio signal to a decoder/Digital Signal Processor (DSP) 33. The ADC 32 transforms the analog audio signal into a digital audio signal and then supplies the digital audio signal to a decoder/ DSP 33.

The decoder/DSP 33 is designed to perform various processes on the digital audio signals supplied from the DIR 31 or the ADC 32 when needed. Specifically, the decoder/DSP 33 may decompress the digital audio signals when they have been compressed. The decoder/DSP 33 may demultiplex the digital audio signals when they have been multiplexed for 7.1 channels and the like.

When receiving from the control section 10 the setting data D1 regarding the acoustic image which is to be realized by the speakers 4, the decoder/DSP 33 performs, based on the setting data D1, various processes such as adjusting an amplitude or phase of a signal of a certain frequency or virtually increasing or decreasing the number of channels.

After performing those signal processing processes, the decoder/DSP 33 supplies a resulting digital audio signal to a Digital Analog Converter (DAC) 34. The digital audio signal is transformed, by the DAC 34, into an analog audio signal, which is then supplied to the delivery processing section 17.

The delivery processing section 17 receives from the DAC 34 the analog audio signal and then supplies the received analog audio signal to one of volume adjustment sections 411 to 418, which is associated with the channel of the received analog audio signal. The analog signal processing section 18 includes those volume adjustment sections 411 to 418.

The volume adjustment sections 411 to 418 adjusts the level of the analog audio signal supplied from the delivery processing section 17, based on a volume adjustment command supplied from the operation input section 11. The adjusted analog audio signal is supplied to amplifiers 421 to 428.

The analog audio signal of each channel is amplified by the corresponding amplifier 421 to 428 so as to drive a corresponding speaker 4 (4FL, 4FR, 4CT, 4SL, 4SR, 4SBL, 4SBR or 4SW). The analog audio signal is then output through relays 431 to 438.

By the way, when a command is supplied from the operation input section 11, the relays 431 to 438 may shut down the supply of the analog audio signal to the unused speaker 4. This allows a user to specify which speaker 4 is to be used.

(3) Process of the Control Section

Following describes the process of the control section 10 of the home server 2. The control section 10 executes programs, such as a basic program and application program stored in the ROM, to perform various processes: The control section controls the display section 14, the graphic processing section 15, the digital signal processing section 16, the delivery processing section 17 and the analog signal processing section 18, based on the control data supplied from the operation input section 11 or the interface 12, the setting data D1 stored in the data storage medium 13 and the like.

(3-1) Playback Process

When a playback command, as the control data, is supplied from the operation input section 11 the control section 10 controls, in accordance with the playback command, the corresponding DVD player 3A, CD player 3B or portable music player 3C for playback. The control section 10 then receives content information from the DVD player 3A, CD player 3B or portable music player 3C and generates, based on the received content information, character data including a string of characters describing the content. The fluorescent display 14 or the LCD 5 therefore displays characters based on the character data.

For example, while the video signals, reproduced from a DVD disc, are supplied from the DVD player 3A, the control section 10 supplies the video signals via the graphic processing section 15 to the LCD 5 (FIG. 1), which then displays the video images based on the video signals. On the other hand, when the CD player 3B or the portable music player 3C is driven to reproduce data, a video image is generated by the graphic processing section 15 in accordance with which player is driven and then is displayed on the LCD 5.

(3-2) Acoustic Field Setup Process

When an acoustic field setup command, as the control data, is supplied from the operation input section 11 the control section 10 controls the graphic processing section 15 to generate the GUI screen data D3 based on the setting data D1 and setting screen data D2 stored in the data storage medium 13. The LCD 5 (FIG. 1) therefore displays a GUI screen based on the GUI screen data D3.

When a setup change command, a command to change the setting of each speaker 4 in the acoustic field space is supplied from the remote controller RCL or the operation input section 11, the control section 10 updates, in accordance with the setup change command, the setting data D1 stored in the data storage medium 13.

If the setup change command is related to the acoustic image, the speakers 4 under the control of the control section 10 outputs, when the setup change command is supplied, predetermined test sound that matches the condition of the setup change command regarding the acoustic image. In addition, the control section 10 displays on the LCD 5 (FIG. 1) an image representing that acoustic image. This helps the user understand the acoustic image through their eyes and ears.

In this embodiment, the home server 2 has been set up in the following manner: The speakers 4 (4FL, 4FR, 4CT, 4SL, 4SR, 4SBL, 4SBR and 4SW) are divided into a plurality of groups, each of which belongs to a certain acoustic field space such as a listening room, a kitchen or a child's room. Accordingly, a certain group of speakers 4 provides reproduced sound which is the same as or different from that of other groups.

In that manner, each group of the speakers 4 is located in a different acoustic field space or a different zone. The home server 2 takes charge of controlling all the zones, such as correcting the acoustic field of each zone.

(4) Acoustic Field Setup through GUI

Instead of the fluorescent display 14 of the home server 2, the AV system 1 displays on a high quality LCD 5 the GUI screen for the setup of acoustic field. The setup of acoustic field may be automatically or manually done through the GUI screen.

Figure 3:
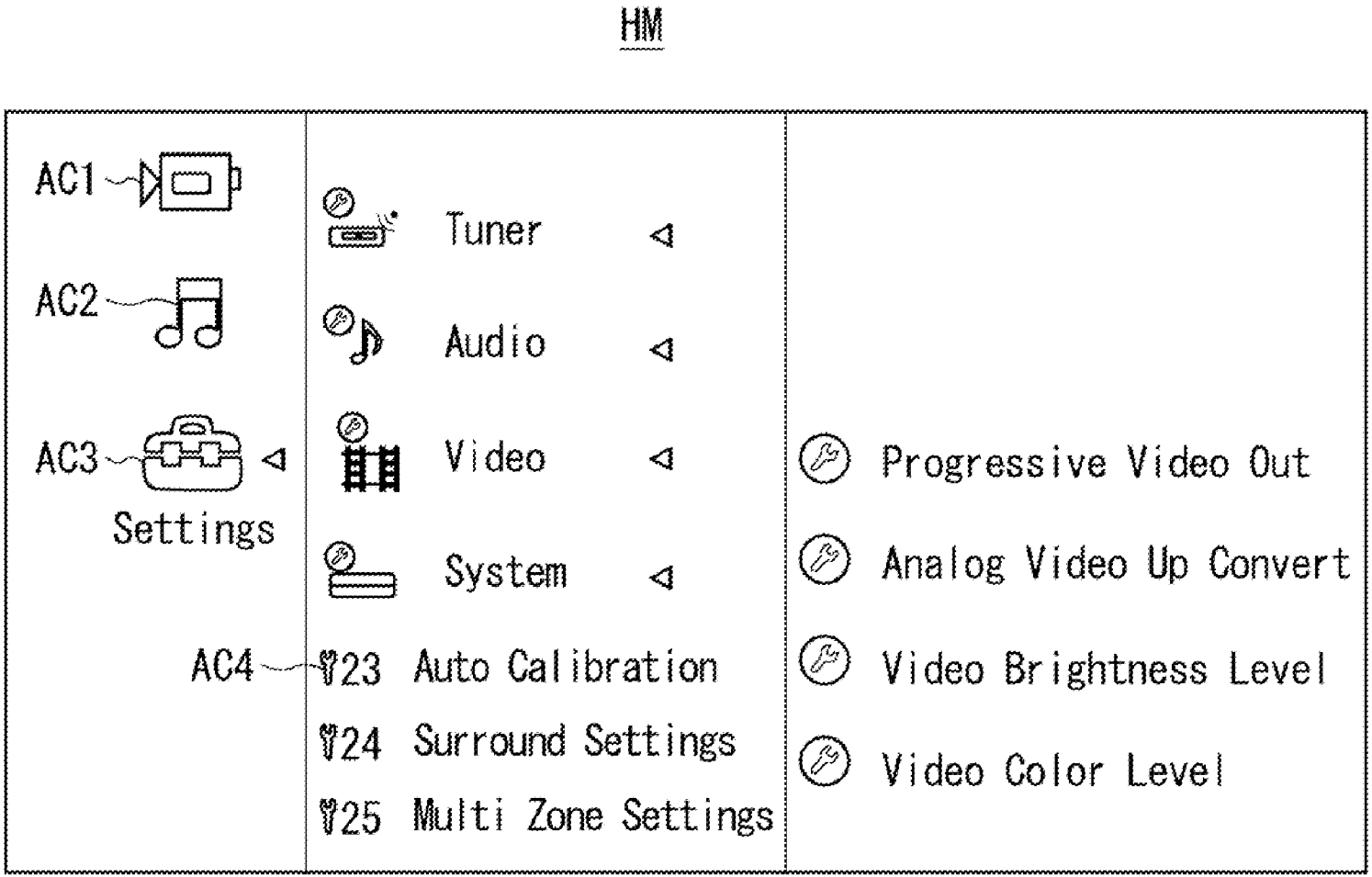
FIG. 3 is a schematic diagram illustrating a home screen.

(4-1) Automatic Acoustic Filed Setup through GUI After being powered on, the control section 10 of the home server 2 controls the graphic processing section 15 to generate a home screen HM (as shown in FIG. 3), which is then displayed on the LCD 5. The uppermost stratum of the home screen HM includes a "Video" icon AC1, a "Music" icon AC2 and a "Setting" icon AC3.

Figure 4:
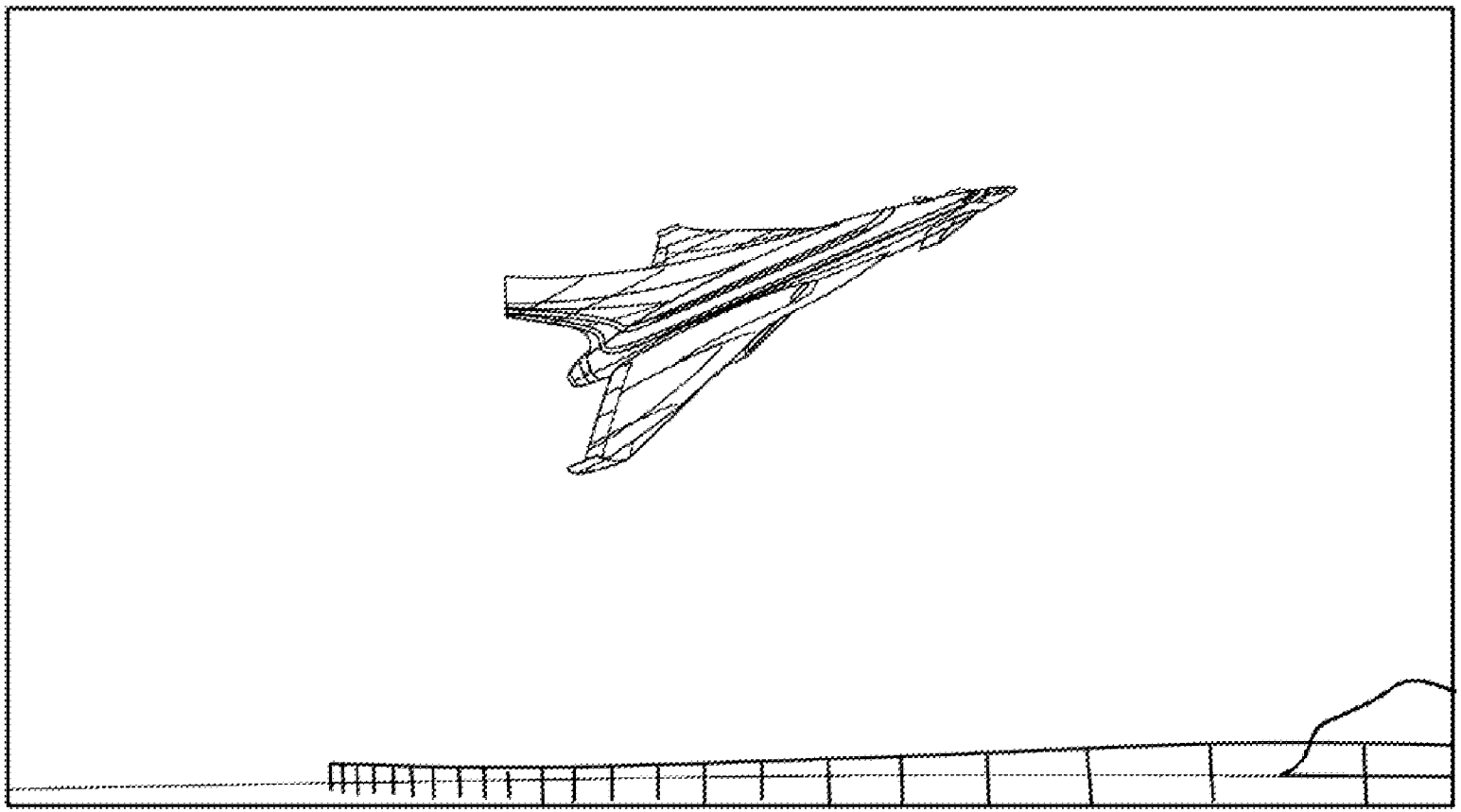
FIG. 4 is a schematic diagram illustrating a video image.

When the "Video" icon AC1 on the home screen HM is selected, the control section 10 displays on the LCD 5 a video image VS based on the video signals supplied from the DVD player 3A, as shown in FIG. 4.

Figure 5:
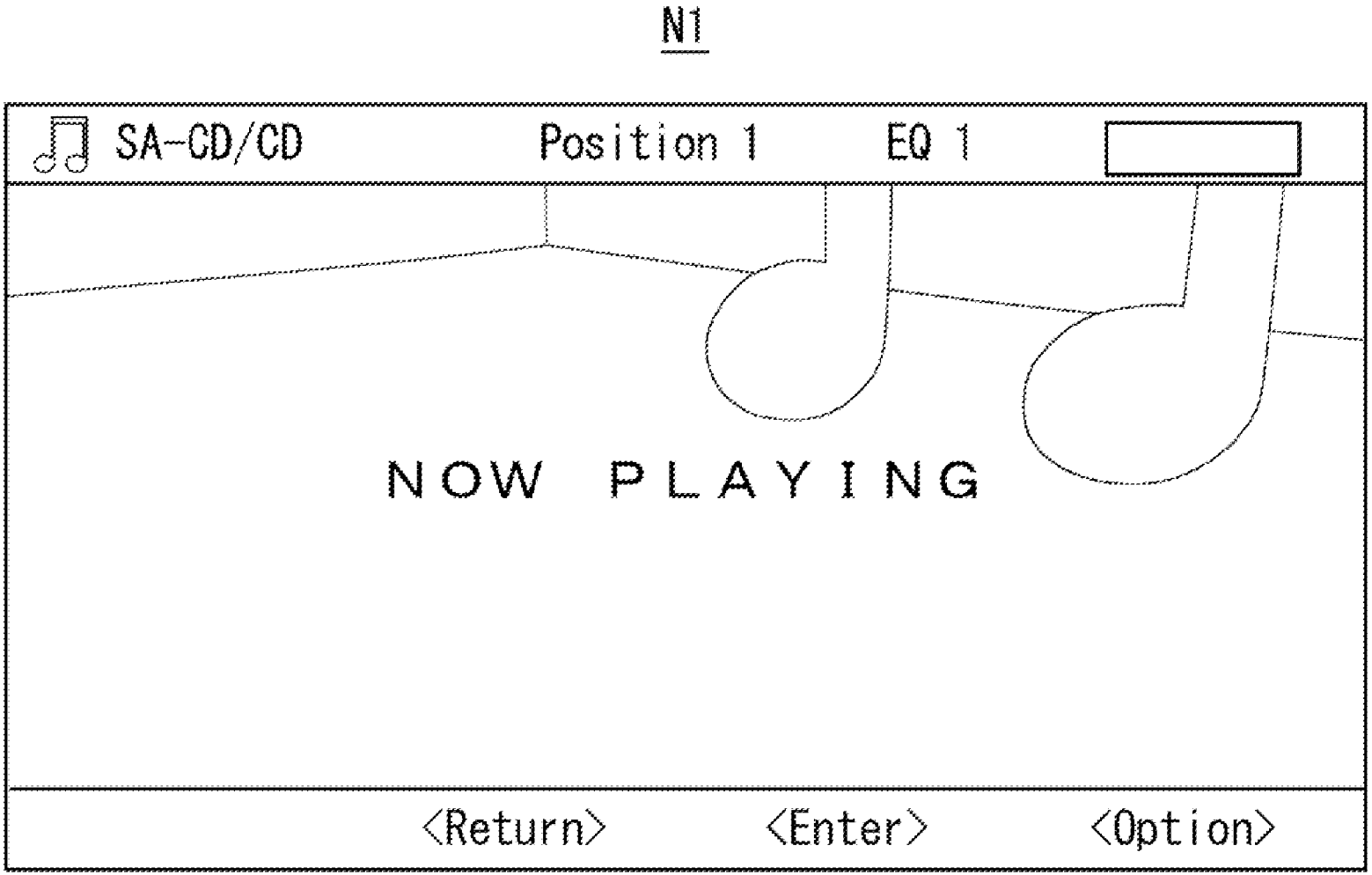
FIG. 5 is a schematic diagram illustrating a notification screen for reproducing a CD.

When the "Music" icon AC2 is selected, the control section 10 controls the graphic processing section 15 to generate a notification screen N1 (as shown in FIG. 5) including a string of characters ("NOW PLAYING"), which is for example irrelevant to the nusic reproduced by the CD player 3B, and then displays the notification screen N1 on the LCD5. Alternatively, the control section 10 may control the graphic processing section 15 to generate a notification screen N2 (as shown in FIG. 6) including information such as a track number, time elapsed since the start of reproduction, artist name and album name of the music reproduced by the portable music player 3C and then display the notification screen N2 on the LCD5.

Figure 6:
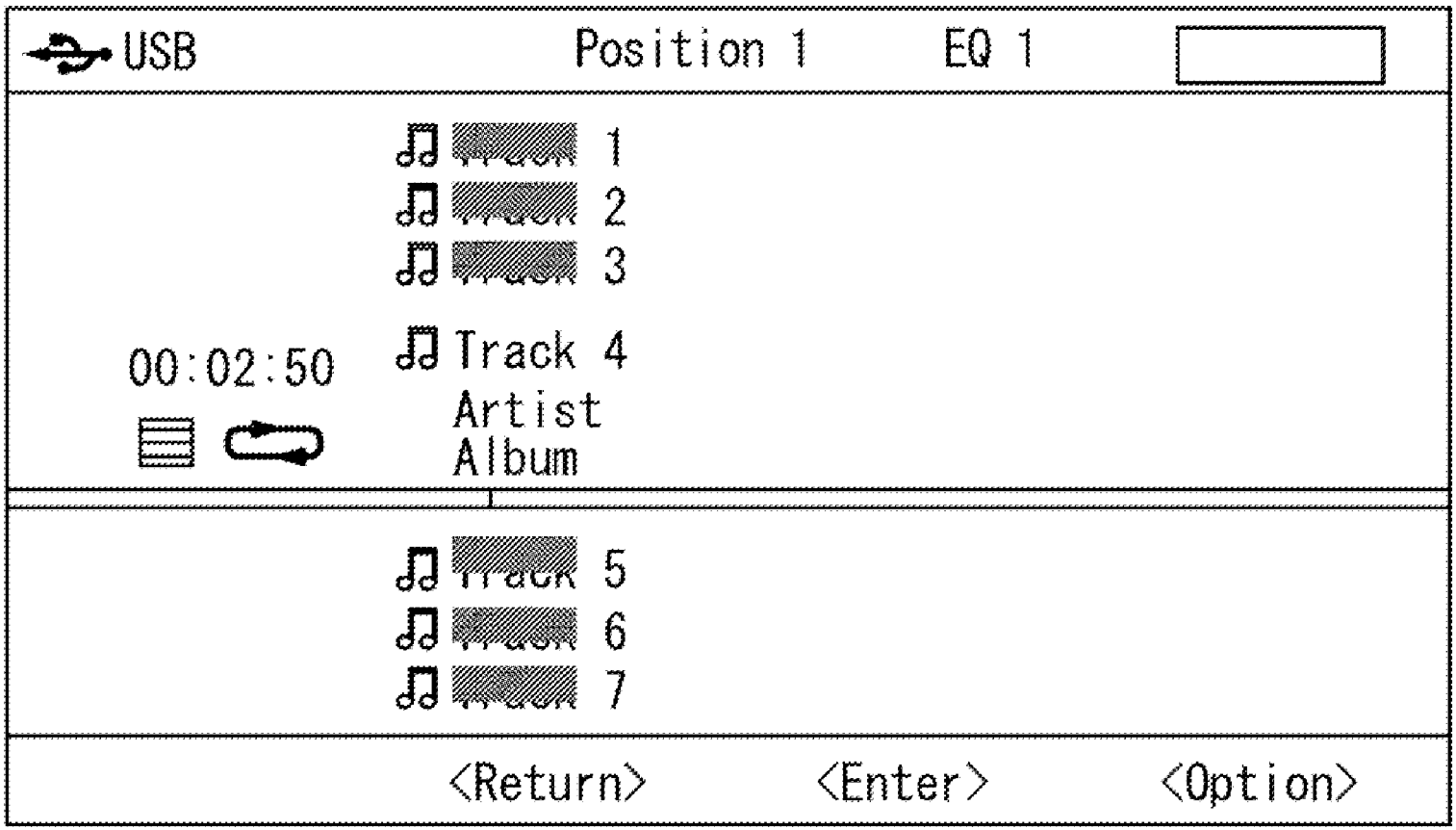
FIG. 6 is a schematic diagram illustrating a notification screen for reproduction by a portable music player.

In that manner, the control section 10 displays the notification screens N1 and N2 (FIGS. 5 and 6). This helps the users understand through their eyes the fact that the CD is being played back or the information regarding the music reproduced by the portable music player 3C.

In addition, the control section 10 of the home server 2 displays on the LCD 5 the GUI screens to perform an acoustic field autonomic setup process and an acoustic field manual setup process, which are easy-to-use. In this case, the "Setting" icon AC3 (FIG. 3) is selected by the user. Subsequently, an "Auto Calibration" icon AC4 is selected by the user from the lower stratum.

Figure 7:
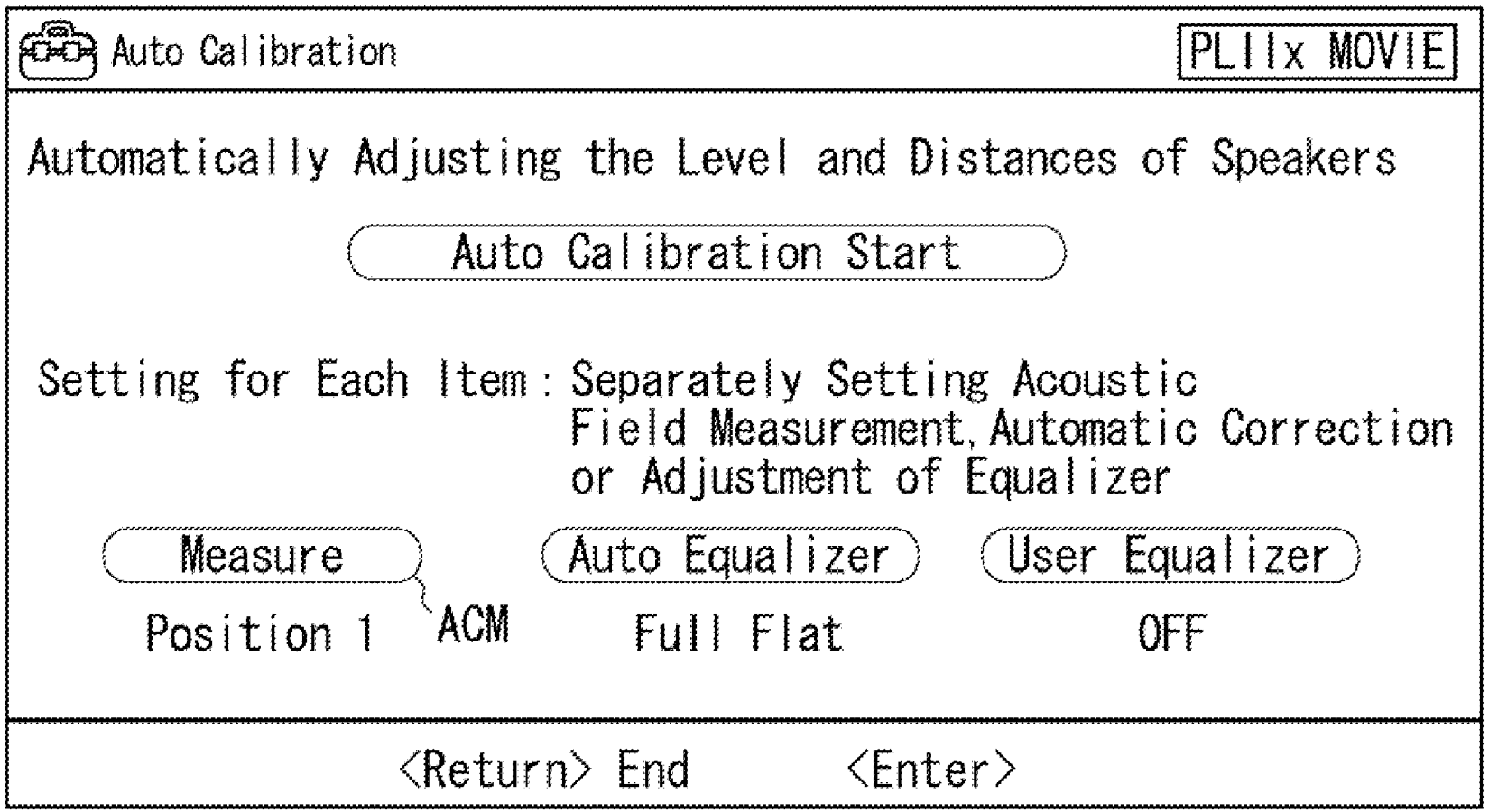
FIG. 7 is a schematic diagram illustrating an auto calibration top screen.

In this case, as shown in FIG. 7, the control section 10 displays on the LCD 5 an auto calibration top screen CT generated by the graphic processing section 15. The auto calibration top screen CT is a first screen to be used to automatically start the acoustic setup process. The auto calibration top screen CT includes a string of characters ("Automatically Adjusting the Level and Distances of Speakers"). A new screen replaces the auto calibration top screen CT on the LCD 5 when the user pushes an "Enter" key of the remote controller RCL.

Figure 8:
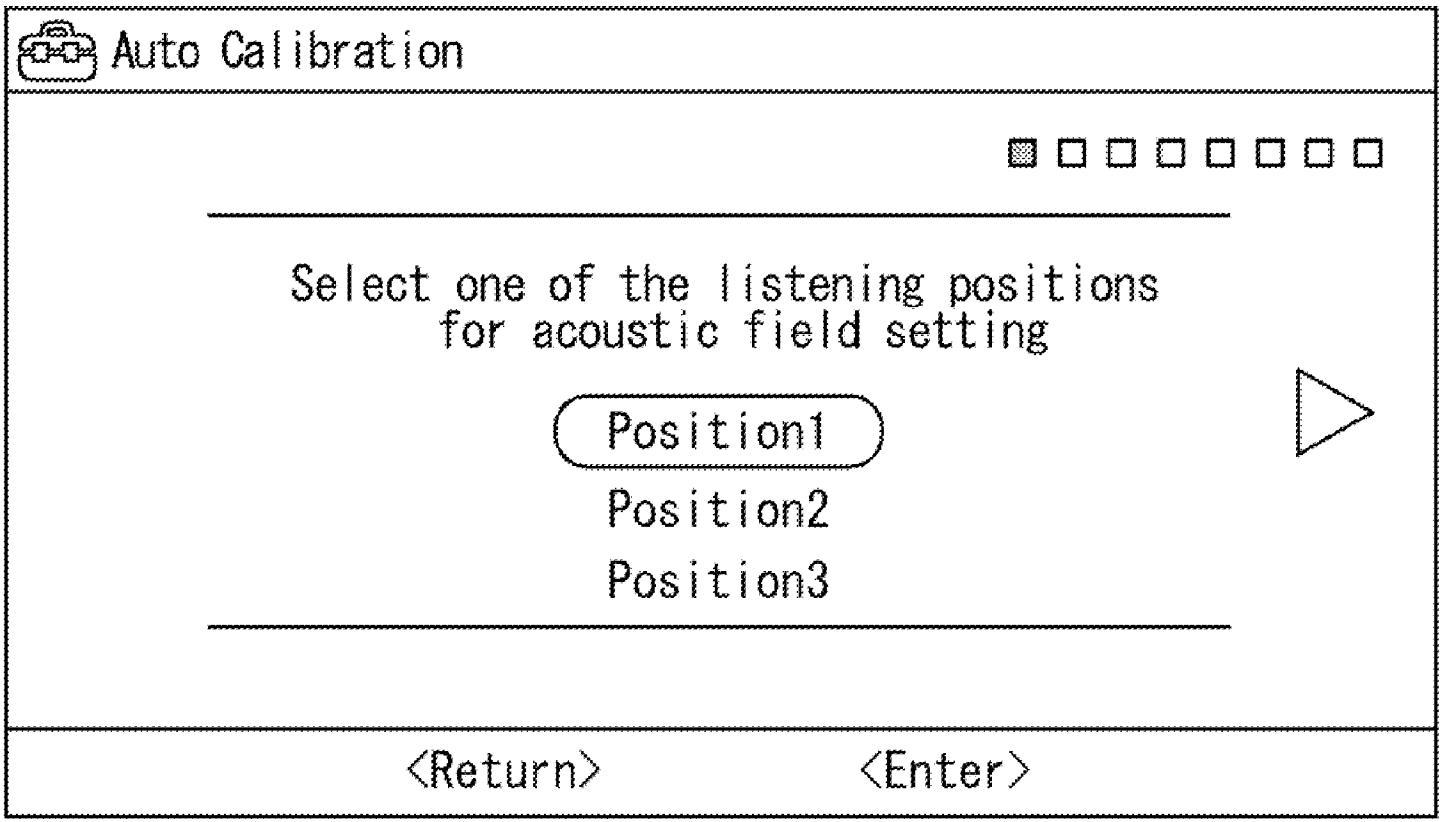
FIG. 8 is a schematic diagram illustrating a listening position selection screen.

As shown in FIG. 8, when the "Enter" key of the remove controller RCL is pushed down, the control section 10 displays on the LCD 5 a listening position selection screen LPS generated by the graphic processing section 15.

The listening position selection screen LPS is used to select one of three listening positions ("Position 1", "Position 2" or "Position 3"). The user pushes an up-down key of the remote controller RCL to select one of the listening positions ("Position 1", "Position 2" or "Position 3").

Those listening positions, which can be set through the listening position selection screen LPS, may be associated with three listening points in the acoustic field space. The listening positions may be associated with three different types of correction patterns when the listening points are all the same. Alternatively, the listening positions may be associated with three different users. Their names may be freely changed.

The control section 10 replaces the listening position selection screen LPS (FIG. 8) on the LCD 5 with a measurement item check screen MIC (FIG. 7), which was generated by the graphic processing section 15, when the "Enter" key of the remote controller RCL is pushed down.

Figure 9:
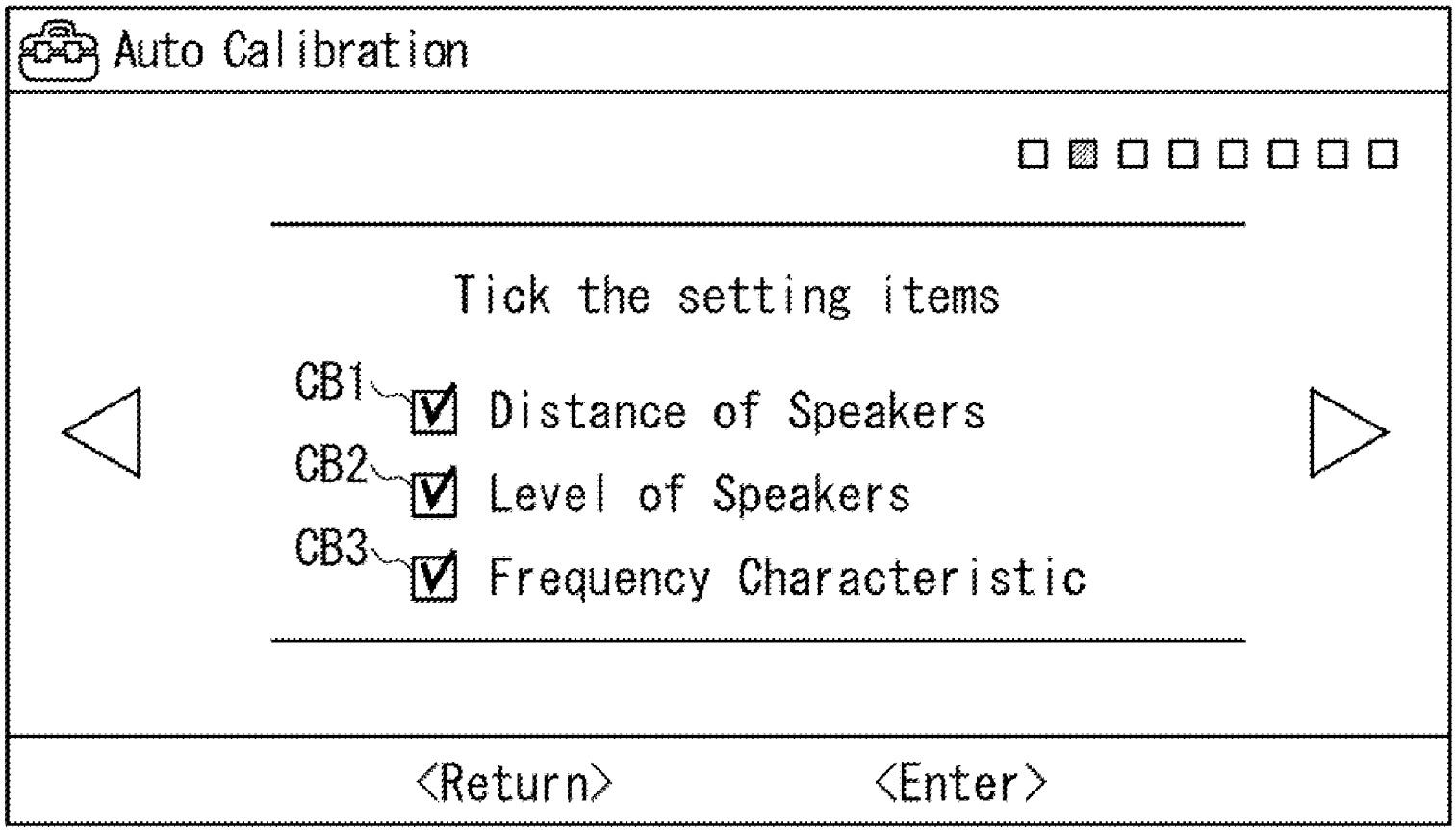
FIG. 9 is a schematic diagram illustrating a measurement item check screen.

The measurement item check screen MIC (FIG. 9) includes three items in order for the user to set up the acoustic filed: "Distance of Speakers", "Level of Speakers" and "Frequency Characteristic". The measurement item check screen MIC also includes checkboxes CB1 to CB3 in order for the user to tick or choose one or some of the items.

Figure 10:
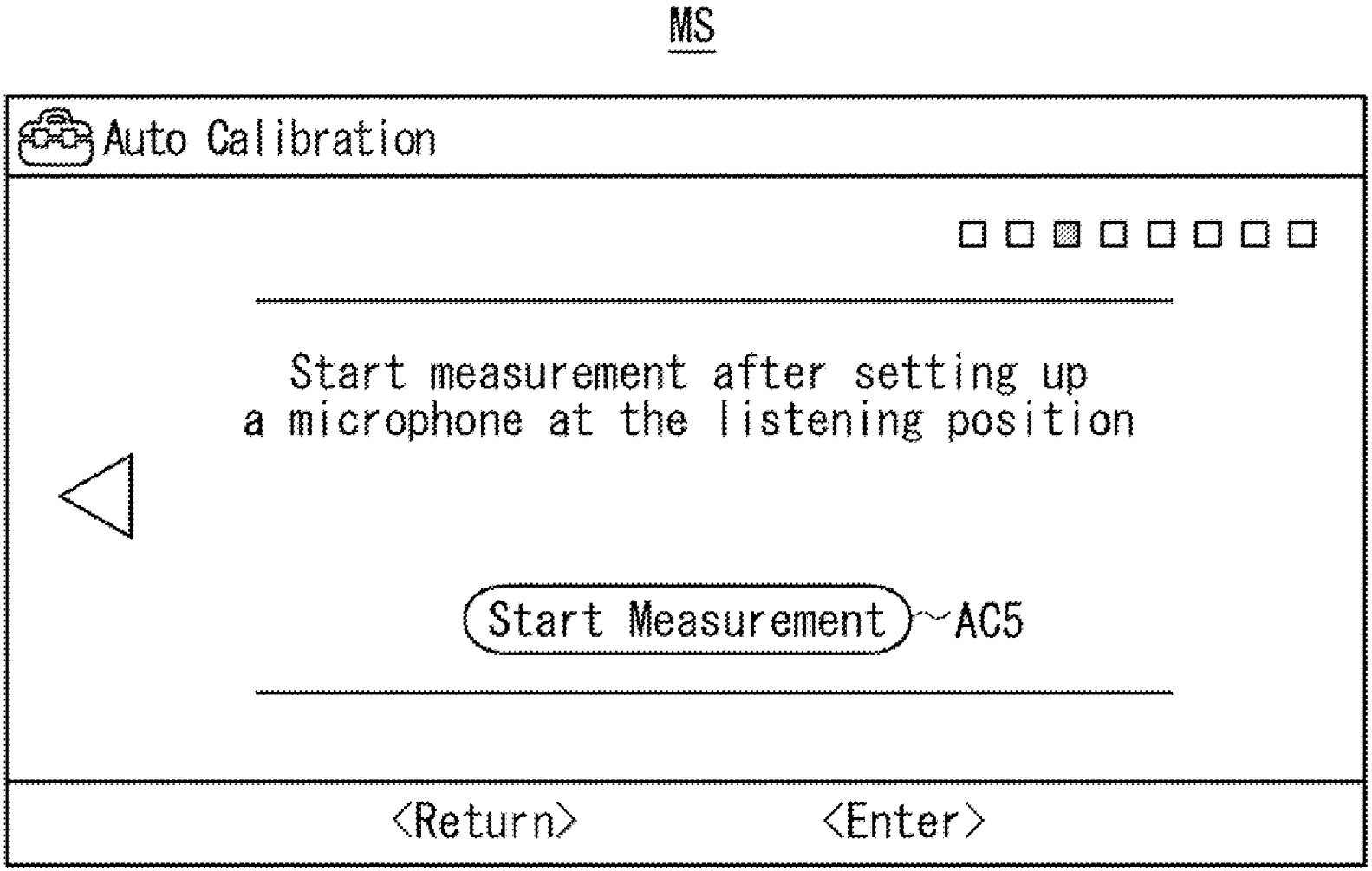
FIG. 10 is a schematic diagram illustrating a measurement start screen.

After one or some of the three items on the measurement item check screen MIC (FIG. 9) are checked and then the "Enter" key of the remote controller RCL is pushed down, the control section 10 replaces, as shown in FIG. 10, the measurement item check screen MIC on the LCD 5 with a measurement start screen MS, which was generated by the graphic processing section 15.

The measurement start screen MS (FIG. 10) includes a string of characters ("Start measurement after setting up a microphone at the listening position") along with a "Start Measurement" icon AC5.

Figure 11:
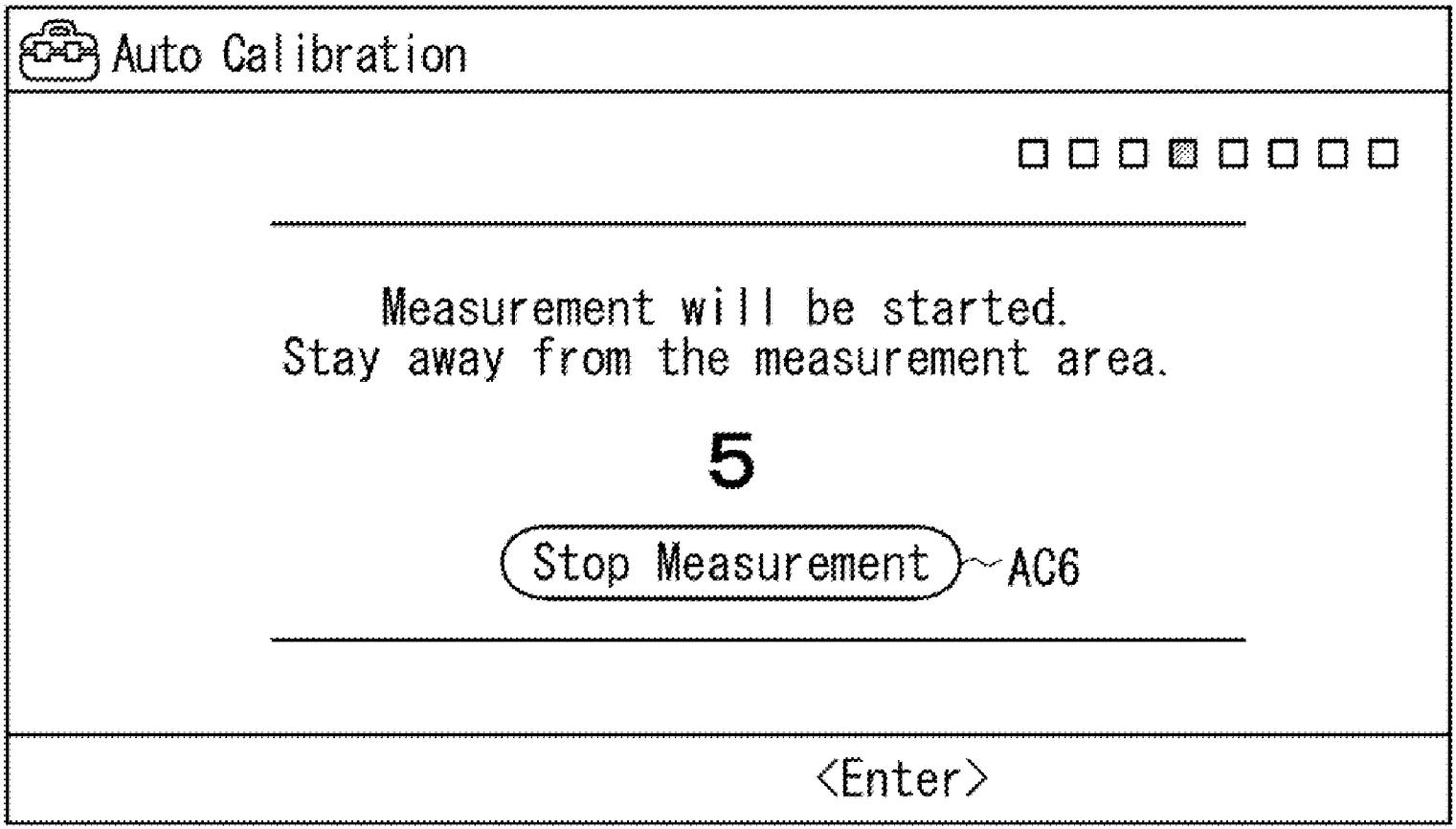
FIG. 11 is a schematic diagram illustrating a measurement notification screen.

When the "Enter" key of the remote controller RCL is pushed down while the "Start Measurement" icon AC5 of the measurement start screen MS (FIG. 10) is being focused, the control section 10 replaces, as shown in FIG. 11, the measurement start screen MS on the LCD 5 with a measurement notification screen MZ, which was generated by the graphic processing section 15.

The measurement notification screen MZ (FIG. 11) displays a notification message, such as "Measurement will be started. Stay away from the measurement area", for the precise measurement. The measurement notification screen MZ also displays a 5 second countdown to encourage the user, who watches the measurement notification screen MZ, to evacuate the measurement area by the start of the measurement.

When the "Enter" key of the remote controller RCL is pushed down while a "Stop Measurement" icon AC6 of the measurement notification screen MZ (FIG. 11) is being focused, the control section 10 stops measuring and then replaces the measurement notification screen MZ on the LCD 5 with the above-noted auto calibration top screen CT (FIG. 7).

Figure 12:
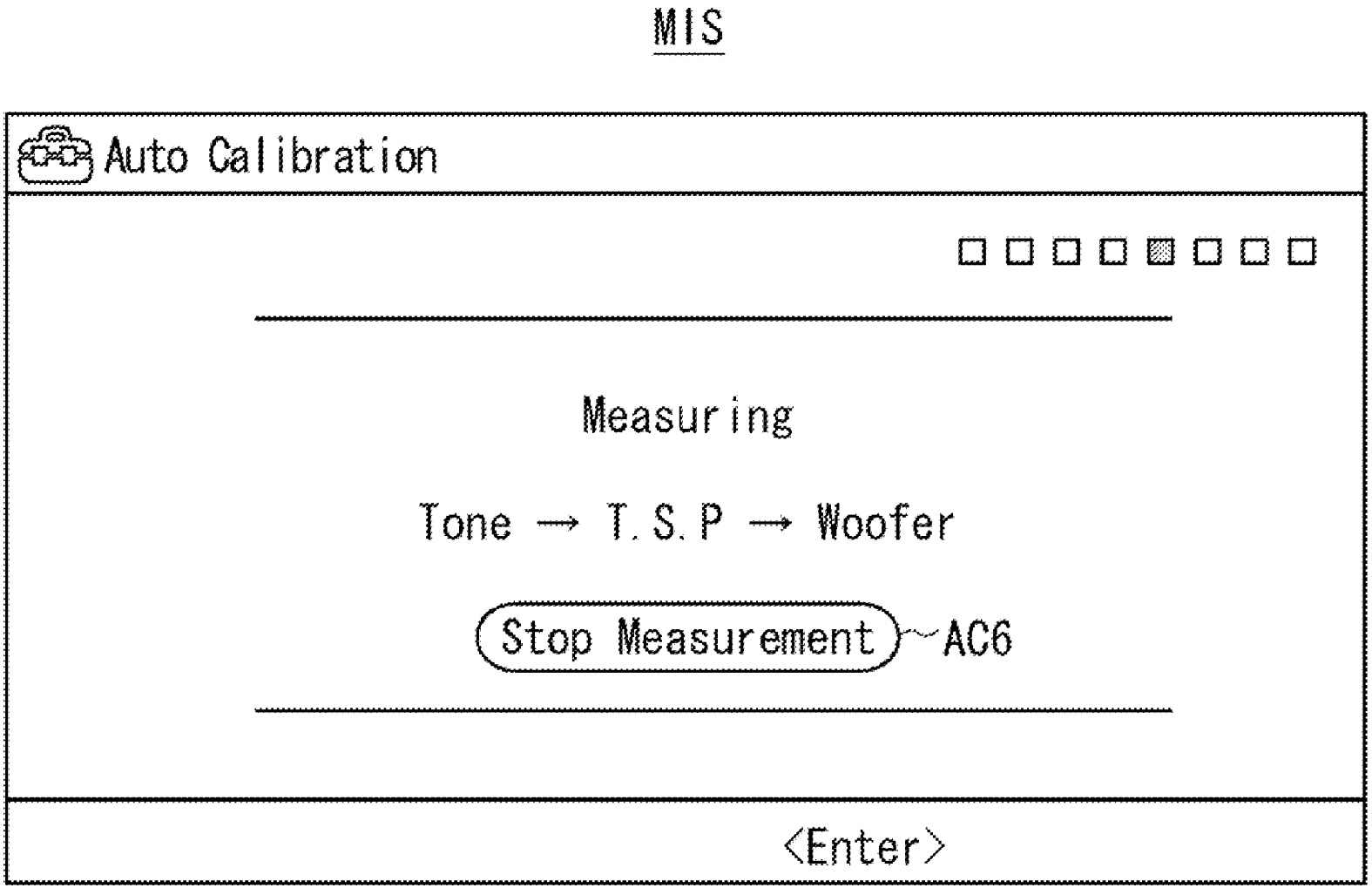
FIG. 12 is a schematic diagram illustrating a measurement progress screen.

When the "Enter" key of the remote controller RCL is pushed down, the control section 10 replaces, as shown in FIG. 12, the measurement notification screen MZ (FIG. 11) on the LCD 5 with a measurement progress screen MIS, which was generated by the graphic processing section 15.

The measurement progress screen MIS (FIG. 12) displays a string of characters ("Measuring") to notify the user of the fact that the measurement process regarding the selected items (such as the "Distance of Speakers", "Level of Speakers" and "Frequency Characteristic" displayed on the measurement item check screen MIC (FIG. 9)) is being performed.

By the way, the user can stop the measurement by pushing the "Enter" key of the remote controller RCL after selecting the "Stop Measurement" icon AC6.

Figure 13:
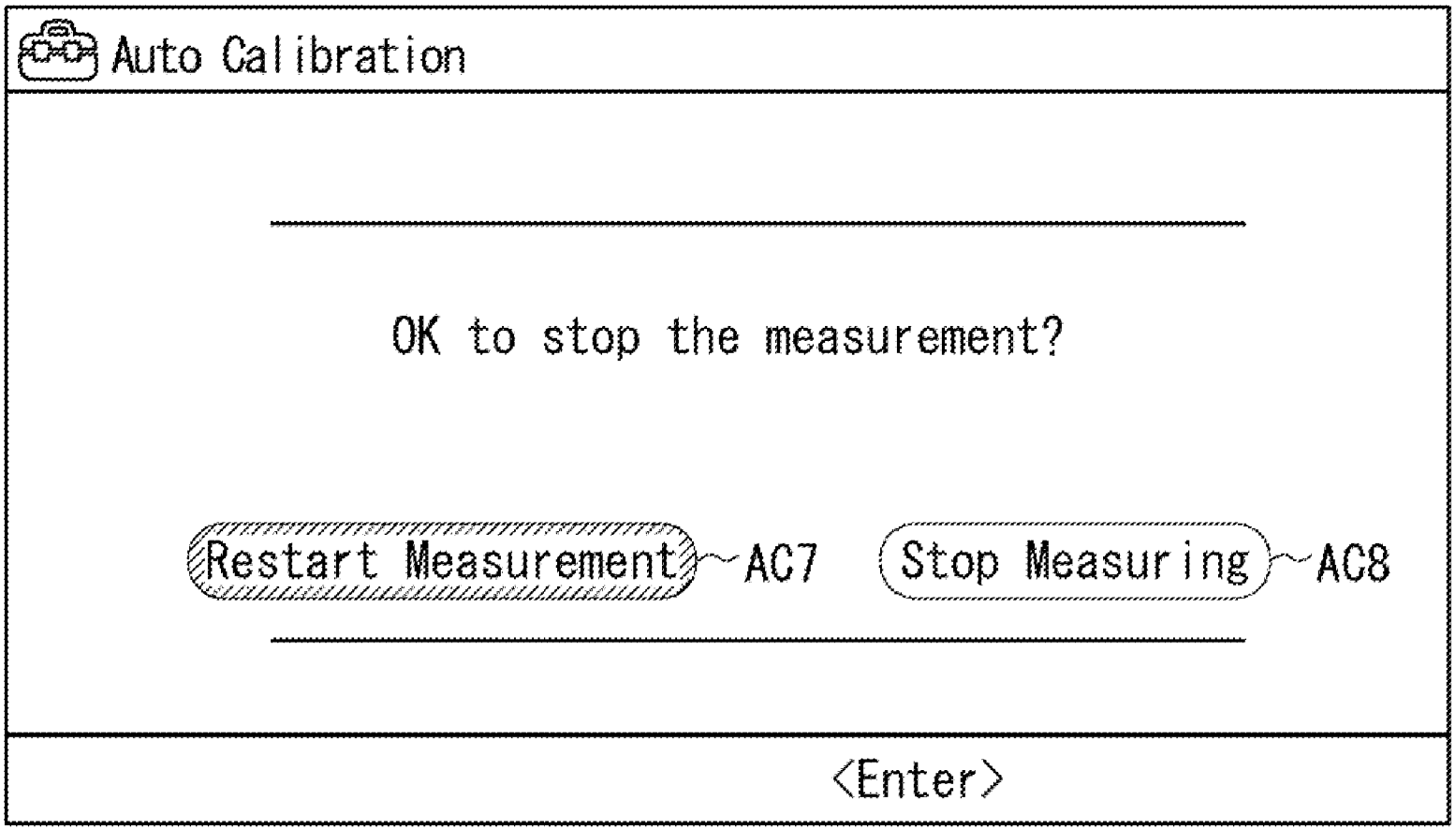
FIG. 13 is a schematic diagram illustrating a measurement stop inquiry screen.
Figure 14:
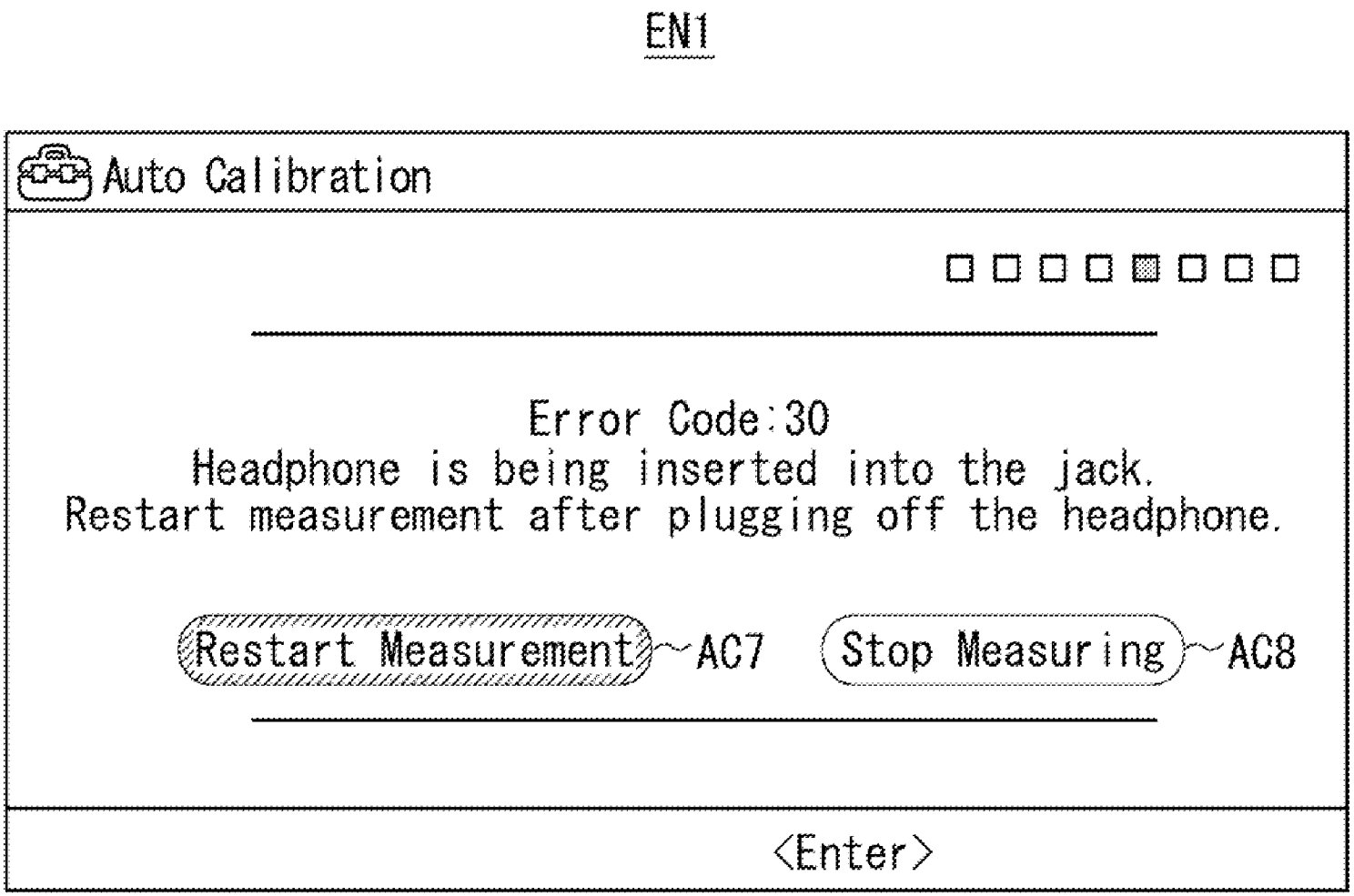
Figure 15:
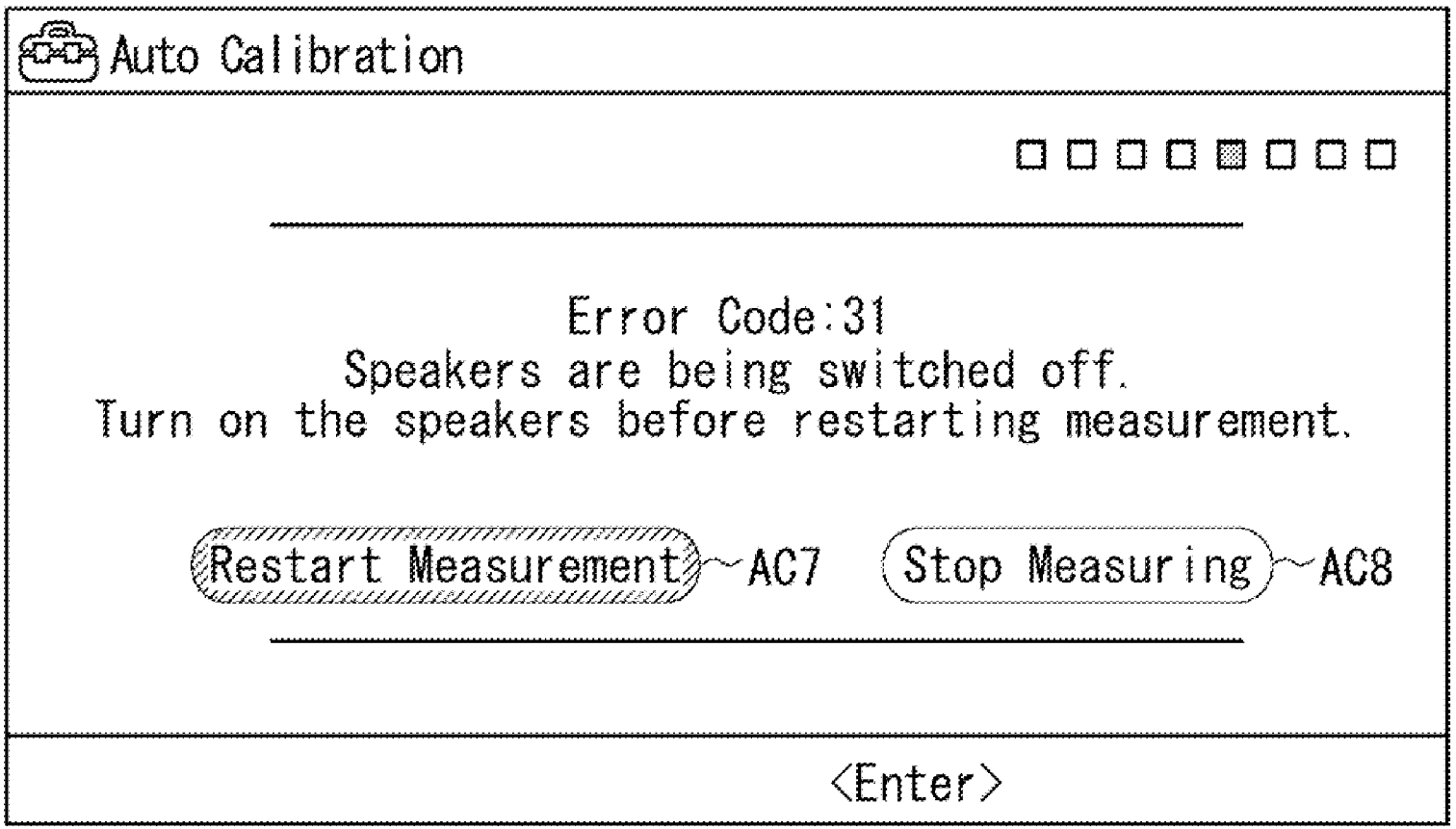
Figure 16:
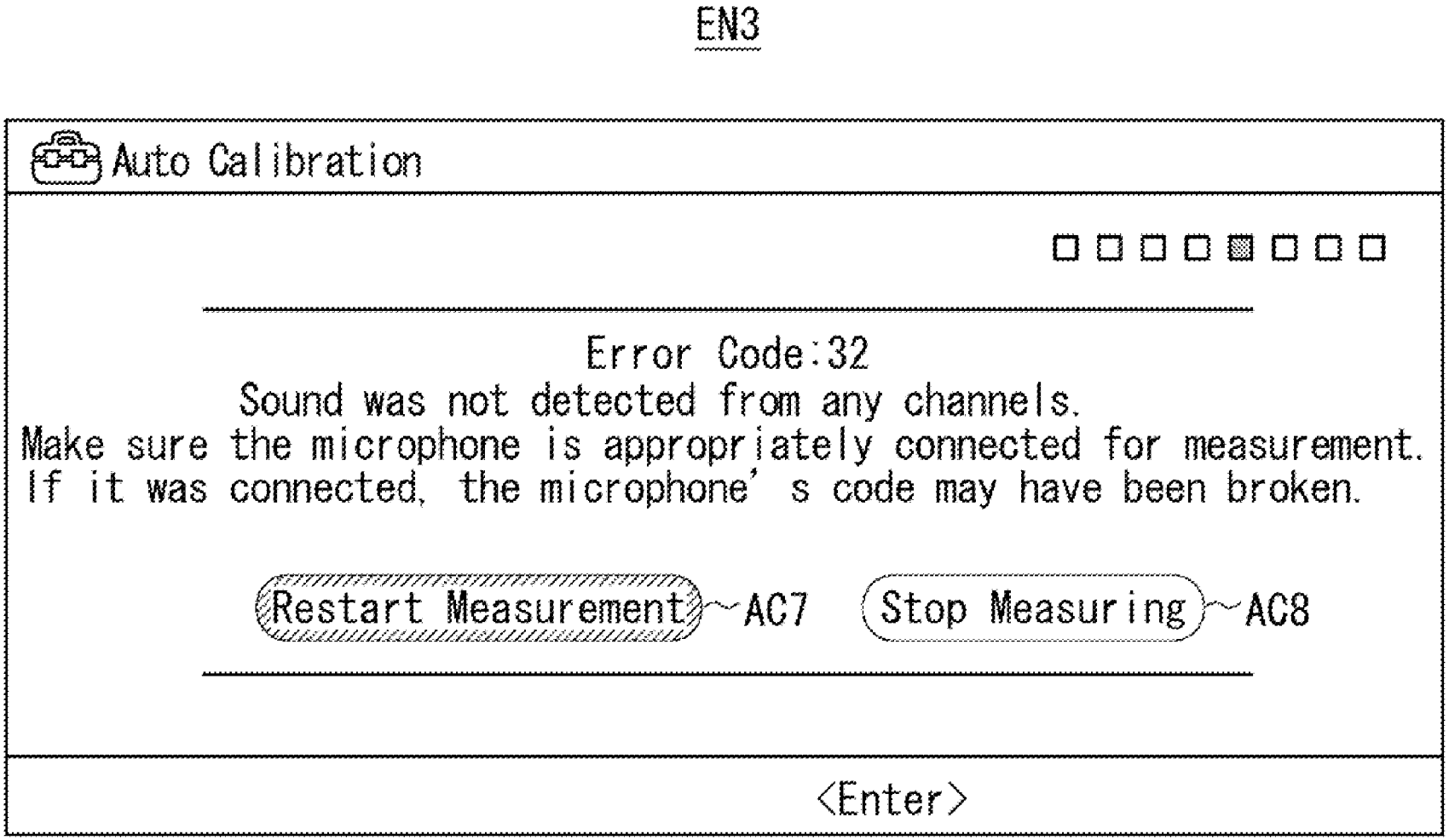
Figure 17:
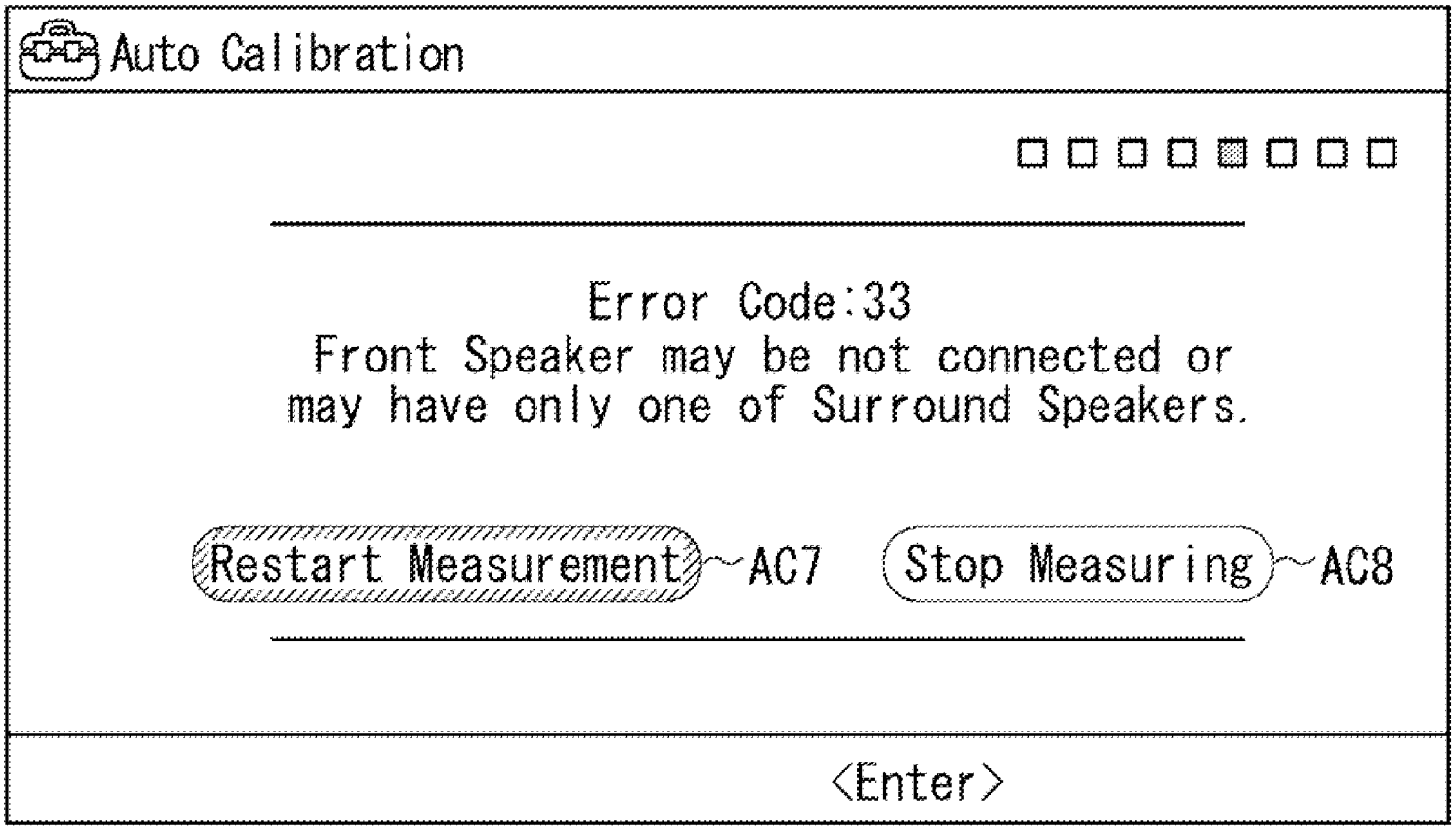

When the "Enter" key of the remote controller RCL is pushed down while the "Stop Measurement" icon AC6 of the measurement progress screen MIS (FIG. 12) is being focused, the control section 10 replaces, as shown in FIG. 13, the measurement progress screen MIS on the LCD 5 with a measurement stop inquiry screen MSTP, which was generated by the graphic processing section 15.

The measurement stop inquiry screen MSTP (FIG. 13) includes a string of characters ("OK to stop the measurement?"). The measurement stop inquiry screen MSTP also includes a "Restart Measurement" icon AC7 and a "Stop Measuring" icon AC8.

Only when the "Enter" key of the remote controller RCL is pushed down while the "Stop Measuring" icon AC8 of the measurement stop inquiry screen MSTP (FIG. 13) is being focused, the control section 10 stops the measurement of the acoustic field space and then replaces the measurement stop inquiry screen MSTP on the LCD 5 with the auto calibration top screen TP (FIG. 7).

By the way, when the "Enter" key of the remote controller RCL is pushed down while the "Restart Measurement" icon AC7 of the measurement stop inquiry screen MSTP (FIG. 13) is being focused, the control section 10 replaces the measurement stop inquiry screen MSTP on the LCD 5 with the measurement start screen MS (FIG. 10) to restart the measurement.

By the way, when the control section 10 runs into an error while displaying the measurement progress screen MIS (FIG. 12), the control section 10 displays on the LCD 5, as shown in FIGS. 14 to 18, one of error notification screens EN1 to EN5, which was generated by the graphic processing section 15, in accordance with the type of the error.

The error notification screen EN1 (FIG. 14) includes a string of characters ("Error Code: 30") indicating that the error of the Error Code 30 has occurred. In addition, the description and instruction for the error are displayed to notify the user: The message is "Headphone is being inserted into the jack. Restart measurement after plugging off the headphone."

The error notification screen EN2 (FIG. 15) includes a string of characters ("Error Code: 31") indicating that the error of the Error Code 31 has occurred. In addition, the description and instruction for the error are displayed to notify the user: The message is "Speakers are switched off. Turn on the speakers before restarting measurement."

The error notification screen EN3 (FIG. 16) includes a string of characters ("Error Code: 32") indicating that the error of the Error Code 32 has occurred. In addition, the description and instruction for the error are displayed to notify the user: The message is "Sound was not detected from any channels. Make sure the microphone is appropriately connected for measurement. If it was connected, the microphone's code may have been broken."

Similarly, the error notification screen EN4 (FIG. 17) includes a string of characters ("Error Code: 33") indicating that the error of the Error Code 33 has occurred. In addition, the description and instruction for the error are displayed to notify the user: The message is "Front Speaker may be not connected or may have only one of Surround Speakers."

Moreover, the error notification screen EN5 (FIG. 18) includes a string of characters ("Error Code: 34") indicating that the error of the Error Code 34 has occurred. In addition, the description and instruction for the error are displayed to notify the user: The message is "Speakers may not be appropriately placed like the right speaker on the left side. Refer to the instruction manual (Preparation 1: Arrangement of Speakers) for rearrangement of speakers." In this embodiment, there are the five error notification screens EN1 to EN5 as noted above. However, there may be more error notification screens.

When the "Enter" key of the remote controller RCL is pushed down while the "Restart Measurement" icon AC7 of the error notification screens EN1 to EN5 (FIGS. 14 to 18) is being focused, the control section 10 replaces the error notification screens EN1 to EN5 on the LCD 5 with the listening position selection screen LPS (FIG. 8) to perform a re-measurement process.

On the other hand, when the "Enter" key of the remote controller RCL is pushed down while the "Stop Measurement" icon AC8 of the error notification screens EN1 to ENS (FIGS. 14 to 18) is being focused, the control section 10 replaces the error notification screens EN1 to EN5 on the LCD 5 with the auto calibration top screen TP (FIG. 7) to end the measurement process.

If the control section 10 completes the measurement process without having any errors, the control section 10 replaces the measurement progress screen MIS (FIG. 12) on the LCD 5 with a measurement completion screen MFN (FIG. 19), which was generated by the graphic processing section 15.

The measurement completion screen MFN (FIG. 19) displays the plurality of speakers 4 (4FL, 4FR, 4CT, 4SL, 4SR, 4SBL, 4SBR or 4SW) in the acoustic field space in three-dimensional manner. A message ("Complete Measurement") notifies the user of the fact that the measurement of the acoustic field space was completed.

The measurement completion screen MFN (FIG. 19) shows the arrangement of the plurality of speakers 4 (4FL, 4FR, 4CT, 4SL, 4SR, 4SBL, 4SBR or 4SW) in three-dimensional manner. In addition, the distance (meter) from a listening point LP1 (specified as a listening position) to each speaker 4 is displayed. Moreover, the volume balance (relative) between the speakers 4, the volume levels (dB) and the like are displayed, along with a "Next" icon AC9.

Figure 19:
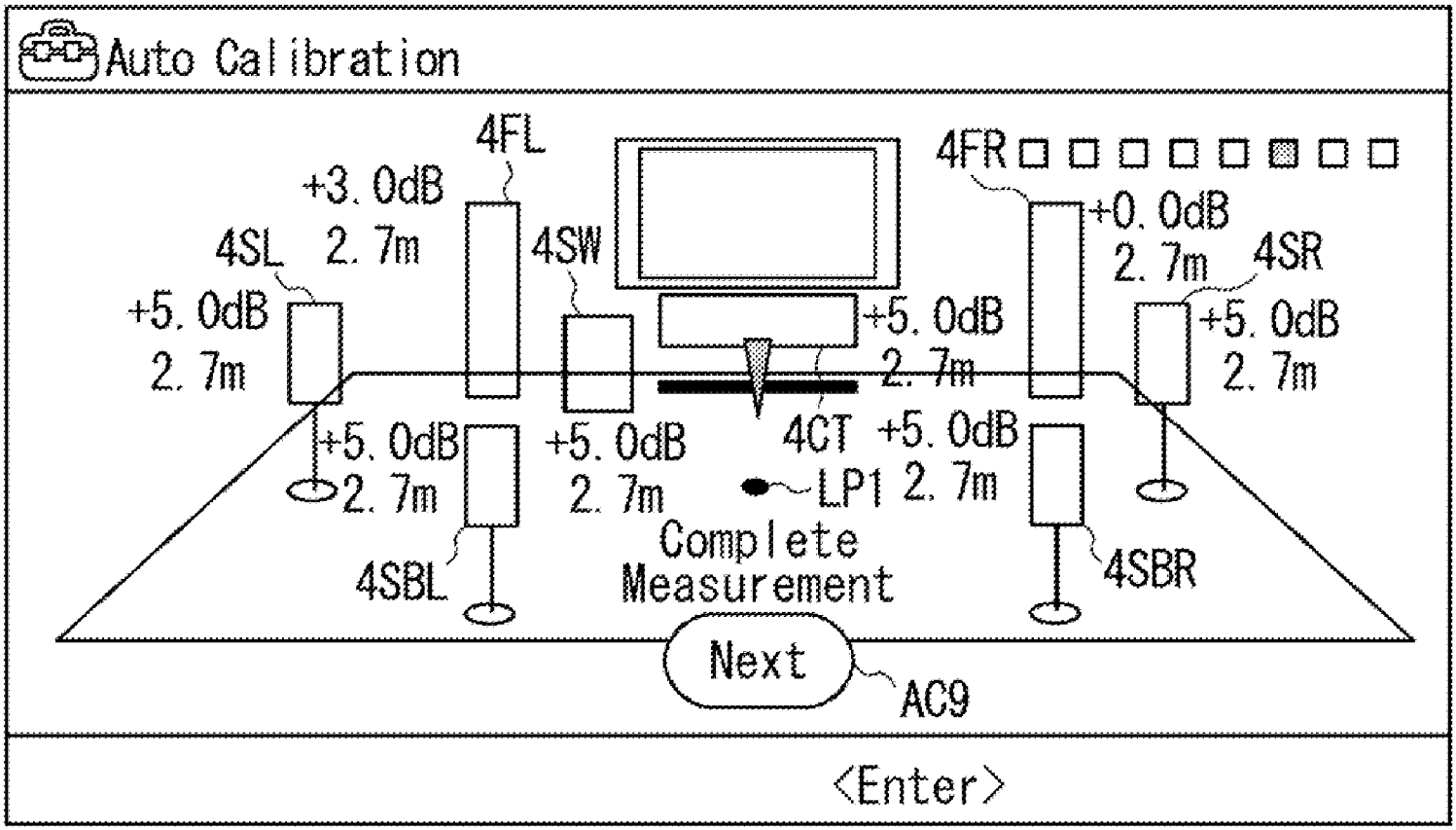
FIG. 19 is a schematic diagram illustrating a measurement completion screen.
Figure 20:
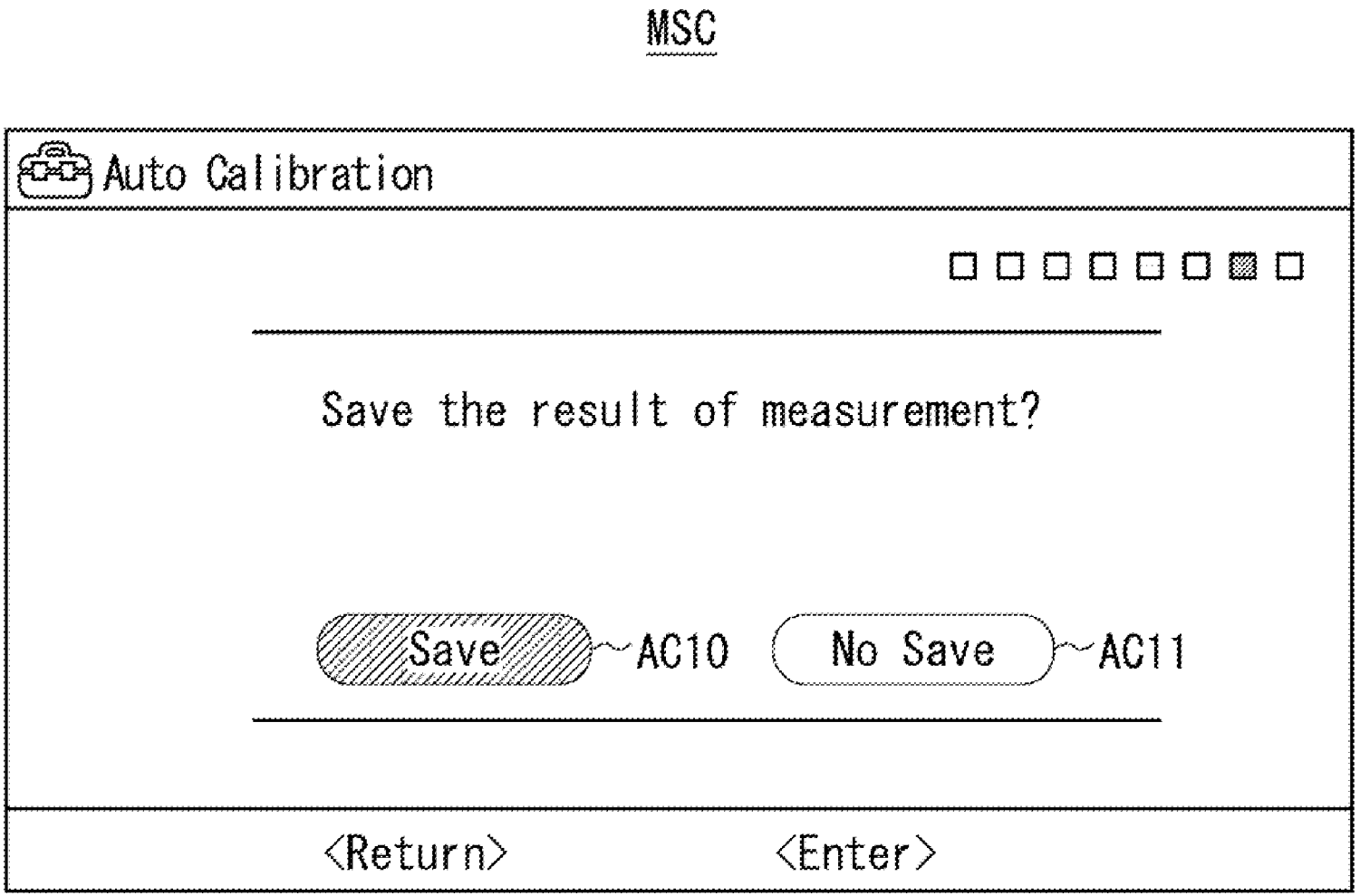
FIG. 20 is a schematic diagram illustrating a measurement result storage selection screen.

When the "Enter" key of the remote controller RCL is pushed down while the "Next" icon AC9 of the measurement completion screen MFN (FIG. 19) is being focused, the control section 10 replaces, as shown in FIG. 20, the measurement completion screen MFN on the LCD 5 with a measurement result storage selection screen MSC, which was generated by the graphic processing section 15.

Figure 21:
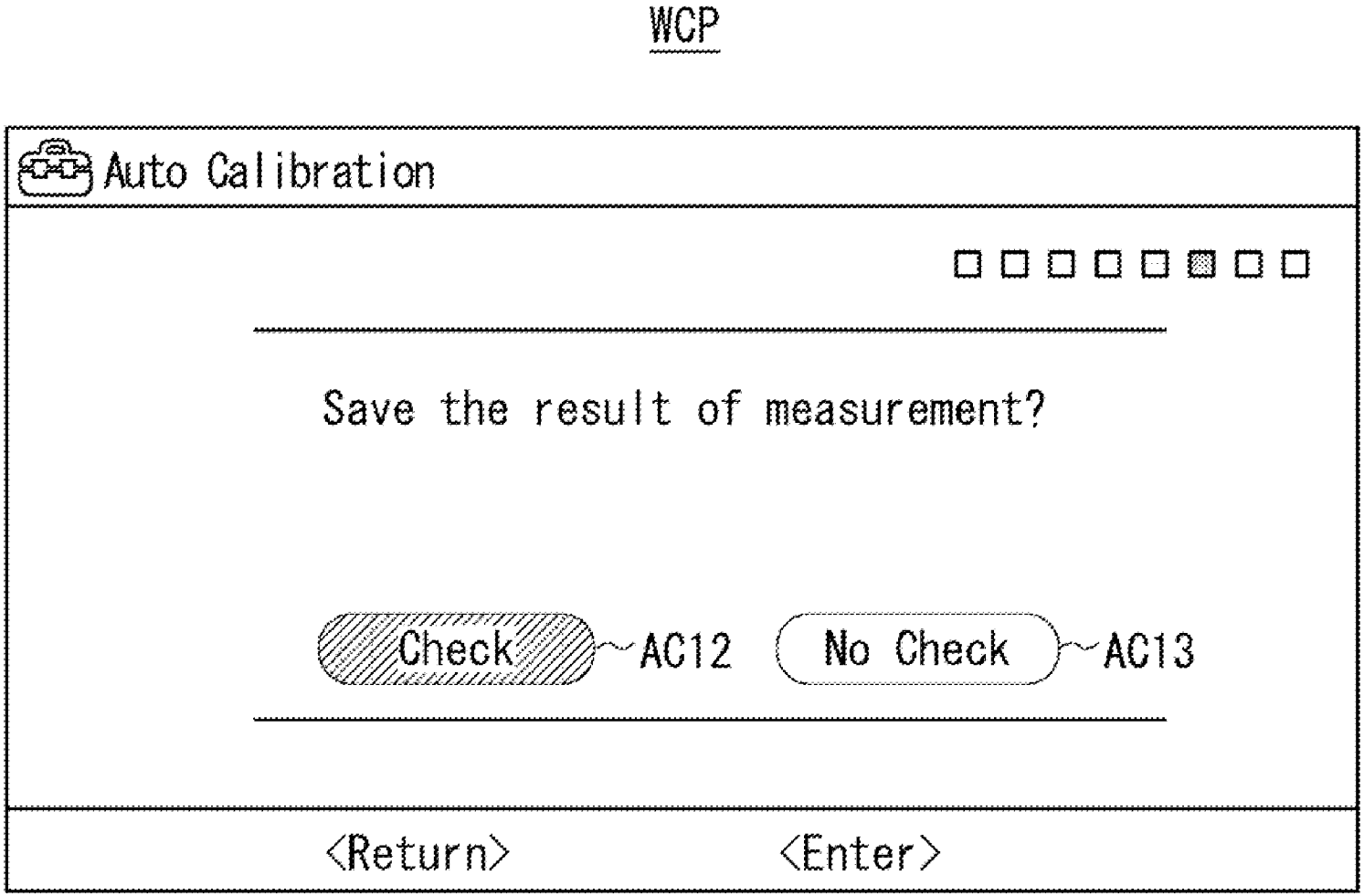
FIG. 21 is a schematic diagram illustrating a warning confirmation selection screen.
Figure 22:
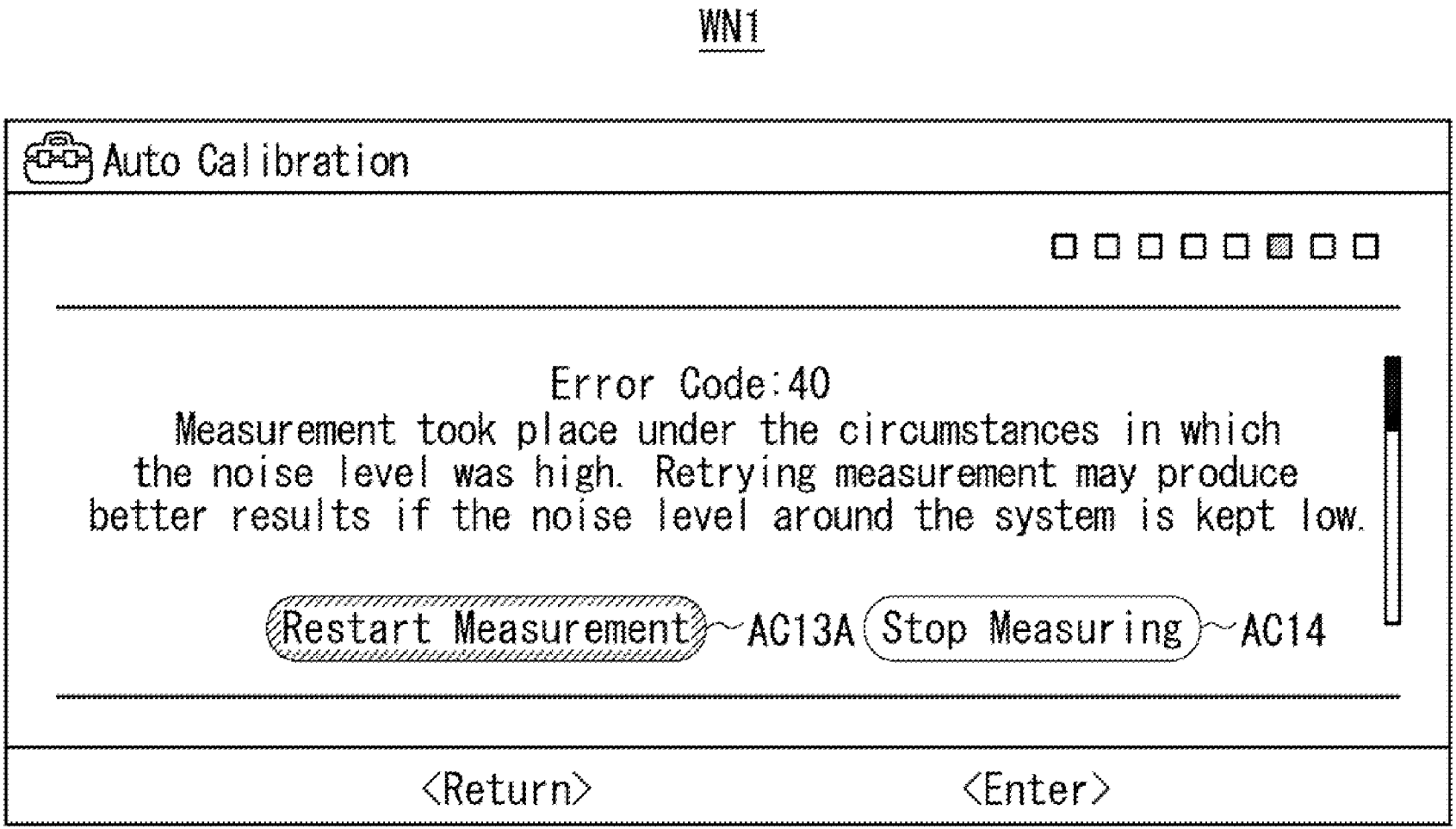
Figure 23:
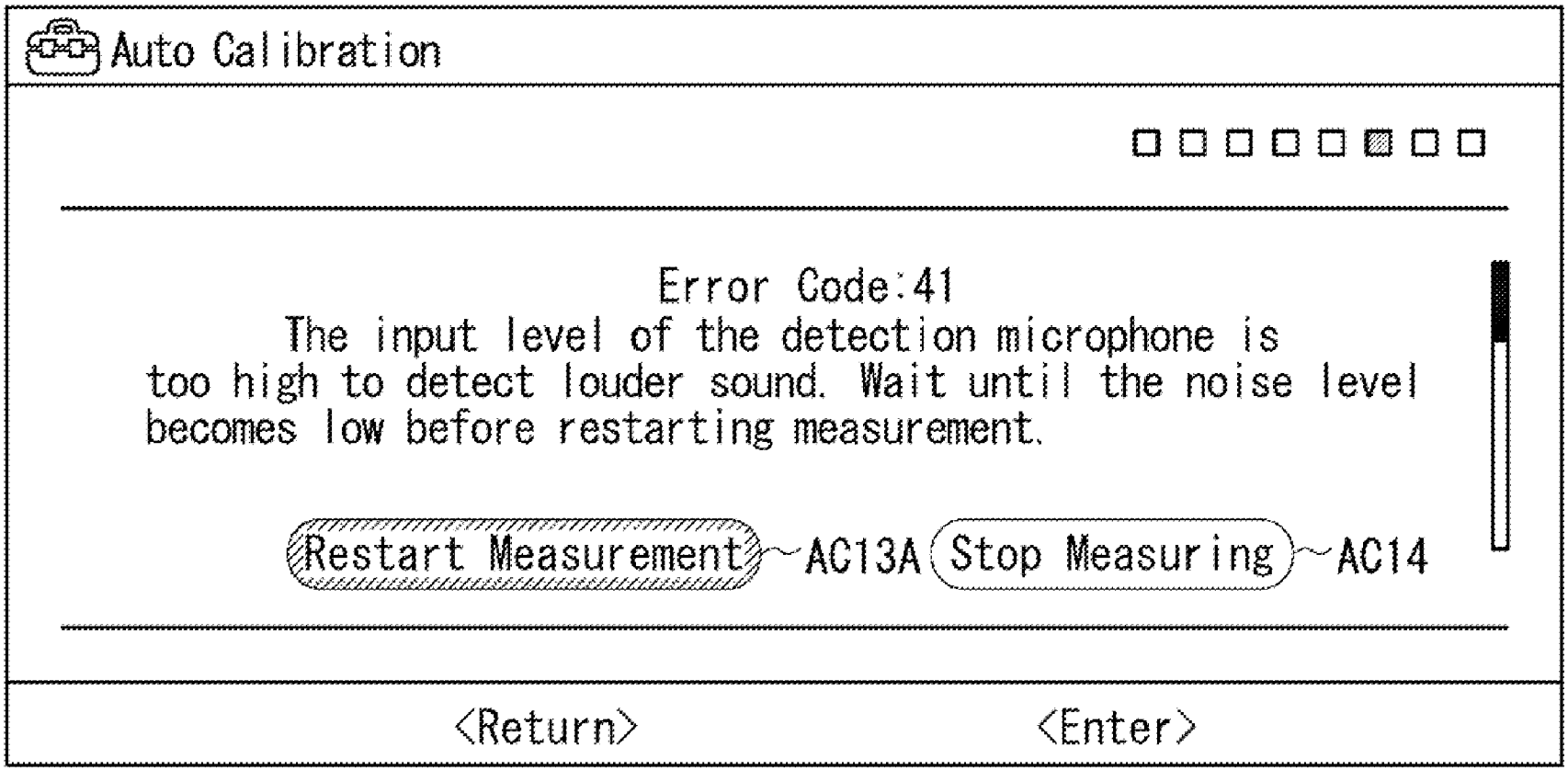
Figure 24:
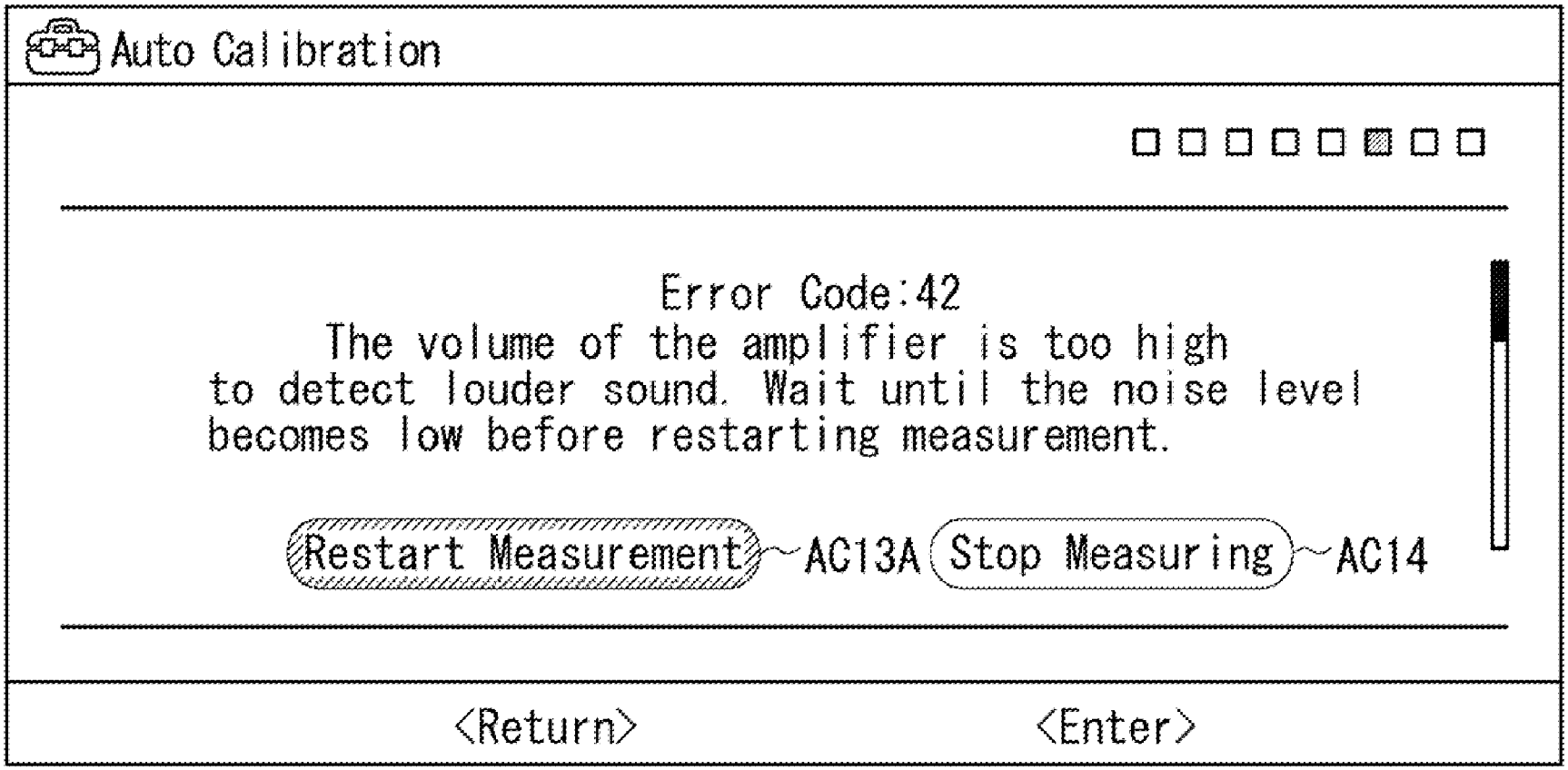
Figure 25:
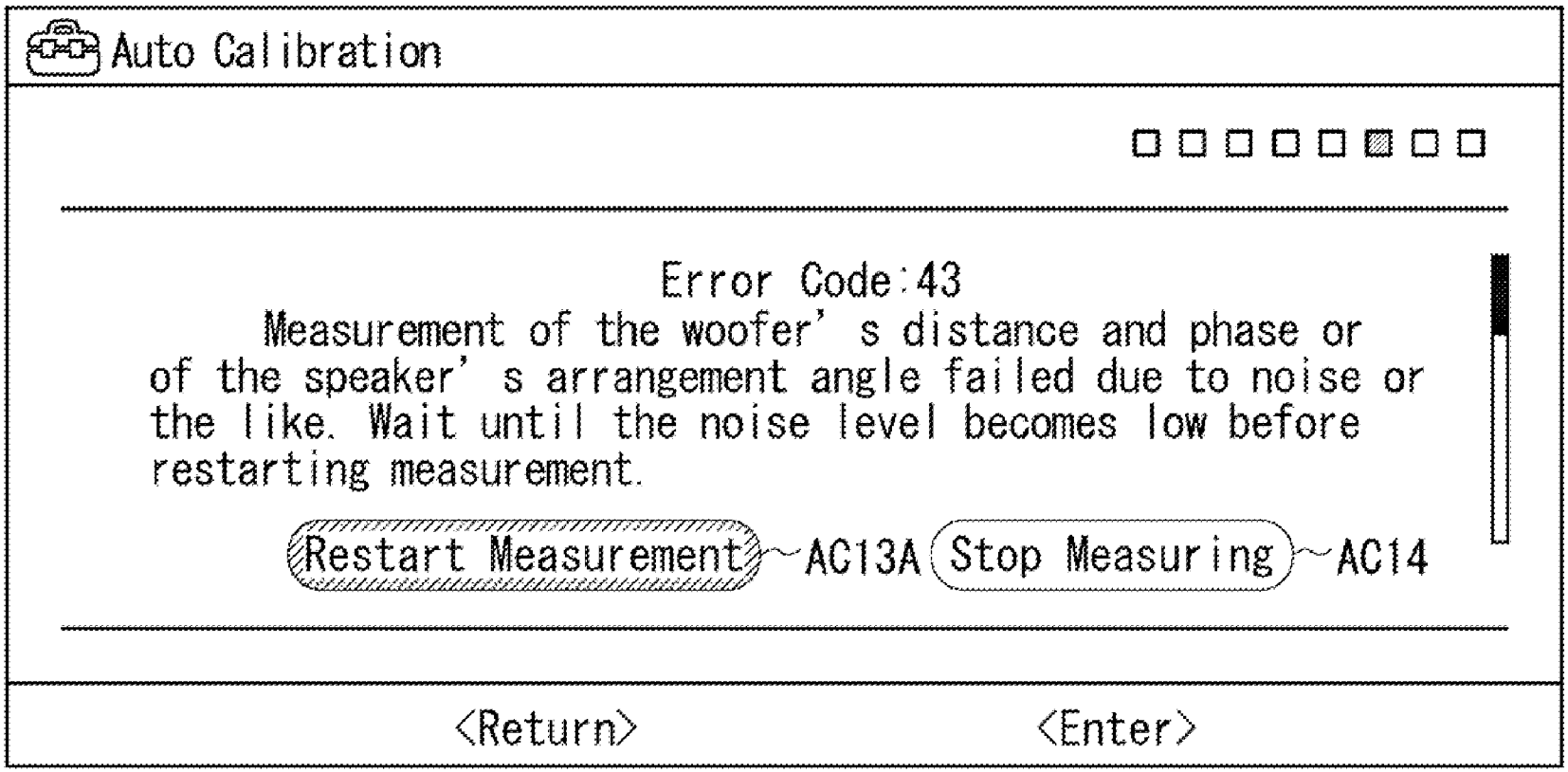

By the way, there may be a need to give warning even after displaying the measurement completion screen MFN (FIG. 19) that informs completion of the measurement of the acoustic field space. In this case, the control section 10 displays a warning confirmation selection screen WCP on the LCD 5 as shown in FIG. 21.

The warning confirmation selection screen WCP (FIG. 21) includes a string of characters ("Measurement was completed. There are some warnings about the result. Do you want to check?"), along with a "Check" icon AC12 and a "No check" icon AC13.

When the "Enter" key of the remote controller RCL is pushed down while the "Check" icon AC12 of the warning confirmation selection screen WCP (FIG. 21) is being focused, the control section 10 replaces the warning confirmation selection screen WCP on the LCD 5 with one of warning notification screens WN1 to WN5 (FIGS. 22 to 26).

The warning notification screen WN1 (FIG. 22) includes a string of characters ("Warning Code: 40") indicating that there is a warning of the Warning Code 40. In addition, the description and instruction for the warning are displayed to notify the user: The message is "Measurement took place under the circumstances in which the noise level was high. Retrying measurement may produce better results if the noise level around the system is kept low."

The warning notification screen WN2 (FIG. 23) includes a string of characters ("Warning Code: 41") indicating that there is a warning of the warning Code 41. In addition, the description and instruction for the warning are displayed to notify the user: The message is "The input level of the detection microphone is too high to detect louder sound. Wait until the noise level becomes low before restarting measurement."

The warning notification screen WN3 (FIG. 24) includes a string of characters ("Warning Code: 42") indicating that there is a warning of the Warning Code 42. In addition, the description and instruction for the warning are displayed to notify the user: The message is "The volume of the amplifier is too high to detect louder sound. Wait until the noise level becomes low before restarting measurement."

Similarly, the warning notification screen WN4 (FIG. 25) includes a string of characters ("Warning Code: 43") indicating that there is a warning of the Warning Code 43. In addition, the description and instruction for the warning are displayed to notify the user: The message is "Measurement of the woofer's distance and phase or of the speaker's arrangement angle failed due to noise or the like. Wait until the noise level becomes low before restarting measurement."

Moreover, the warning notification screen WN5 (FIG. 26) includes a string of characters ("Warning Code: 44") indicating that there is a warning of the Warning Code 44. In addition, the description and instruction for the warning are displayed to notify the user: The message is "Measurement is completed. However, the result shows the reversed phases of speakers. The terminals of Surround Back L and Surround Back R may be connected to the opposite jacks. In a case where they are appropriately connected, the problem may be attributed to the configuration of the speakers and you can use it as is." By the way, in this embodiment, there are the five warning notification screens WN1 to WN5 (FIGS. 22 to 26). However, there may be other warning notification screens.

When the "Enter" key of the remote controller RCL is pushed down while a "Restart Measurement" icon AC13A of the warning notification screens WN1 to WN5 (FIGS. 22 to 26) is being focused, the control section 10 replaces the warning notification screens WN1 to WN5 on the LCD 5 with the listening position selection screen LPS (FIG. 8) to restart the measurement.

On the other hand, when the "Enter" key of the remote controller RCL is pushed down while a "Stop Measurement" icon AC14 of the warning notification screens WN1 to WN5 (FIGS. 22 to 26) is being focused, the control section 10 replaces the warning notification screens WN1 to WN5 on the LCD 5 with the measurement result storage selection screen MSC (FIG. 20), which was generated by the graphic processing section 15.

The measurement result storage selection screen MSC (FIG. 20) includes a string of characters ("Save the result of measurement?"), along with a "Save" icon AC10 and a "No Save" icon AC11 to make sure whether the user wants to save the result of the measurement regarding the level and frequency characteristic of the speakers 4 or to restart measurement without saving the data.

Figure 27:
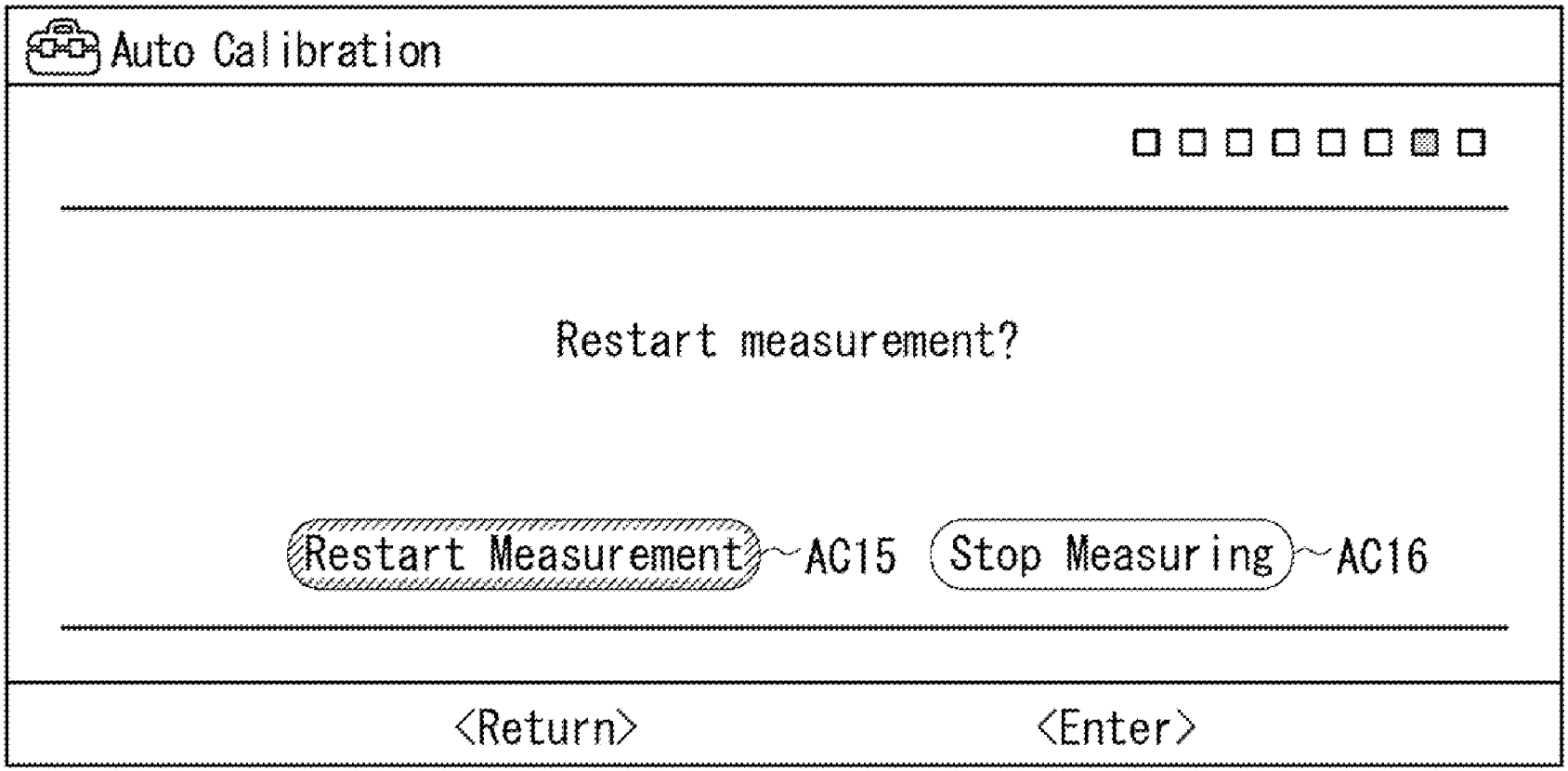
FIG. 27 is a schematic diagram illustrating a re-measurement selection screen.

When the "Enter" key of the remote controller RCL is pushed down while the "No Save" icon AC11 of the measurement result storage selection screen MSC (FIG. 20) is being focused, the control section 10 replaces the measurement result storage selection screen MSC on the LCD 5 with a re-measurement selection screen RMC (FIG. 27), which was generated by the graphic processing section 15.

The re-measurement selection screen RMC (FIG. 27) includes a string of characters ("Restart measurement?"), along with a "Restart Measurement" icon AC15 and a "Stop Measurement" icon AC16 to check if the user wants to restart the measurement or to stop the measurement because the user has determined not to save the result of the previous measurement before the re-measurement selection screen RMC was displayed.

When the "Enter" key of the remote controller RCL is pushed down while the "Restart Measurement" icon AC15 of the re-measurement selection screen RMC (FIG. 27) is being focused, the control section 10 replaces the re-measurement selection screen RMC on the LCD 5 with the measurement start screen MS (FIG. 10).

On the other hand, when the "Enter" key of the remote controller RCL is pushed down while the "Stop Measurement" icon AC16 of the re-measurement selection screen RMC (FIG. 27) is being focused, the control section 10 replaces the re-measurement selection screen RMC on the LCD 5 with the auto calibration top screen TP (FIG. 7).

Figure 28:
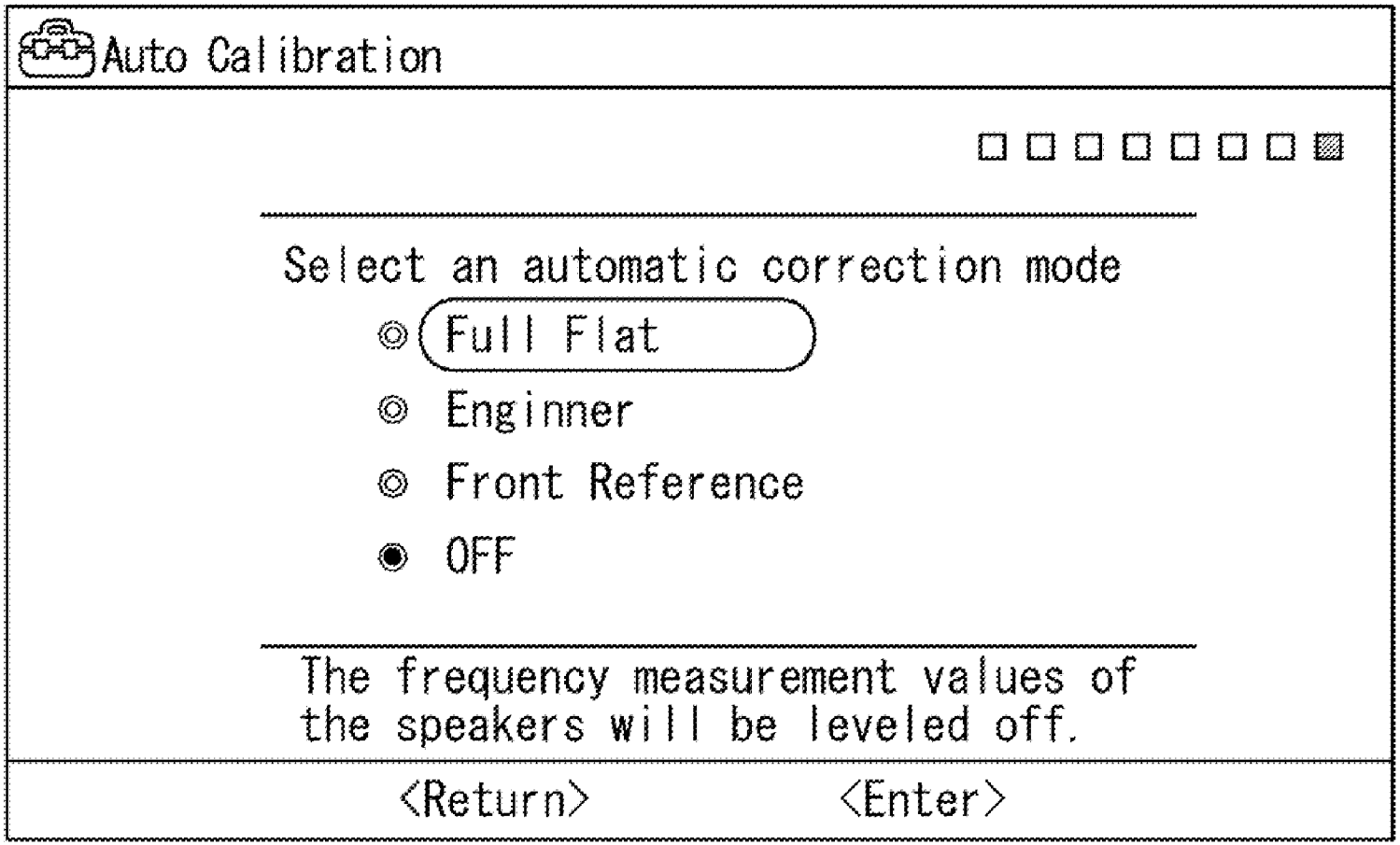
FIG. 28 is a schematic diagram illustrating a full flat automatic correction mode selection screen.

On the other hand, when the "Enter" key of the remote controller RCL is pushed down while the "Save" icon AC10 of the measurement result storage selection screen MSC (FIG. 20) is being focused, the control section 10 replaces the measurement result storage selection screen MSC on the LCD 5 with a full flat automatic correction mode selection screen FAR (FIG. 28), which was generated by the graphic processing section 15.

The full flat automatic correction mode selection screen FAR (FIG. 28) includes the strings of characters ("Full Flat", "Engineer", "Front Reference" and "OFF"), one of which ("Full Flat") is being focused, and also includes a string of character "Leveling off the frequency measurement values of the speakers"). This means that this correction mode is to correct, based on the result of the frequency measurement of the acoustic field space, the frequency measurement values of the speakers 4 such that they are leveled off.

Figure 29:
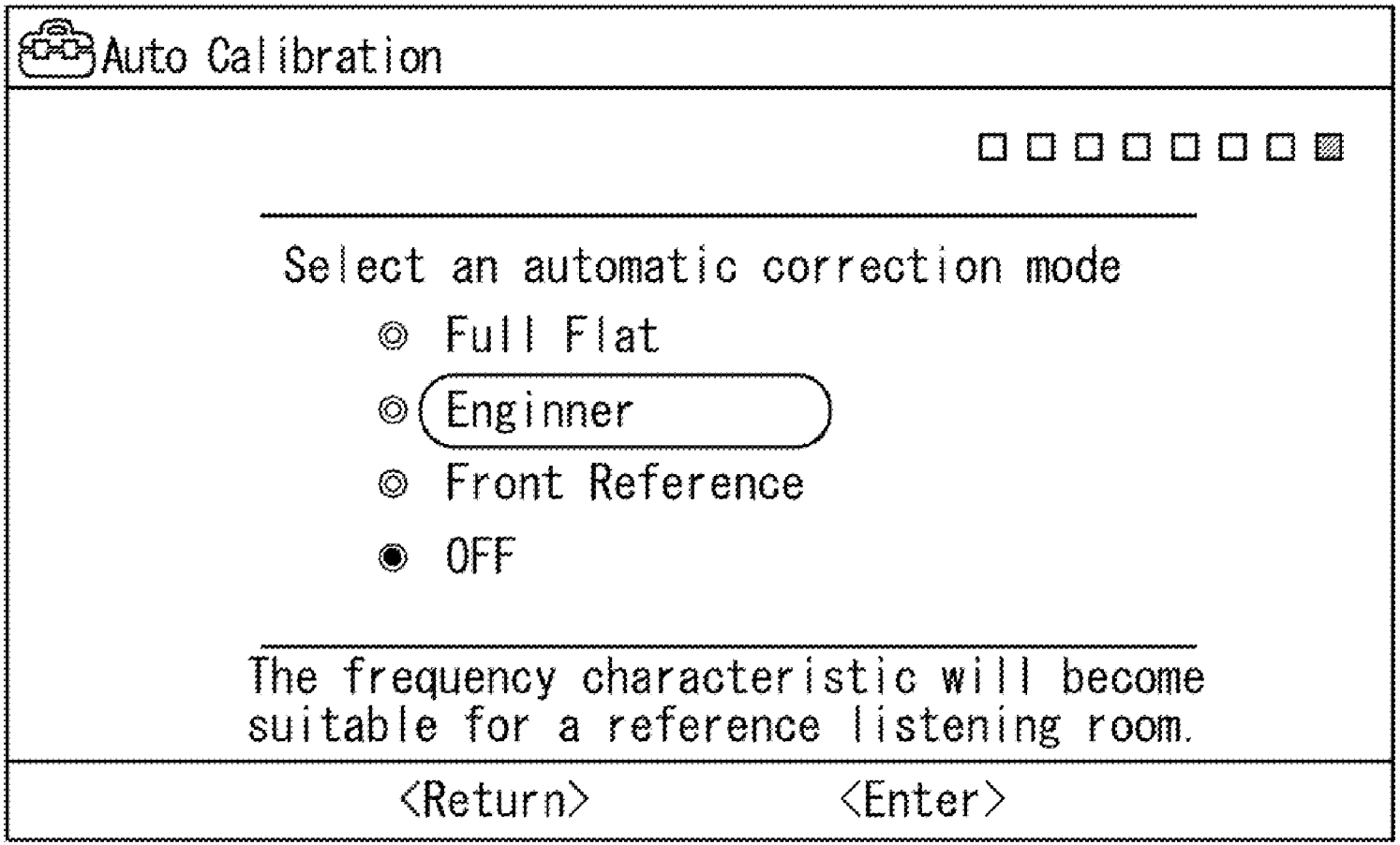
FIG. 29 is a schematic diagram illustrating an engineer automatic correction mode selection screen.

When one of the items ("Full Flat", "Engineer", "Front Reference" or "OFF") on the full flat automatic correction mode selection screen FAR, for example the "Engineer", is focused (or selected), the control section 10 replaces the full flat automatic correction mode selection screen FAR on the LCD 5 with an engineer automatic correction mode selection screen EAR (FIG. 29), which was generated by the graphic processing section 15.

The engineer automatic correction mode selection screen EAR (FIG. 29), where the "Engineer" is being focused, includes a string of characters ("The frequency characteristic will become suitable for a reference listening room") to notify the user of the fact that this correction mode is to correct, based on the result of the frequency measurement of the acoustic field space, the frequency characteristic of the speakers 4 such that it becomes suitable for a reference listening room.

Figure 30:
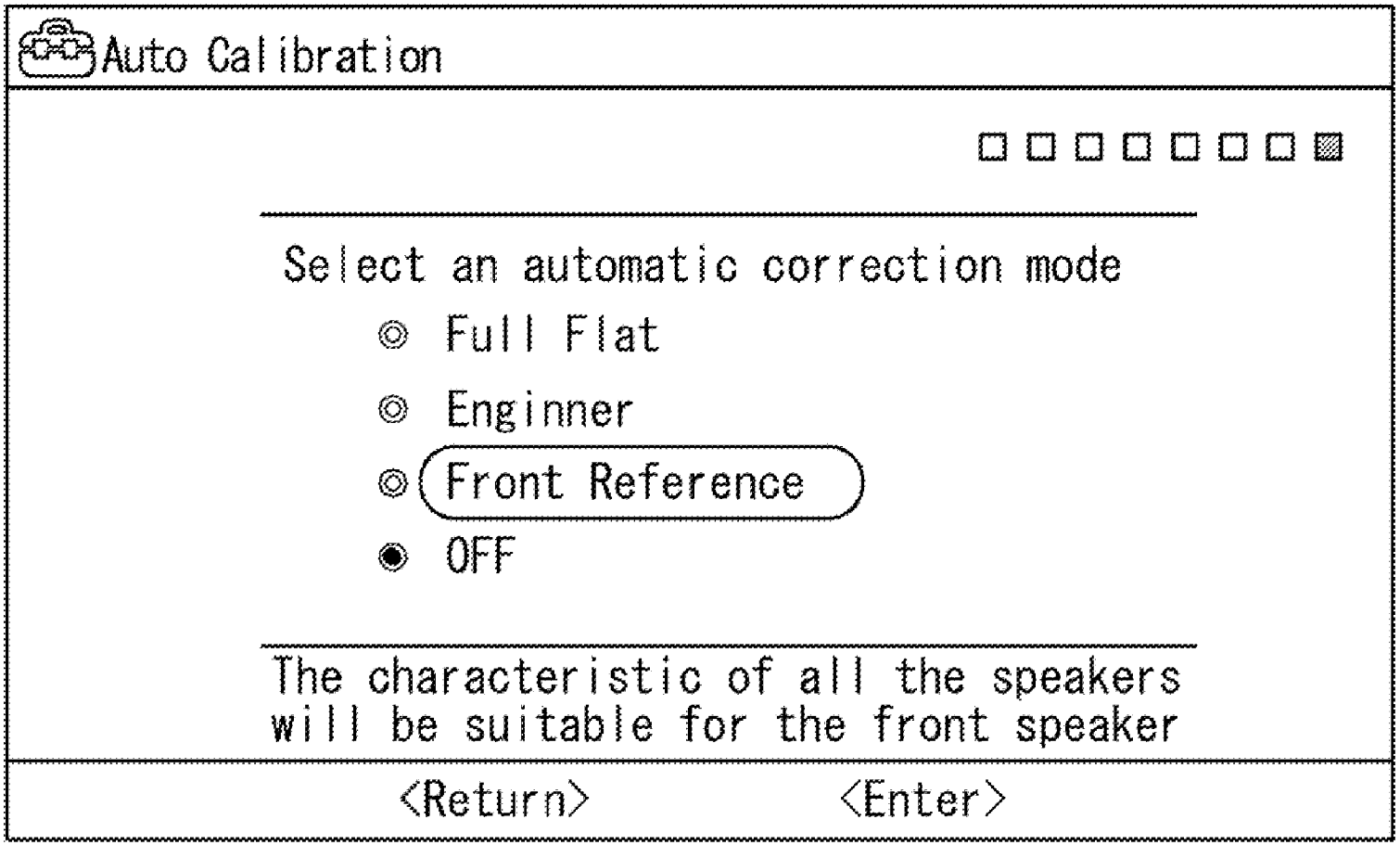
FIG. 30 is a schematic diagram illustrating a front reference automatic correction mode selection screen.

When one of the items ("Full Flat", "Engineer", "Front Reference" or "OFF") on the engineer automatic correction mode selection screen EAR (FIG. 29), for example the "Front Reference", is focused (or selected), the control section 10 replaces the engineer automatic correction mode selection screen EAR on the LCD 5 with a front reference automatic correction mode selection screen FRAR (FIG. 30).

The front reference automatic correction mode selection screen FRAR (FIG. 30), where the "Front Reference" is being focused, includes a string of characters ("The characteristic of all the speakers will be suitable for the front speaker") to notify the user of the fact that this correction mode is to correct, based on the result of the frequency measurement of the acoustic field space, the frequency characteristic of the speakers 4 such that it becomes suitable for the left and right front speakers 4FL and 4FR.

Figure 31:
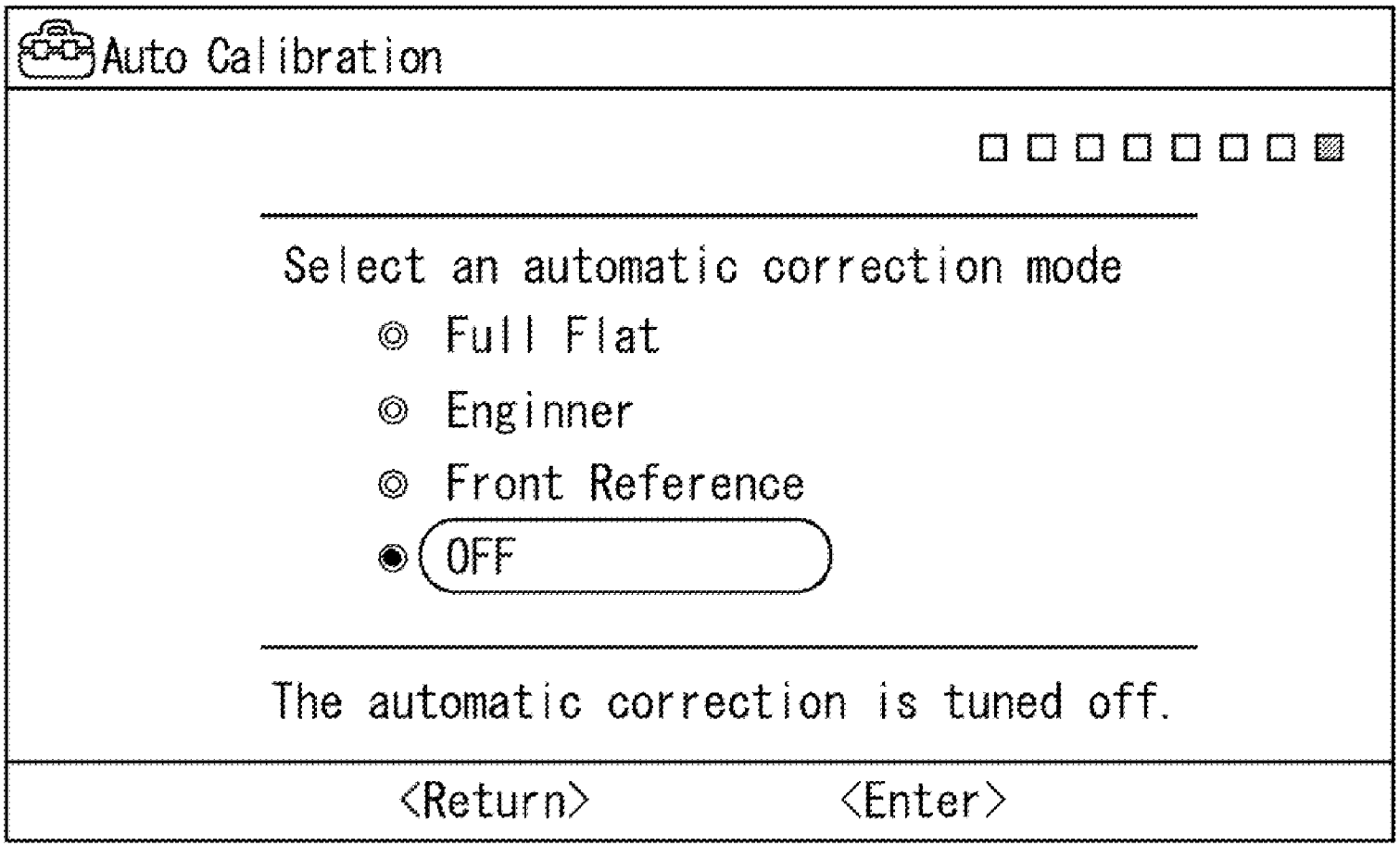
FIG. 31 is a schematic diagram illustrating an automatic correction off mode screen.

When one of the items ("Full Flat", "Engineer", "Front Reference" or "OFF") on the front reference automatic correction mode selection screen FRAR (FIG. 30), for example the "OFF", is focused (or selected), the control section 10 replaces the front reference automatic correction mode selection screen FRAR on the LCD 5 with an automatic correction off mode selection screen ARO (FIG. 31).

The automatic correction off mode selection screen ARO (FIG. 31), where the "OFF" is being focused, includes a string of characters ("The automatic correction is tuned off") to notify the user of the fact that this correction mode is not to correct the frequency characteristic of the speakers 4.

When the "Enter" key of the remote controller RCL is pushed down while one of the screens (the full flat automatic correction mode selection screen FAR (FIG. 28), the engineer automatic correction mode selection screen EAR (FIG. 29), the front reference automatic correction mode selection screen FRAR (FIG. 30) or automatic correction off mode selection screen ARO (FIG. 31)) is being displayed, the control section 10 automatically performs the correction process corresponding to the displayed screen, and then stores the resultant setting values in the data storage medium 13 as the setting data D1. After that, the control section 10 replaces the screens on the LCD 5 with the auto calibration top screen CT (FIG. 7), which was generated by the graphic processing section 15.

Figure 32:
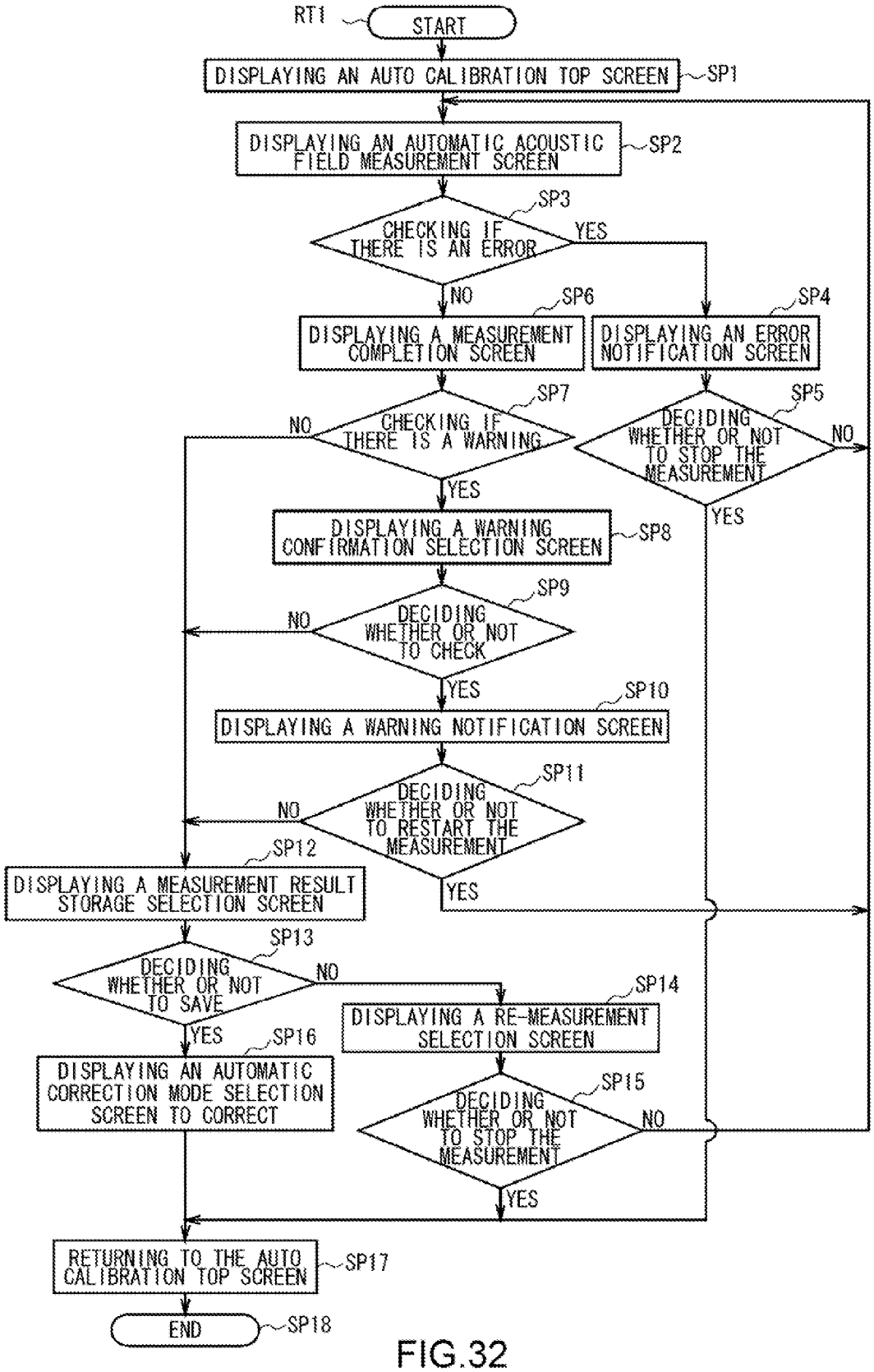
FIG. 32 is a flowchart illustrating an automatic acoustic field setting process with GUI.

The above describes the method of automatic acoustic field setting in which the control section 10 uses GUI. FIG. 32 is a flowchart illustrating a procedure of the automatic acoustic field setup that uses various GUI screens.

(4-2) Automatic Acoustic Field Setup Process with GUI

As shown in FIG. 32, the control section 10 of the home server 2 executes an application program or an audio setup program to start a routine RT1 from start step and then proceeds to step SP1. At step SP1, after the "Auto Calibration" icon AC4 of the home screen HM displayed on the LCD 5 is selected, the control section 10 replaces the home screen HM on the LCD 5 with the auto calibration top screen CT (FIG. 7) and then proceeds to step SP2.

At step SP2, the control section 10 selects one of the automatic acoustic field measurement screens (i.e. the listening position selection screen LPS (FIG. 8), the measurement item check screen MIC (FIG. 9), the measurement start screen MS (FIG. 10), the measurement notification screen MZ (FIG. 11), the measurement progress screen MIS (FIG. 12) or the like) and displays the selected screen on the LCD 5 in order to measure the acoustic field space after the "Enter" key of the remote controller RCL is pushed down while the auto calibration top screen CT (FIG. 7) is being displayed. The control section 10 subsequently proceeds to step SP3.

At step SP3, the control section 10 checks if it runs into any errors while displaying at step SP2 one of the automatic acoustic field measurement screens (FIG. 8 to FIG. 12). If the control section 10 detects an error while displaying the automatic acoustic field measurement screens, the control section 10 proceeds to next step SP4.

At step SP4, since there is an error during the automatic acoustic field measurement process, the control section 10 displays on the LCD 5 the corresponding error notification screen (one of the screens EN1 to EN5 (FIGS. 14 to 18)) and then proceeds to step SP5.

At step SP5, the control section 10 checks if the "Stop Measuring" icon AC8 has been selected or pushed on the displayed error notification screen (one of the screens EN1 to EN5 (FIGS. 14 to 18)) by the user who checks the error message.

If the "Restart Measurement" icon AC7 of the displayed error notification screen, instead of the "Stop Measuring" icon AC8, has been selected, the control section 10 returns to step SP2 to display one of the automatic acoustic field measurement screens (FIG. 8 to FIG. 12) and then performs the subsequent process.

Whereas if the "Stop Measuring" icon AC8 of the displayed error notification screen has been selected, then the control section 10 proceeds to step SP17.

At step SP17, the control section 10 stops measuring the acoustic field space and then displays the auto calibration top screen CT (FIG. 7) on the LCD 5. The control section 10 subsequently proceeds to step SP18 to end the process.

If the control section 10 at step SP3 does riot detect any errors while displaying the automatic acoustic field measurement screens (FIGS. 8 to 12), the control section 10 proceeds to step SP6 and displays on the LCD 5 the measurement completion screen MFN (FIG. 19). The control section 10 subsequently proceeds to step SP7.

At step SP7, after displaying the measurement completion screen MFN (FIG. 19), the control section 10 checks if there is any warning to give, which may have been caused while performing the automatic acoustic field measurement process. If there is a warning, the control section 10 proceeds to step SP8. If not so, the control section 10 proceeds to step SP12.

At step SP8, since there is a warning to give, the control section 10 displays on the LCD 5 the warning confirmation selection screen WCP (FIG. 21) to let the user make the decision regarding whether or not to check the warning and then proceeds to step SP9.

At step SP9 the control section 10 checks if the "Check" icon AC12 of the warning confirmation selection screen WCP (FIG. 21) has been selected. If the "Check" icon AC12 was not selected, then this means that the user does not want to check the warning and therefore the control section 10 proceeds to step SP12.

Whereas if the "Check" icon AC12 was selected at step SP9, then this means that the user wants to check the warning and therefore the control section 10 proceeds to step SP10.

At step SP10, the control section 10 displays on the LCD 5 the corresponding warning notification screen (i.e. one of the screens WN1 to WN5 (FIGS. 22 to 26)) to let the user check the warning and then proceeds to step SP1.

At step SP11 the control section 10 checks if the "Restart Measurement" icon AC13 of the displayed warning notification screen has been selected. If the "Stop Measurement" icon AC14, instead of the "Restart Measurement" icon AC13, was selected, then this means that the user does not want to restart the measurement and therefore the control section 10 proceeds to step SP12.

Whereas if the "Restart Measurement" icon AC13 was selected at step SP11 after the user checked the warning on the displayed warning notification screen, then this means that the user wants to restart the measurement and therefore the control section 10 returns to step SP2 to restart the automatic acoustic field measurement process.

At step SP12, the control section 10 displays on the LCD 5 the measurement result storage selection screen MSC (FIG. 20) to let the user make the decision regarding whether or not to save the data of the measurement result on the measurement completion screen MFN (FIG. 19) and then proceeds to step SP13.

At step SP13, the control section 10 checks if the "Save" icon AC10 of the measurement result storage selection screen MSC (FIG. 20) has been selected. If the "Save" icon AC10 was not selected, then this means that the user does not want to save the data of the measurement result regarding the automatic acoustic field measurement process through the measurement completion screen MFN (FIG. 19) and therefore the control section 10 proceeds to step SP14.

At step SP14, since the user does not want to save the data of the measurement result regarding the automatic acoustic field measurement process, the control section 10 displays on the LCD 5 the re-measurement selection screen RMC (FIG. 27) to let the user make the decision regarding whether or not to restart the measurement and then proceeds to step SP15.

At step SP15 the control section 10 checks if the "Stop Measurement" icon AC16 of the re-measurement selection screen RMC (FIG. 27) has been selected. If the "Restart Measurement" icon AC15 of the re-measurement selection screen RMC (FIG. 27), instead of the "Stop Measurement" icon AC16, was selected, then this means the user wants to restart the measurement and therefore the control section 10 proceeds to step SP2 to restart the automatic acoustic field measurement process.

Whereas if the "Stop Measurement" icon AC16 was selected, then this means the user wants to stop the measurement and therefore the control section 10 proceeds to step SP17.

If the "Save" icon AC10 of the measurement result storage selection screen MSC (FIG. 20) was selected at step SP13, then this means that the user wants to save the data of the measurement result regarding the automatic acoustic field measurement process through the measurement completion screen MFN (FIG. 19) and therefore the control section 10 proceeds to step SP16.

At step SP16, before saving the data of the measurement result regarding the automatic acoustic field measurement process through the measurement completion screen MFN (FIG. 19), the control section 10 displays on the LCD 5 one of the following screens: the full flat automatic correction mode selection screen FAR (FIG. 28), the engineer automatic correction mode selection screen EAR (FIG. 29), the front reference automatic correction mode selection screen FRAR (FIG. 30) or automatic correction off mode selection screen ARO (FIG. 31). The control section 10 saves the measurement data, whose values have been corrected through one of the automatic correction mode selection screens (FIGS. 28 to 31), in the data storage medium 13 as the setting data D1 and then proceeds to step SP17.

At step SP17, since it has stored the setting data D1 in the data storage medium 13 at step SP16 the control section 10 displays again on the LCD 5 the auto calibration top screen CT (FIG. 7) and then proceeds to step SP18 to end the process.

(4-3) Manual Acoustic Field Setup Process with GUI

The following describes the method of manual acoustic field setup using GUI. After being powered on, the control section 10 of the home server 2 controls the graphic processing section 15 to generate the home screen HM (FIG. 3) and then displays the home screen HM on the LCD 5.

When "Setting" icon AC3 and the lower-layer's "Auto Calibration" icon AC4 are selected on the home screen HM (FIG. 3) the control section 10 of the home server 2 displays the auto calibration top screen CT (FIG. 7) on the LCD 5.

Figure 33:
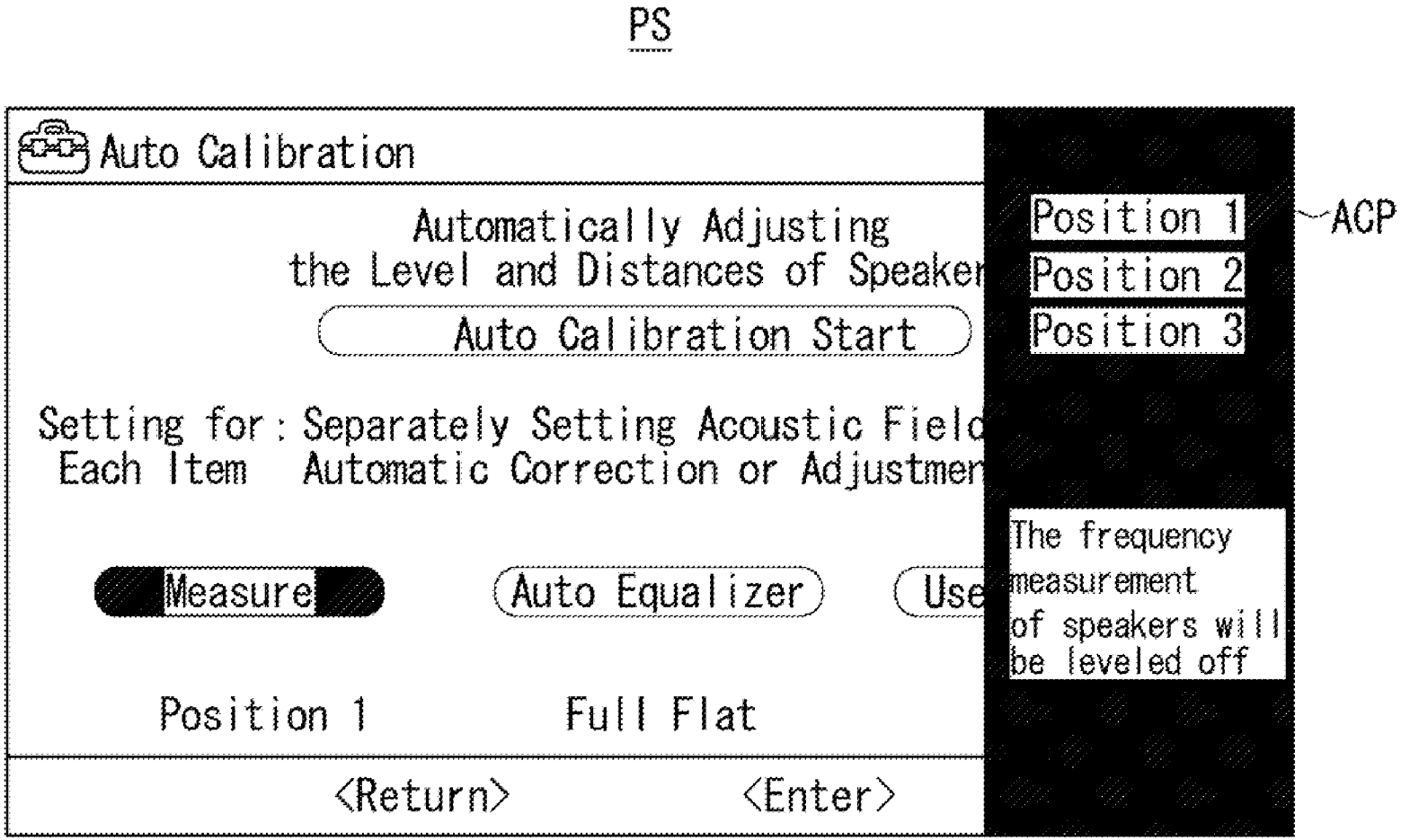
FIG. 33 is a schematic diagram illustrating a position selection screen.

When a "Measure" icon ACM of the auto calibration top screen CT (FIG. 7) is selected, the control section 10 controls the graphic processing section 15 to generate a position selection screen PS (FIG. 33), which is then displayed on the LCD 5.

Figure 34:
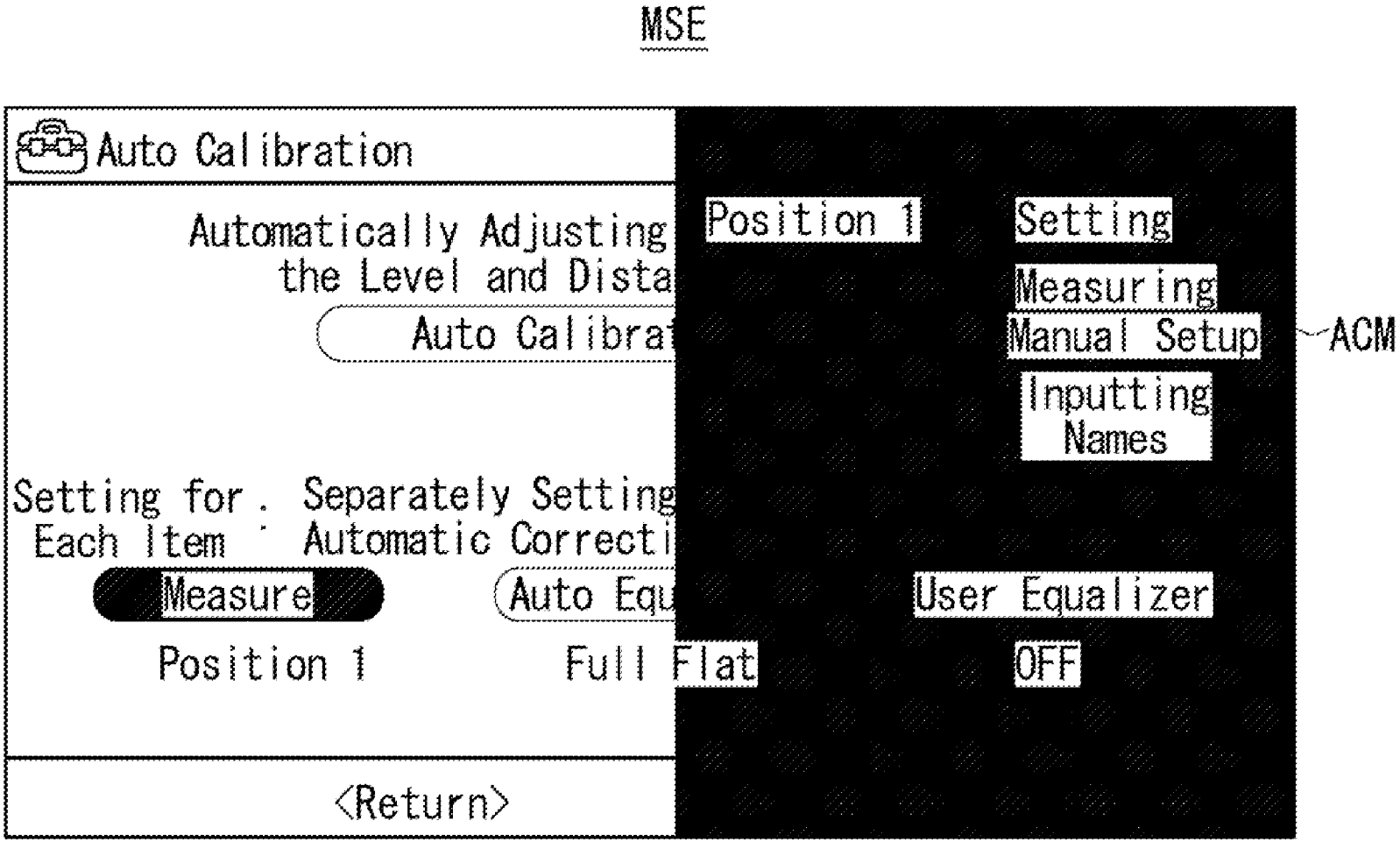
FIG. 34 is a schematic diagram illustrating a manual setup editing screen.
Figure 35:
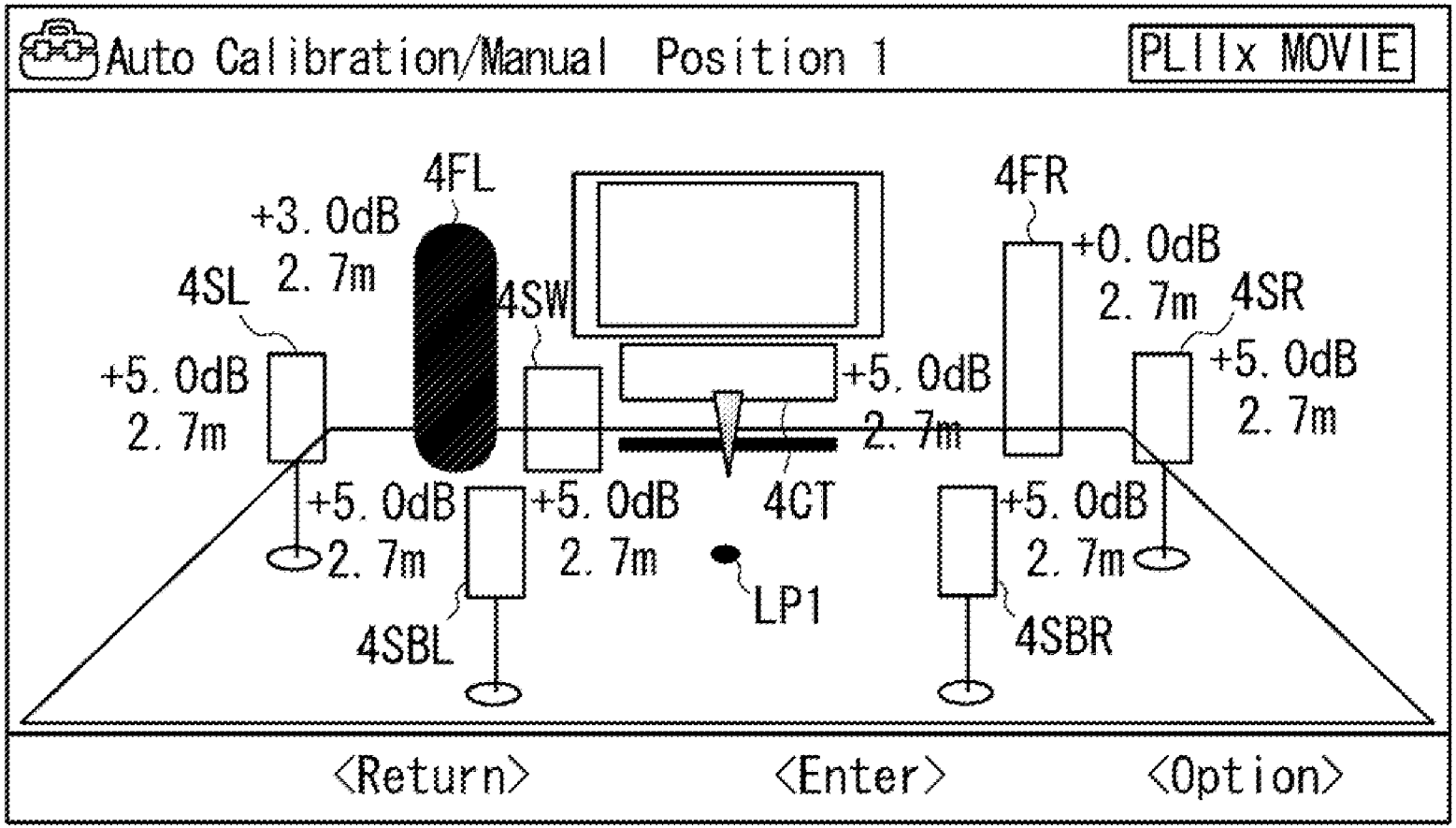
FIGS. 35 to 39 are schematic diagrams illustrating a speaker selection screen.
Figure 36:
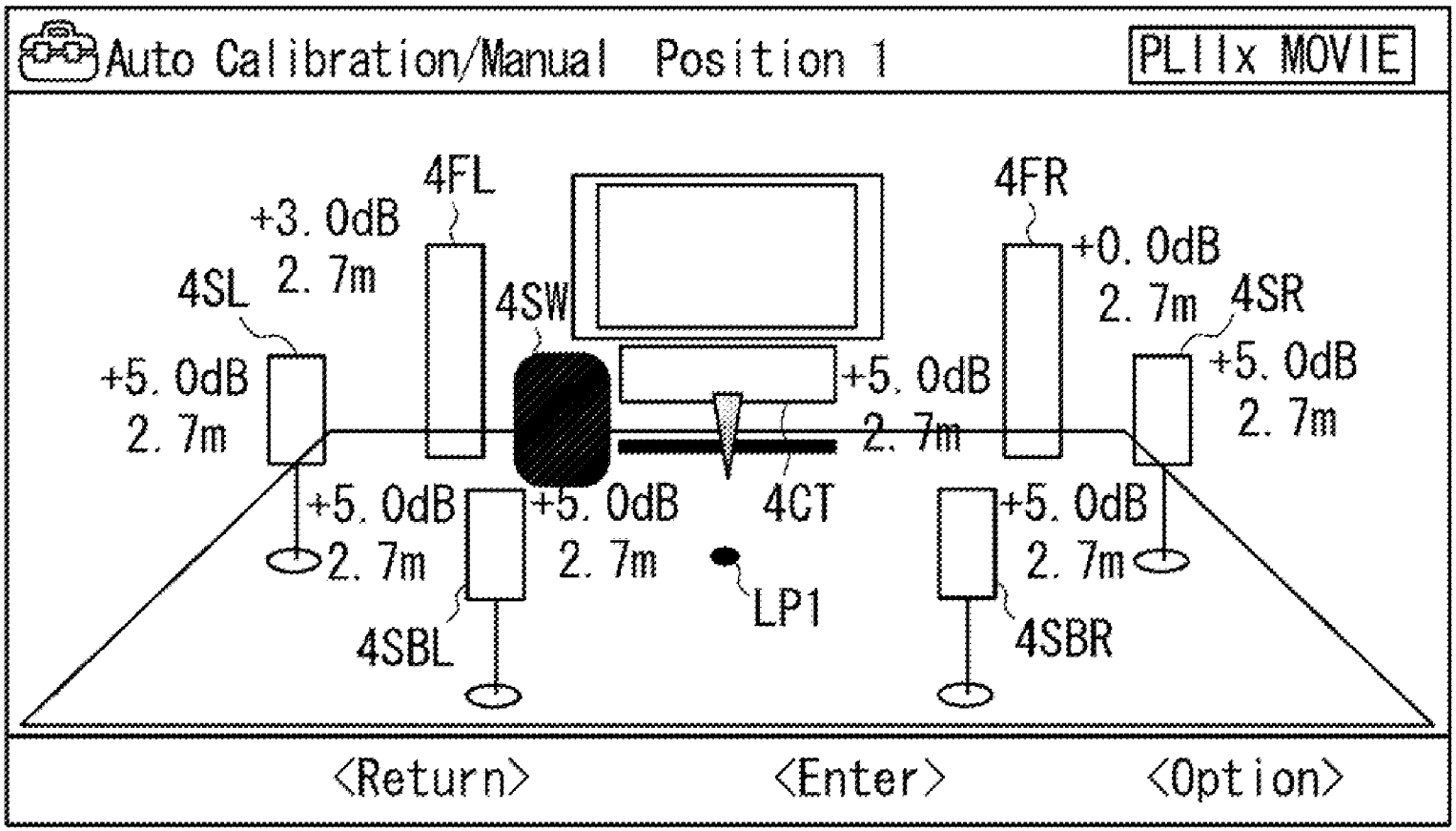
Figure 37:
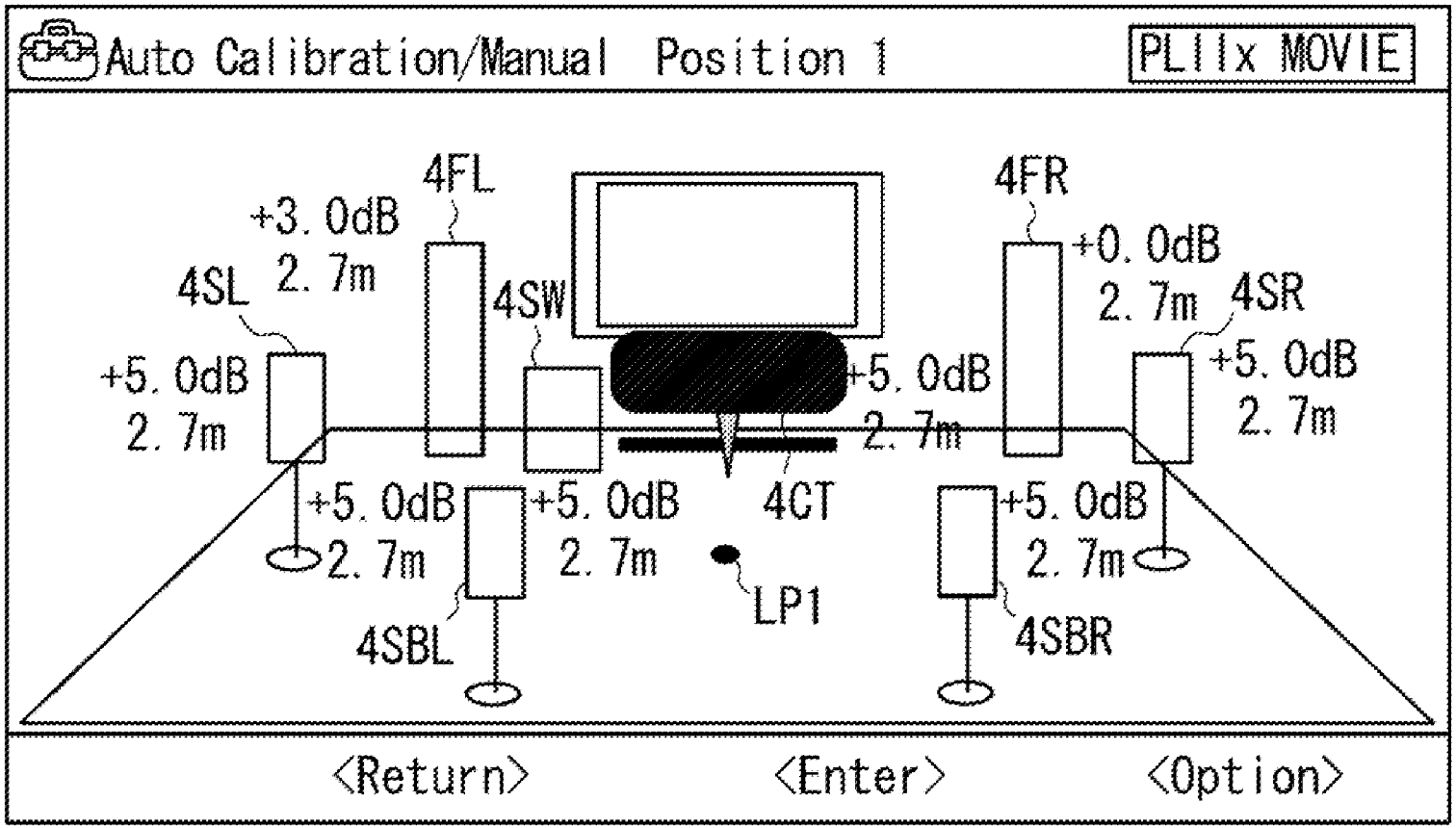
Figure 38:
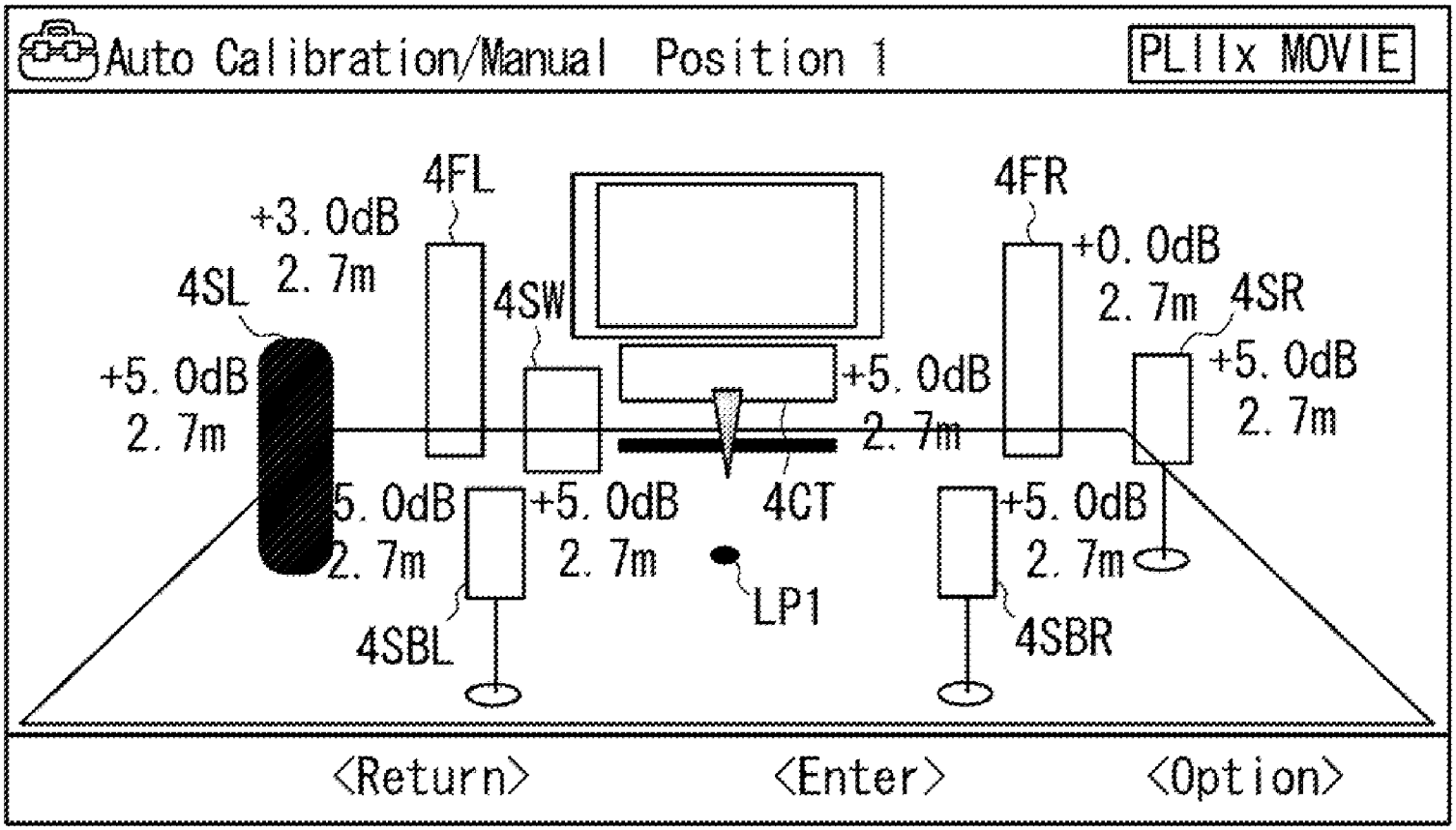
Figure 39:
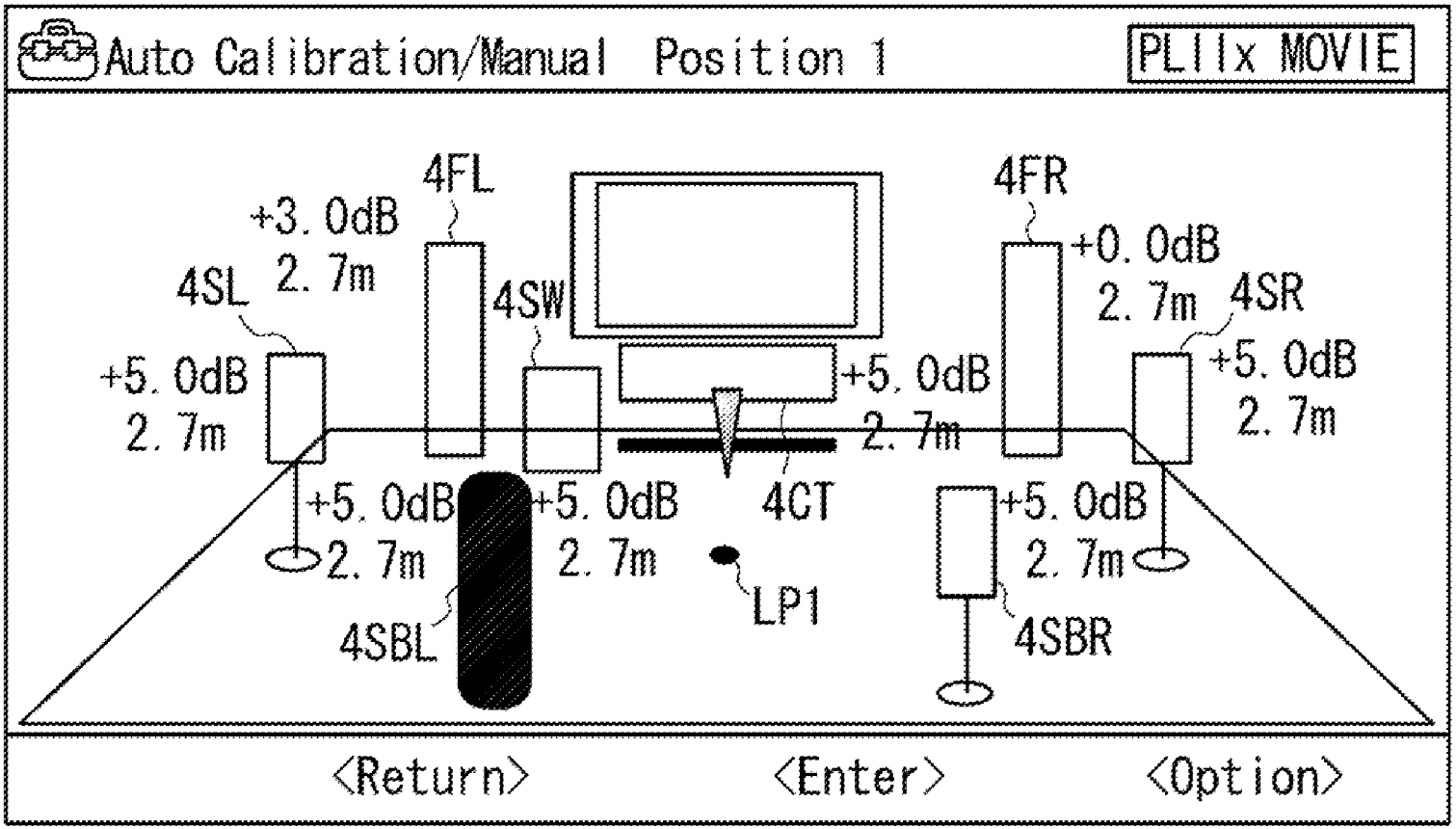

When a "Position" icon ACP of the position selection screen PS (FIG. 33) is selected, the control section 10 displays on the LCD 5 a manual setup editing screen MSE (FIG. 34). When a "Manual Setup" icon ACM of the manual setup editing screen MSE (FIG. 34) is selected, the control section 10 displays on the LCD 5 one of the speaker selection screens SS1 to SS5 (FIGS. 35 to 39), which were generated by the graphic processing section 15 in a three-dimensional manner.

The speaker selection screen SS1 (FIG. 35) visually illustrates, by putting a hatching image on the image of the left front speaker FL, that the left front speaker FL is currently selected for manual setup. The speaker selection screen SS2 (FIG. 36) visually illustrates, by putting a hatching image on the image of the sub woofer 4SW, that the sub woofer 4SW is currently selected for manual setup.

Similarly, the speaker selection screen SS3 (FIG. 37) visually illustrates, by putting a hatching image on the image of the center speaker 4CT, that the center speaker 4CT is currently selected for manual setup. The speaker selection screen SS4 (FIG. 38) visually illustrates, by putting a hatching image on the image of the left surround speaker 4SL, that the left surround speaker 4SL is currently selected for manual setup. The speaker selection screen SS5 (FIG. 39) visually illustrates, by putting a hatching image on the image of the left surround back speaker 4SBL, that the left surround back speaker 4SBL is currently selected for manual setup.

One of the speaker selection screens SS1 to SS5 (FIGS. 35 to 39) is displayed depending on which key of the remote controller RCL (i.e. a "←", "→", "↑" or "↓" key) is pushed by the user. In this manner, the user can select one of the speakers 4 for manual setup by choosing from among the speaker selection screens SS1 to SS5 (FIGS. 35 to 39).

Figure 40:
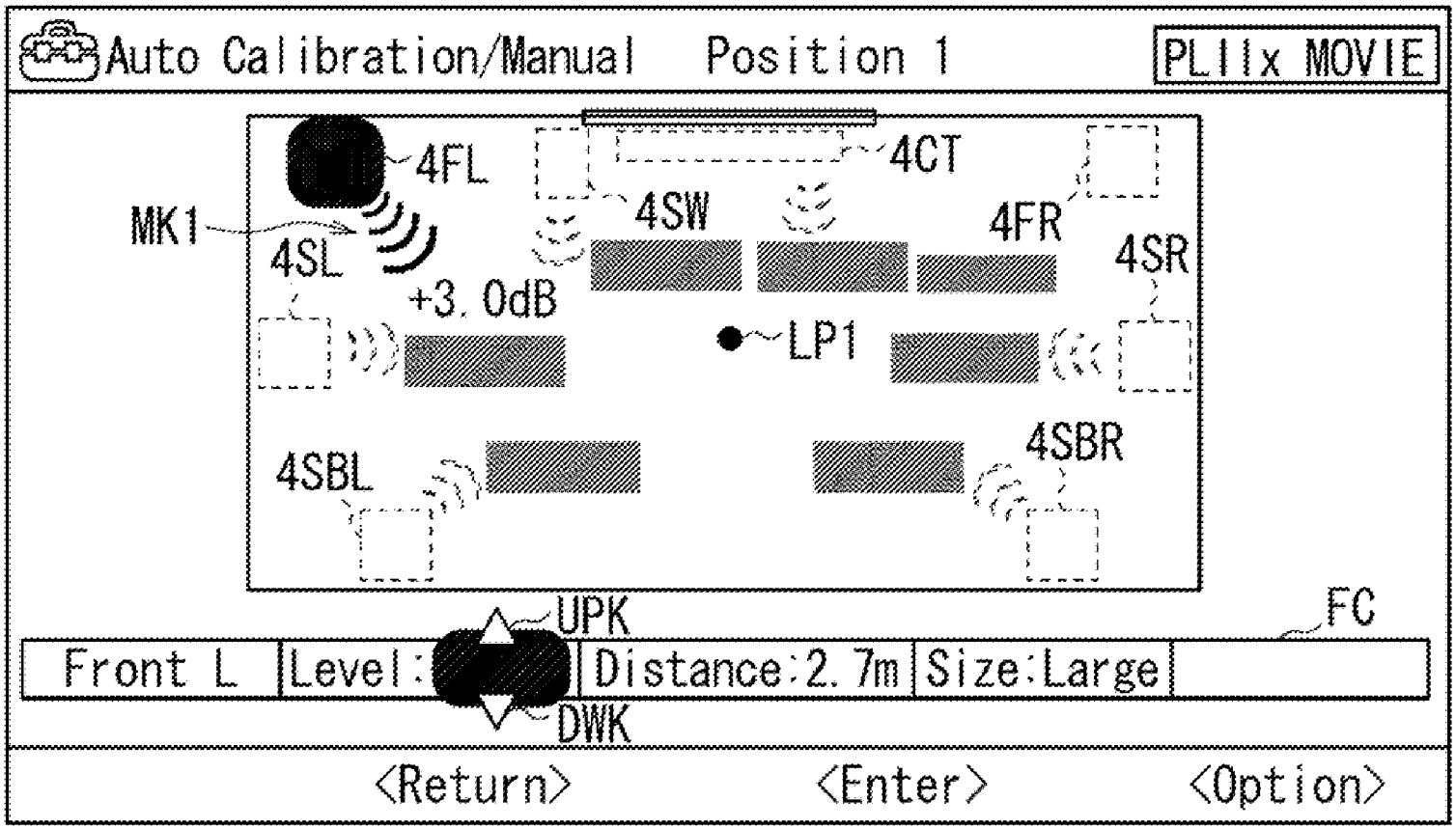
FIGS. 40 and 44 are schematic diagrams illustrating a speaker level screen.

For example, when the "Enter" key of the remote controller RCL is pushed down while the speaker selection screen SS1 (FIG. 35) is being displayed, the control section 10 controls the graphic processing section 15 to generate a speaker level screen SLV1 (FIG. 40) and then displays the speaker level screen SLV1 on the LCD 5. The speaker level screen SLV1 (FIG. 40) displays, as well as the arrangement of the speakers 4, the volume level (+3 dB) of the target left front speaker 4FL covered by the hatching image, which is a relative value to the other speakers 4.

The speaker level screen SLV1 (FIG. 40) is a top view illustrating the arrangement of the speakers 4 in the acoustic field space in a two-dimensional manner while the speaker selection screen SS1 (FIG. 35) displays the arrangement in a three-dimensional manner. In addition to the speaker selection screen SS1 (FIG. 35), displaying the speaker level screen SLV1 (FIG. 40) helps the user to understand much more about the arrangement of the speakers 4.

In addition, the bottom area of the speaker level screen SLV1 (FIG. 40) includes a setting display frame FC. The control section 10 displays the detailed setting of the left front speaker 4FL, which is currently being specified for manual setup, in the setting display frame FC.

Specifically, the setting display frame FC displays the following items: the volume level (Level: +3.0 dB); a speaker distance (Distance: 2.7 meter), which is a distance from the left front speaker 4FL to the listening point LP1 specified as "Position 1" on the listening position selection screen LPS (FIG. 8); and the speaker size (Size: Large).

In this case, the control section 10 displays a value of "+3.0 dB" as the volume level of the left front speaker 4FL on the speaker level screen SLV1 (FIG. 40) while displaying a level mark MK1 as an image of the volume level. When the up key UPK or a down key DWK around the setting display frame FC is pushed to change the volume level of the left front speaker 4FL, the value of the volume level and the level of the level mark MK1 will increase or decrease accordingly.

In that manner, not only does the value of the volume level indicate the volume level of the left front speaker 4FL, but also the level mark MK1 represents it in order to help the user to intuitively understand.

In addition, the control section 10 illustrates the other speakers 4 (other than the left front speaker 4FL) on the speaker level screen SLV1 (FIG. 40) by dotted lines. Accordingly, the user can easily understand that, among the speakers 4, the left front speaker 4FL is currently being selected for manual setup. At the same time the user can also understand the arrangement of the speakers 4 including the left front speaker 4FL.

Figure 41:
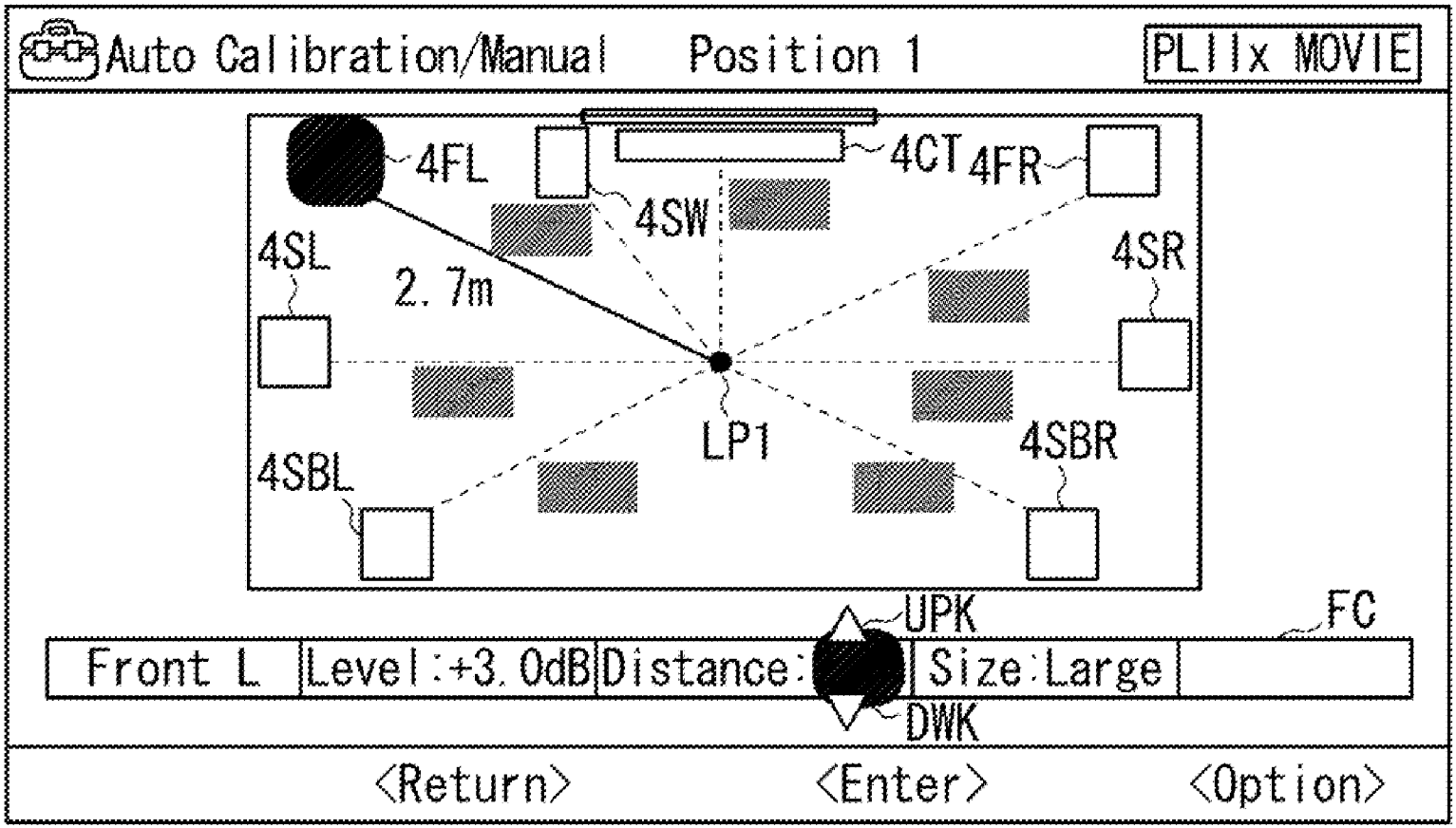
FIG. 41 is a schematic diagram illustrating a speaker distance screen.

When the "→" key of the remote controller RCL is pushed down while the speaker level screen SLV1 (FIG. 40) is being displayed on the LCD 5, the control section 10 controls the graphic processing section 15 to produce a speaker distance screen SDM (FIG. 41), which is then displayed on the LCD 5.

The speaker distance screen SDM (FIG. 41) illustrates a distance (2.7 meters for example) between the target left front speaker 4FL covered by the hatching image and the listening point LP1.

At the same time, the control section 10 displays a straight line between the left front speaker 4FL and the listening point LP1 and also displays the distance (2.7 meters for example) adjacent to the straight line. Accordingly, the user can intuitively make the comparison, regarding the distances from the listening point LP1, between the left front speaker 4FL and the other speakers 4.

When the "→" key of the remote controller RCL is pushed down while the speaker distance screen SDM (FIG. 41) is being displayed on the LCD 5, the control section 10 controls the graphic processing section 15 to produce a speaker size screen SSZ (FIG. 42), which is then displayed on the LCD 5.

Figure 42:
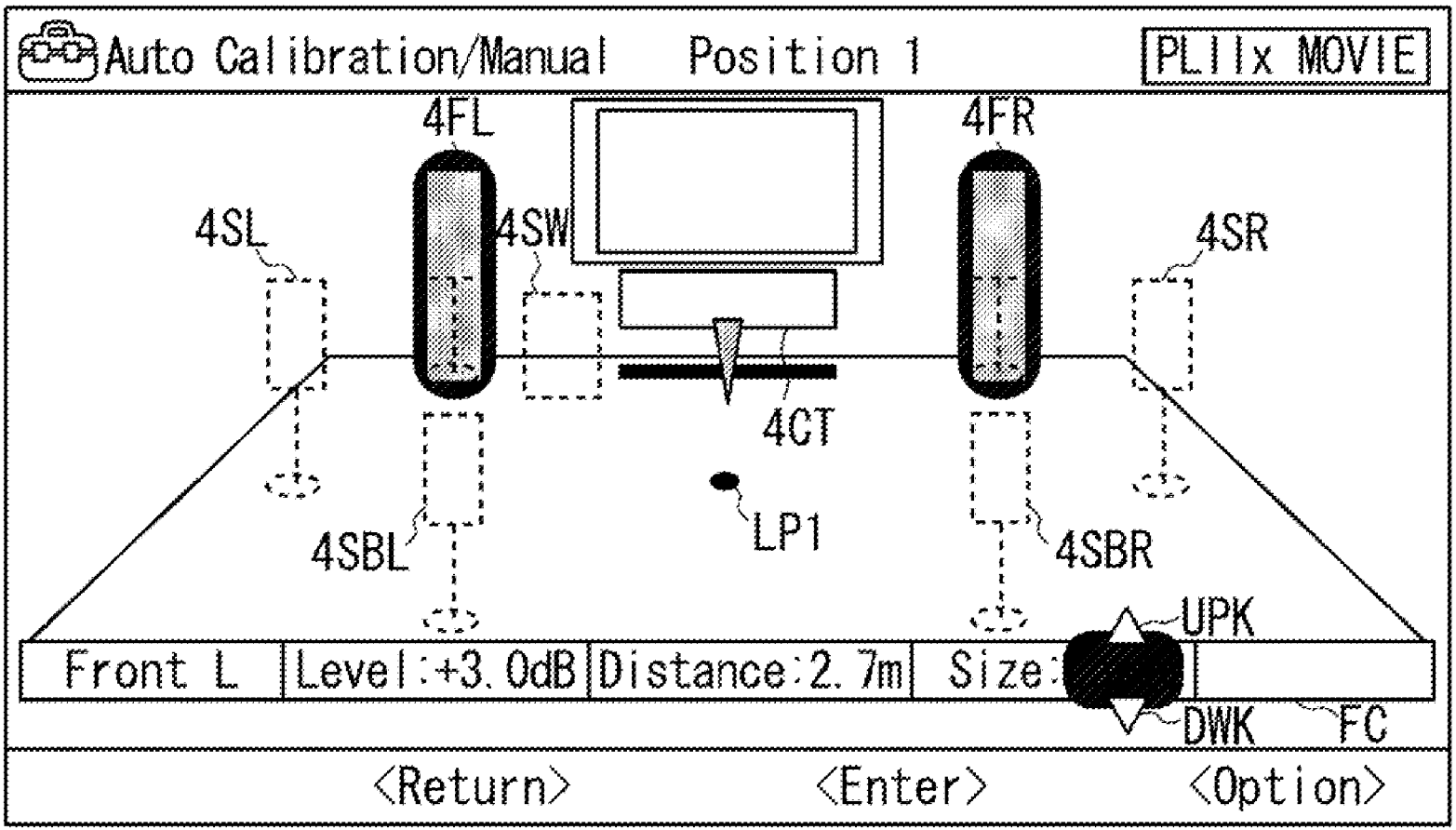
FIGS. 42 and 43 are schematic diagrams illustrating a speaker size screen.

The control section 10 puts the hatching images on both the target left front speaker 4FL and the right front speaker 4FR on the speaker size screen SSZ (FIG. 42). This is because the speaker size of the right front speaker 4FR should be adjusted when the speaker size of the target left front speaker 4FL is changed.

The word "speaker size" means: an entire bandwidth reproduction speaker for "Large" and a middle-to-high bandwidth reproduction speaker for "Small". The control section 10 sets the speaker size of the left front speaker 4FL and right front speaker 4FR to "Large" or "Small".

In this case, when the "↑" or "↓" key of the remote controller RCL is operated to push down the up key UPK or the down key DWK around the speaker size section of the setting display frame FC, the control section 10 changes the speaker size of the left front speaker 4FL and right front speaker 4FR to "Large" or "Small".

Specifically, when the "↓" key of the remote controller RCL is operated to push down the down key DWK, the control section 10 replaces "Large", displayed inside the setting display frame FC of the speaker size screen SSZ1, with "Small". Accordingly, the LCD 5 displays a speaker size screen SSZ2 (FIG. 43), which was generated by the graphic processing section 15.

In this case, the speaker size screen SSZ2 (FIG. 43) displays the downsized images of the left front speaker 4FL and right front speaker 4FR. This helps the user to intuitively understand that the speaker size has been changed to "Small" without checking the setting display frame FC.

Figure 44:
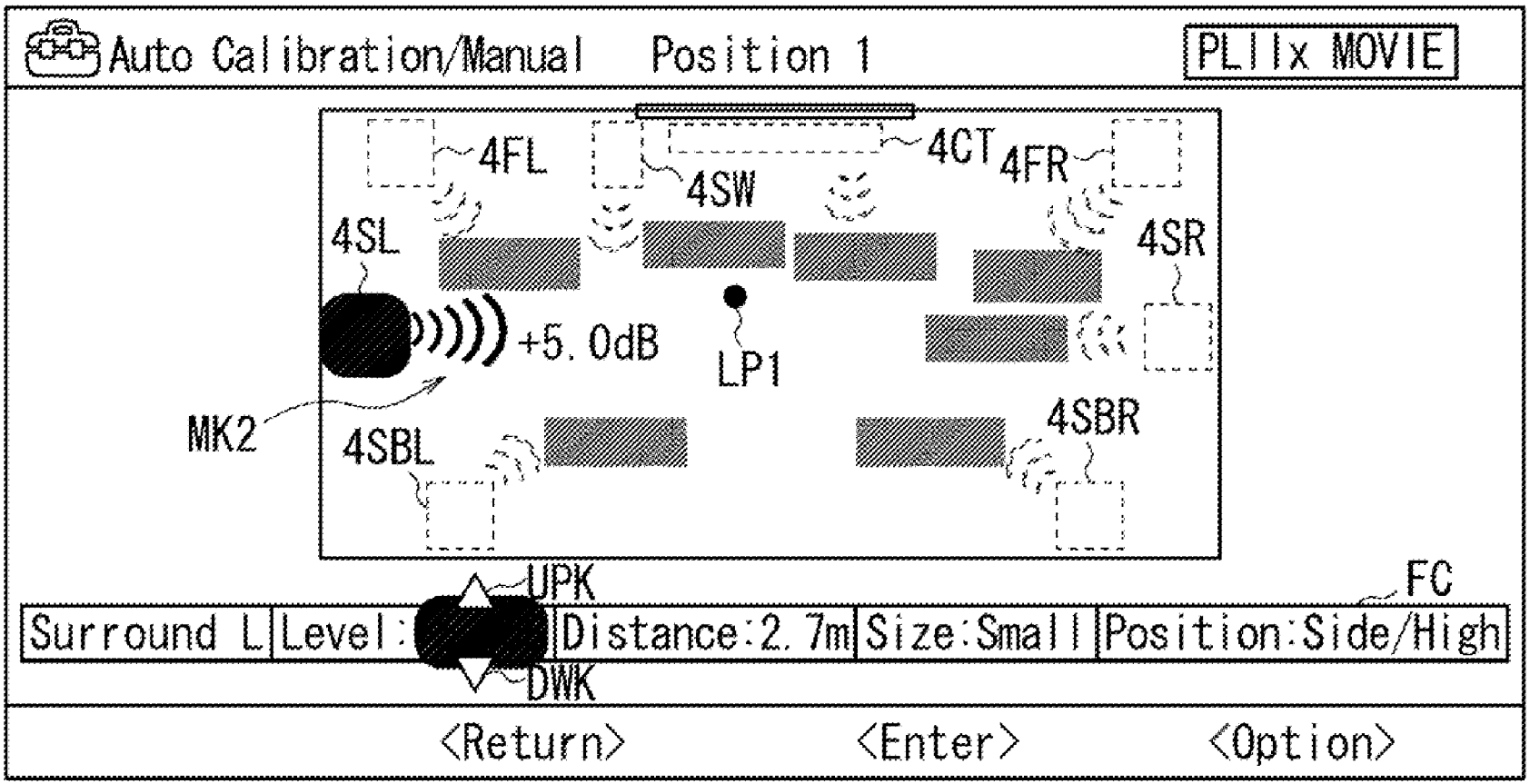

Similarly, when the "Enter" key of the remote controller RCL is pushed down while for example the speaker selection screen SS4 (FIG. 38) is being displayed, the control section 10 controls the graphic processing section 15 to generate a speaker level screen SLV2 (FIG. 44) and then displays the speaker level screen SLV2 on the LCD 5. The speaker level screen SLV2 (FIG. 44) displays, as well as the arrangement of the speakers 4, the volume level (+5 dB) of the target left surround speaker 4SL covered by the hatching image, which is a relative value to the other speakers 4.

The speaker level screen SLV2 (FIG. 44) is a top view illustrating the arrangement of the speakers 4 in the acoustic field space in a two-dimensional manner while the speaker selection screen SS4 (FIG. 38) displays the arrangement in a three-dimensional manner. In addition to the speaker selection screen SS4 (FIG. 38), displaying the speaker level screen SLV2 (FIG. 44) helps the user to understand much more about the arrangement of the speakers 4.

In addition, the bottom area of the speaker level screen SLV2 (FIG. 44) includes a setting display frame FC. The control section 10 displays the detailed setting of the left surround speaker 4SL, which is currently being specified for manual setup, in the setting display frame FC. Specifically, the setting display frame FC displays the following items: the volume level (Level: +5.0 dB); a speaker distance (Distance: 2.7 meter), which is a distance from the left surround speaker 4SL to the listening point LP1 specified as "Position 1" on the listening position selection screen LPS (FIG. 8); and the speaker size (Size: Small).

In this case, the control section 10 displays a value of "+5.0 dB" as the volume level of the left surround speaker 4SL on the speaker level screen SLV2 (FIG. 44) while displaying a level mark MK2 as an image of the volume level. When the up key UPK or the down key DWK around the setting display frame FC is pushed by operating the "↑" or "↓" key of the remote controller RCL to change the volume level of the left surround speaker 4SL, the value of the volume level and the level of the level mark MK2 will increase or decrease accordingly.

In that manner, not only does the value of the volume level indicate the volume level of the left surround speaker 4SL, but also the level mark MK2 represents it in order to help the user to intuitively understand.

In addition, the control section 10 illustrates the other speakers 4 (other than the left surround speaker 4SL) on the speaker level screen SLV2 (FIG. 44) by dotted lines. Accordingly, the user can easily understand that, among the speakers 4, the left surround speaker 4SL is currently being selected for manual setup. At the same time the user can also understand the arrangement of the speakers 4 including the left surround speaker 4SL.

When the "→" key of the remote controller RCL is pushed down three times while the speaker level screen SLV2 (FIG. 44) is being displayed on the LCD 5, the control section 10 controls the graphic processing section 15 to produce a speaker height selection screen SHS1 (FIG. 45), which is then displayed on the LCD 5.

The speaker height selection screen SHS1 (FIG. 45) puts the hatching images on both the left surround speaker 4SL and the right surround speaker 4SR. This is because the height of the right surround speaker 4SR should be adjusted when the height of the target left surround speaker 4SL is changed.

The height of the speakers will be: "High", in which the left surround speaker 4SL and the right surround speaker 4SR produce an audio image upwardly, or "Low", in which the left surround speaker 4SL and the right surround speaker 4SR produce an audio image downwardly. The control section 10 can change the audio image localization of the left surround speaker 4SL and right surround speaker 4SR to "High" or "Low".

In the speaker height selection screen SHS1 (FIG. 45), the images of the target left surround speaker 4SL and right surround speaker 4SR are illustrated by solid lines. In addition, the setting display frame FC at the bottom of the screen shows "Position: Side/Low", indicating that the audio image localization of the left surround speaker 4SL and right surround speaker 4SR is low.

When the "↓" key of the remote controller RCL is operated to push down the down key DWK adjacent to the section of "Position: Side/Low" of the setting display frame FC of the speaker height selection screen SHS1 (FIG. 45), the control section 10 updates that section to display "Position: Side/High". As a result, the LCD 5 displays the speaker height selection screen SHS2 (FIG. 46), which was generated by the graphic processing section 15.

In the speaker height selection screen SHS2 (FIG. 46), the images of the target left surround speaker 4SL and right surround speaker 4SR are illustrated by solid lines. In addition, the setting display frame FC at the bottom of the screen shows "Position: Side/High", indicating that the audio image localization of the left surround speaker 4SL and right surround speaker 4SR is high.

Figure 45:
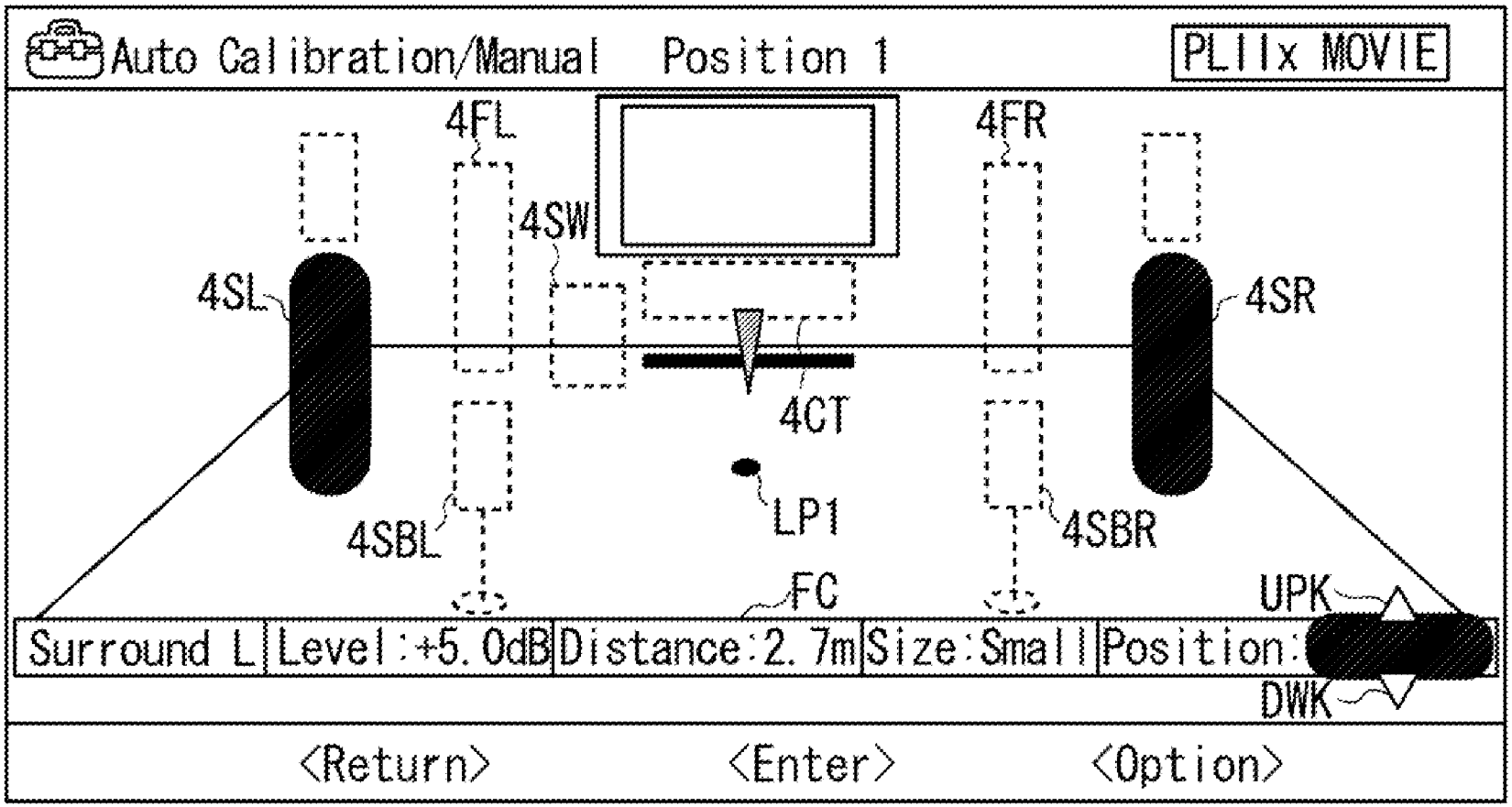
FIGS. 45 and 46 are schematic diagrams illustrating a speaker height selection screen.

When the "↓" key of the remote controller RCL is operated to push down the down key DWK adjacent to the section of "Position: Side/High" of the setting display frame FC of the speaker height selection screen SHS2 (FIG. 46), the control section 10 updates that section to display "Position: Side/Low". As a result, the LCD 5 displays the speaker height selection screen SHS1 (FIG. 45).

Figure 47:
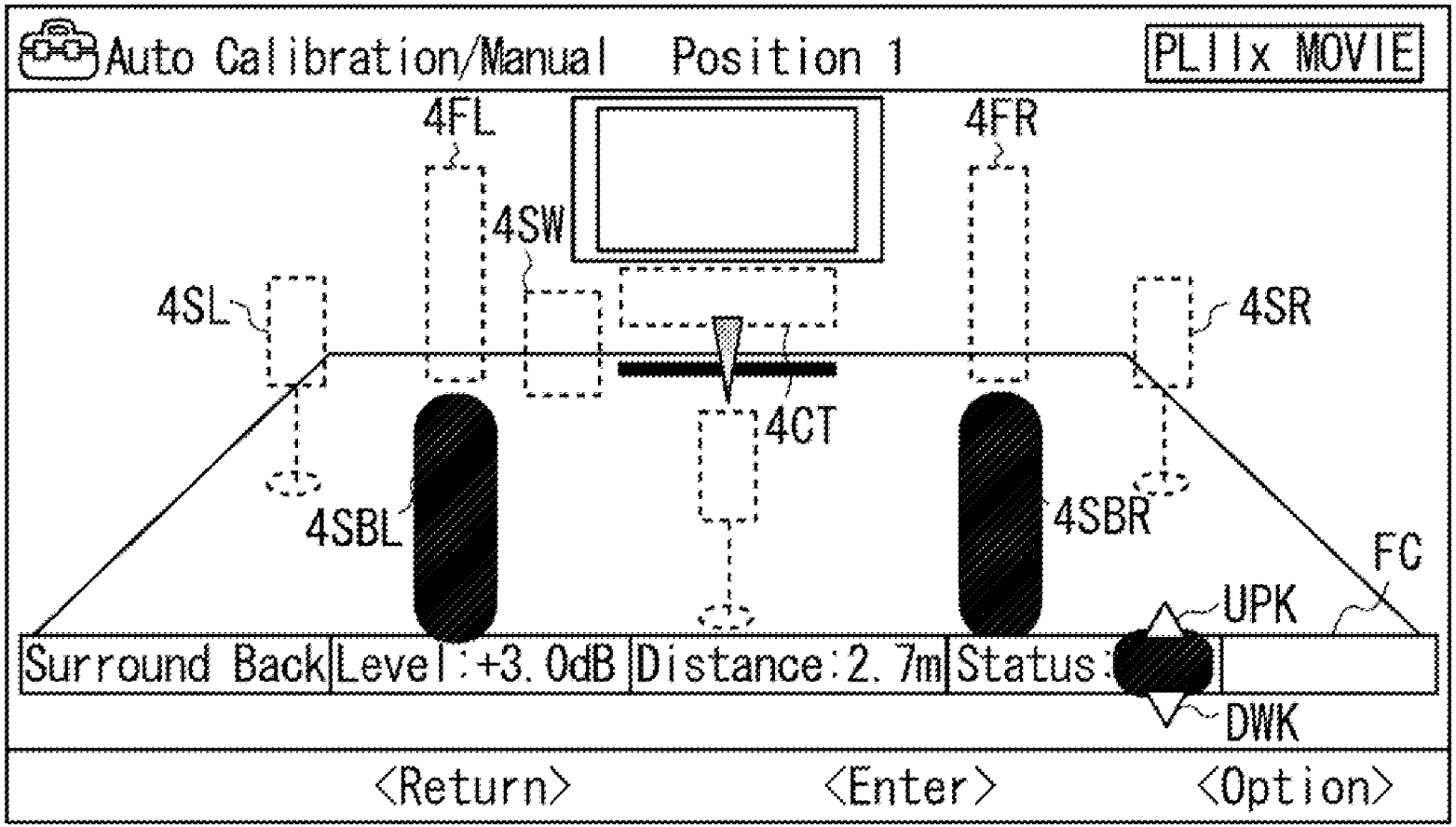
FIGS. 47 to 49 are schematic diagrams illustrating a surround back speaker arrangement selection screen.

When the "Enter" key of the remote controller RCL is pushed down while the speaker selection screen SS5 (FIG. 39) is being displayed, the control section 10 controls the graphic processing section 15 to generate a surround back speaker arrangement selection screen SBL1 (FIG. 47) and then displays the surround back speaker arrangement selection screen SBL1 on the LCD 5.

The previous screen, or the speaker selection screen SS5 (FIG. 39), put the hatching image only on the left surround back speaker 4SBL. However, the surround back speaker arrangement selection screen SBL1 (FIG. 47) puts the hatching images on both the left surround back speaker 4SBL and the right surround back speaker 4SBR. This is because the arrangement of the right surround back speaker 4SBR should be adjusted when the arrangement of the target left surround back speaker 4SBL is changed.

The surround back speaker arrangement selection screen SBL1 (FIG. 47) displays one of the arrangement modes, which is called a "Status: Dual" mode: The left surround back speaker 4SBL and the right surround back speaker 4SBR are located behind the listening point LP1.

Figure 48:
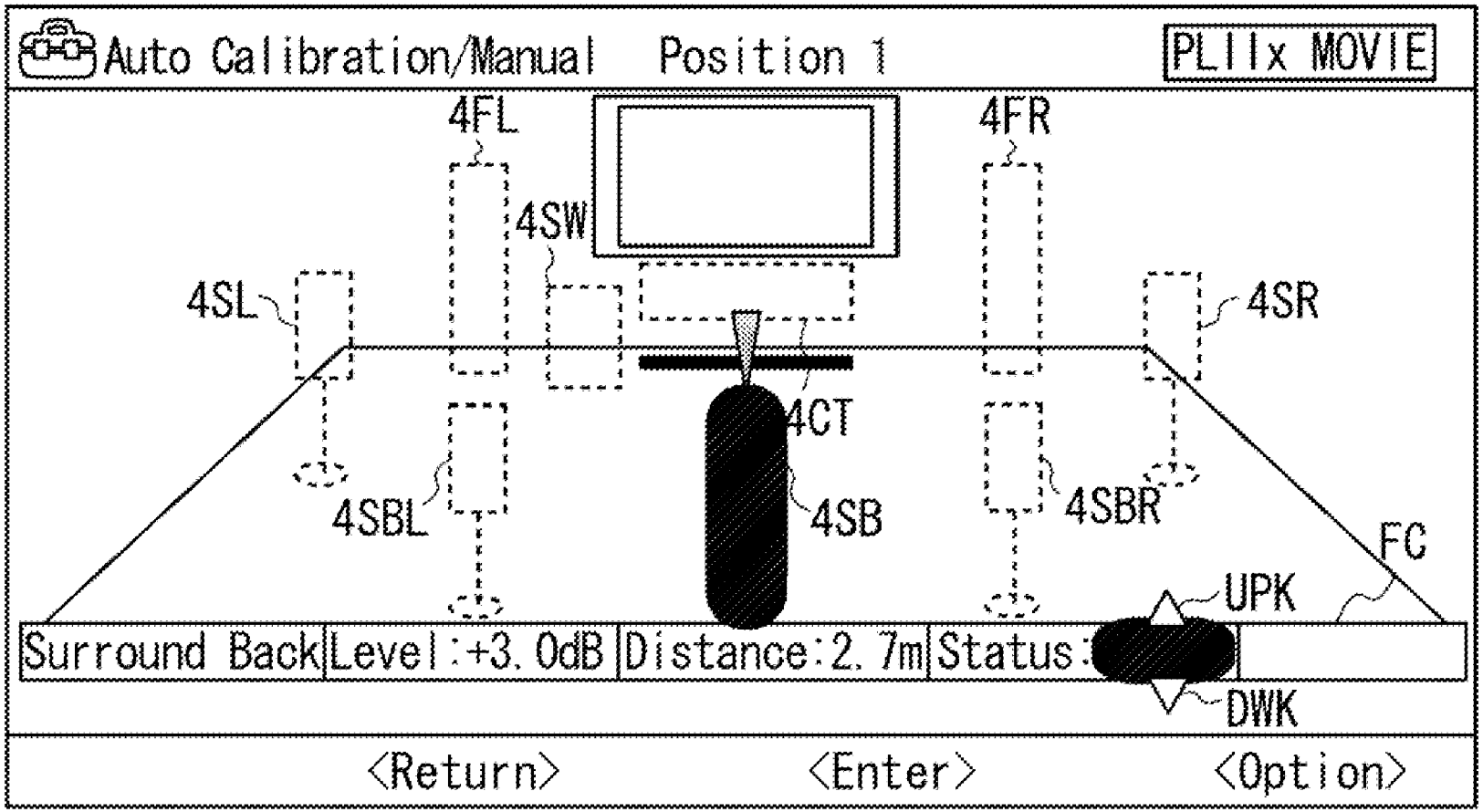

When the "↓" key of the remote controller RCL is operated to push down the down key DWK adjacent to the section of "Status: Dual" of the setting display frame FC of the surround back speaker arrangement selection screen SBL1 (FIG. 47), the control section 10 replaces the surround back speaker arrangement selection screen SBL1 with a surround back speaker arrangement selection screen SBL2 (FIG. 48), which was generated by the graphic processing section 15.

The surround back speaker arrangement selection screen SBL2 (FIG. 48) displays one of the arrangement modes, which is called a "Status: Single" mode: One surround back speaker 4BS is located behind the listening point LP1.

Figure 49:
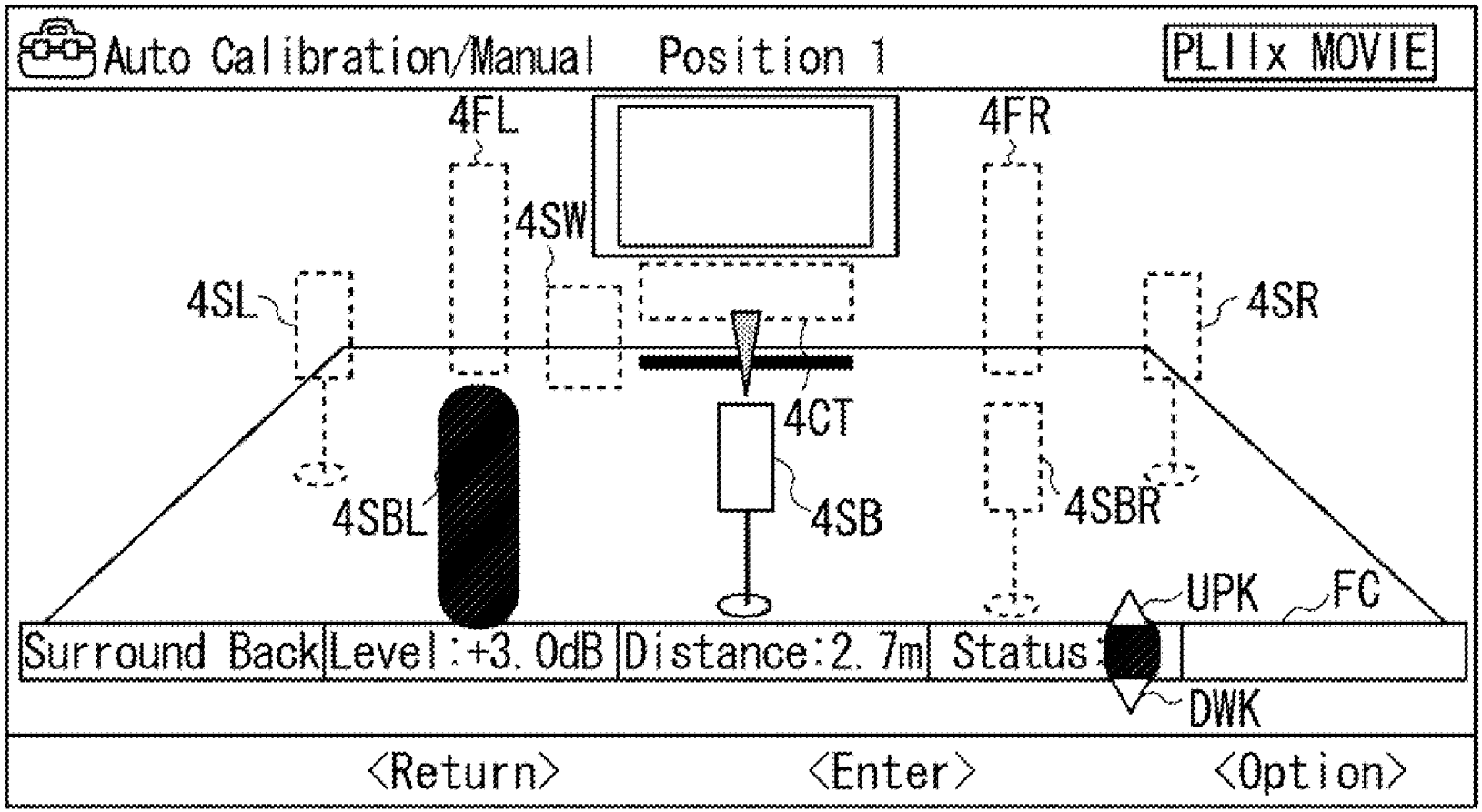

When the "↓" key of the remote controller RCL is operated to push down the down key DWK adjacent to the section of "Status: Single" of the setting display frame FC of the surround back speaker arrangement selection screen SBL2 (FIG. 48), the control section 10 replaces the surround back speaker arrangement selection screen SBL2 with a surround back speaker arrangement selection screen SBL3 (FIG. 49), which was generated by the graphic processing section 15.

The surround back speaker arrangement selection screen SBL3 (FIG. 49) displays one of the arrangement modes, which is called a "Status: No" mode: No surround back speaker is located behind the listening point LP1 while the setting display frame FC displays the characters of "Status: No".

In that manner, when the "↓" key of the remote controller RCL is operated, the control section 10 selects one of the selection screens SBL1 to SBL3 (FIGS. 47 to 49) to be displayed. The user selects the desired arrangement regarding the left surround back speaker 4SBL and the right surround back speaker 4SBR from among the arrangement examples presented by those selection screens.

Figure 50:
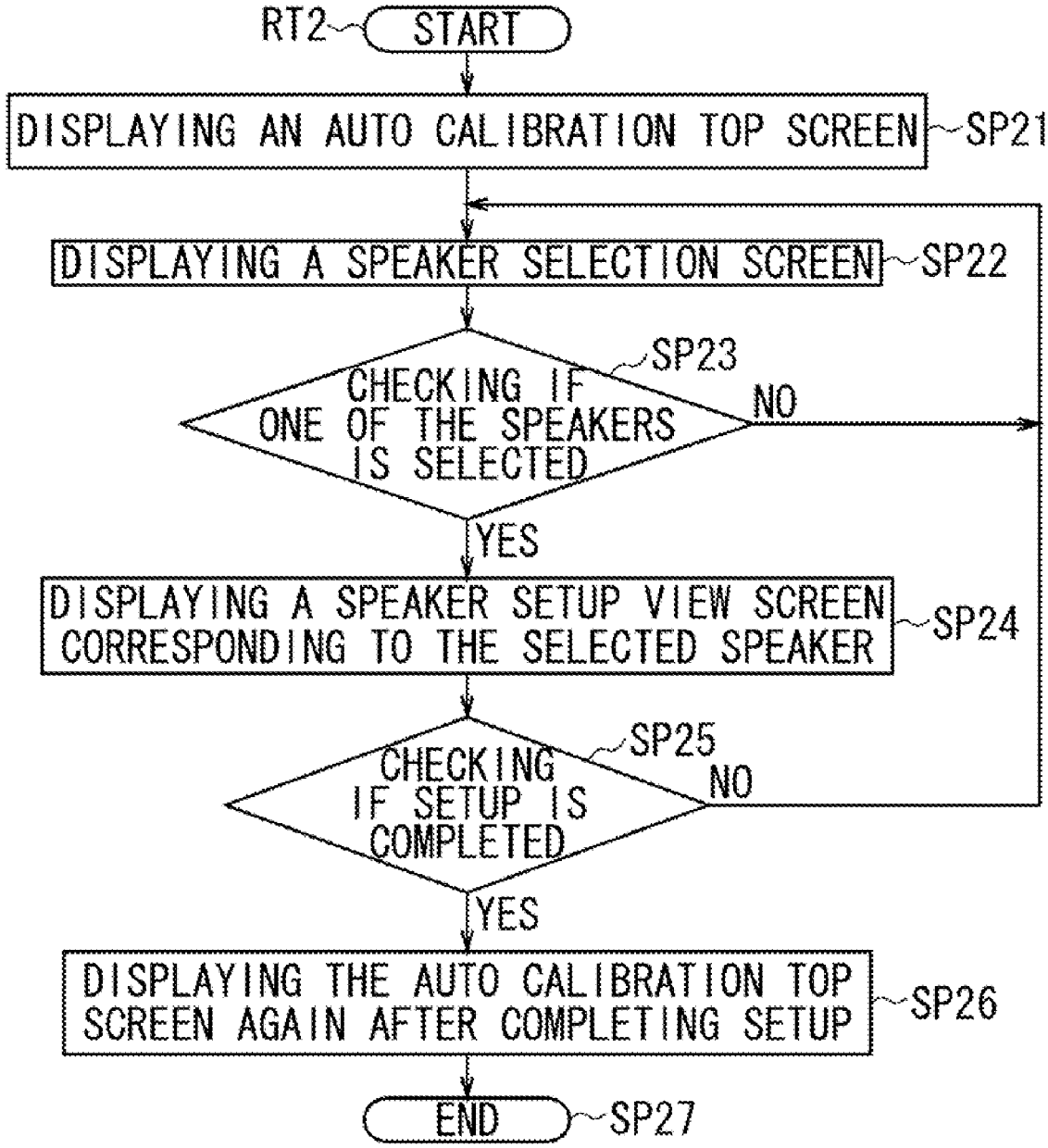
FIG. 50 is a flowchart illustrating a manual acoustic field setting process with GUI.

The above describes the method of manual acoustic field setting in which the control section 10 uses the GUI function. FIG. 50 is a flowchart illustrating the procedure of the manual acoustic field setting process.

(4-4) Manual Acoustic Field Setting Process

As shown in FIG. 50, the control section 10 of the home server 2 executes an application program or the audio setup program to start a routine RT2 from start step and then proceeds to step SP21. At step SP21, after the "Auto Calibration" icon AC4 of the home screen HM (FIG. 3) displayed on the LCD 5 is selected, the control section 10 replaces the home screen HM on the LCD 5 with the auto calibration top screen CT (FIG. 7) and then proceeds to step SP22.

At step SP22, after displaying the auto calibration top screen CT (FIG. 7), the position selection screen PS (FIG. 33) and the manual setup editing screen MSE (FIG. 34), the control section 10 displays one of the speaker selection screens SS1 to SS5 (FIG. 35 to 39) on the LCD 5 and then proceeds to step SP23.

At step SP23, the control section 10 checks if the user has selected one of the speakers 4 for manual setup by choosing one of the speaker selection screens SS1 to SS5 (FIGS. 35 to 39). If the user has not chosen the speaker selection screen yet, the control section 10 returns to step SP22 and waits until one of the speaker selection screens is selected.

Figure 43:
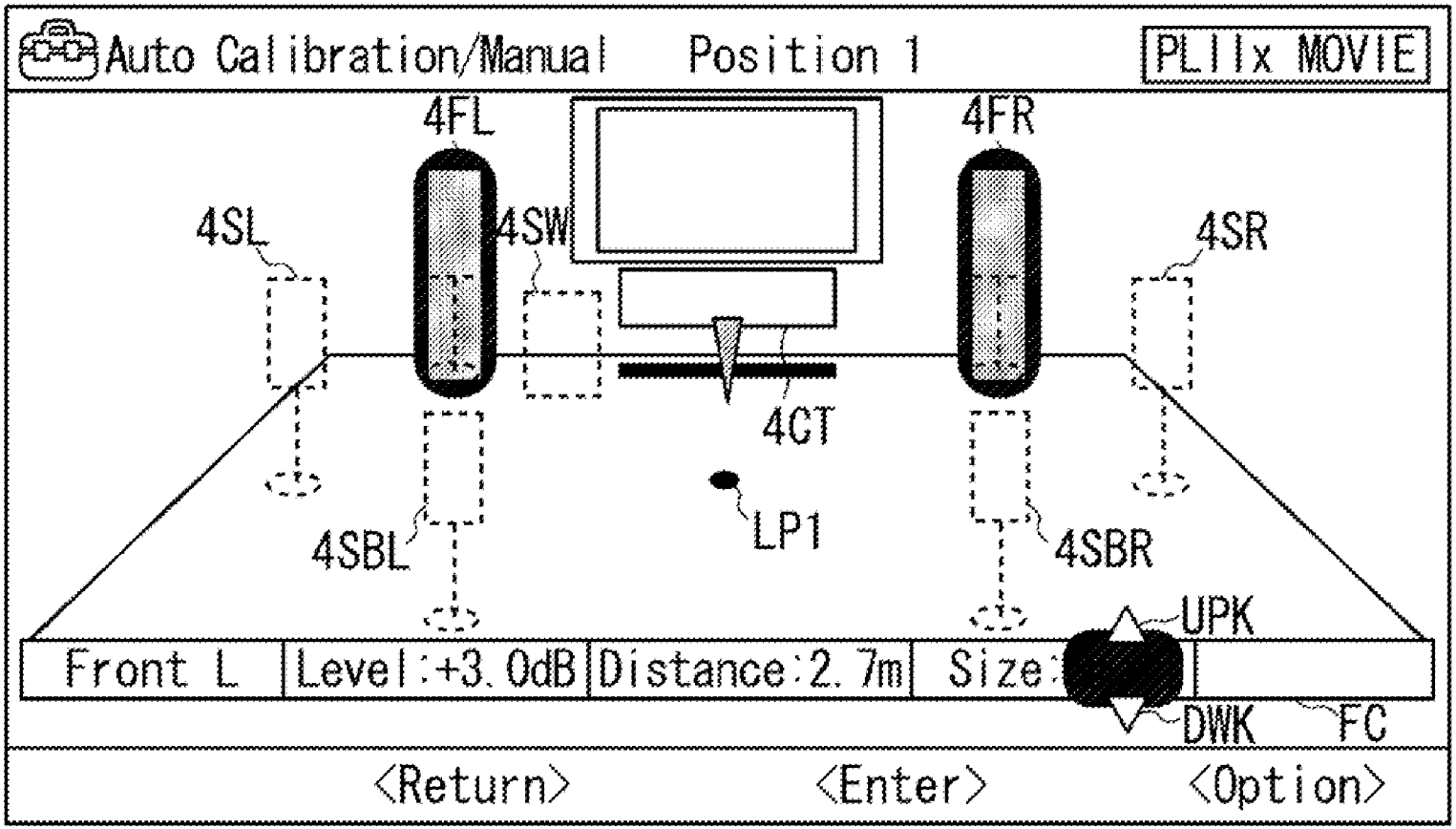

If it determines at step SP23 that the user has chosen the speaker selection screen, the control section 10 proceeds to step SP24. At step SP24, the control section 10 displays on the LCD 5 one of the following screens if the user has chosen the speaker selection screen SS1 (FIG. 35) at step SP23: the speaker level screen SLV1 (FIG. 40), the speaker distance screen SDM (FIG. 41), the speaker size screen SSZ1 (FIG. 42) or the speaker size screen SSZ2 (FIG. 43). The control section 10 subsequently proceeds to step SP25.

In that manner, after the user selects one of the speaker selection screens SS1 to SS5 (FIGS. 35 to 39), the LCD 5 displays the corresponding speaker setup view screen.

At step SP25, the control section 10 checks if the user has completed the manual setup operation through the speaker setup view screen displayed at step SP24. If the user has not completed the operation yet, the control section 10 returns to step SP22 to retry the above process. Whereas if the user has completed the operation, the control section 10 then proceeds to step SP26.

At step SP26, the control section 10 completes the manual setup process and then displays on the LCD 5 the auto calibration top screen CT (FIG. 7) again. The control section 10 subsequently proceeds to step SP27 to end the process.

(4-5) Manual Acoustic Field Setting Process for Speaker Pattern by Using GUI

In addition to the manual setting process for each channel's speaker 4, the home server 2 performs the manual acoustic field setting process in which the acoustic field characteristic of the acoustic field space is easily set up by speaker patterns. In this case, one of the speaker patterns, such as 2 channels, 4 channels, 5.1 channels, 6.1 channels, 7.1 channels or 9.1 channels, is selected for the AV system 1.

Figure 51:
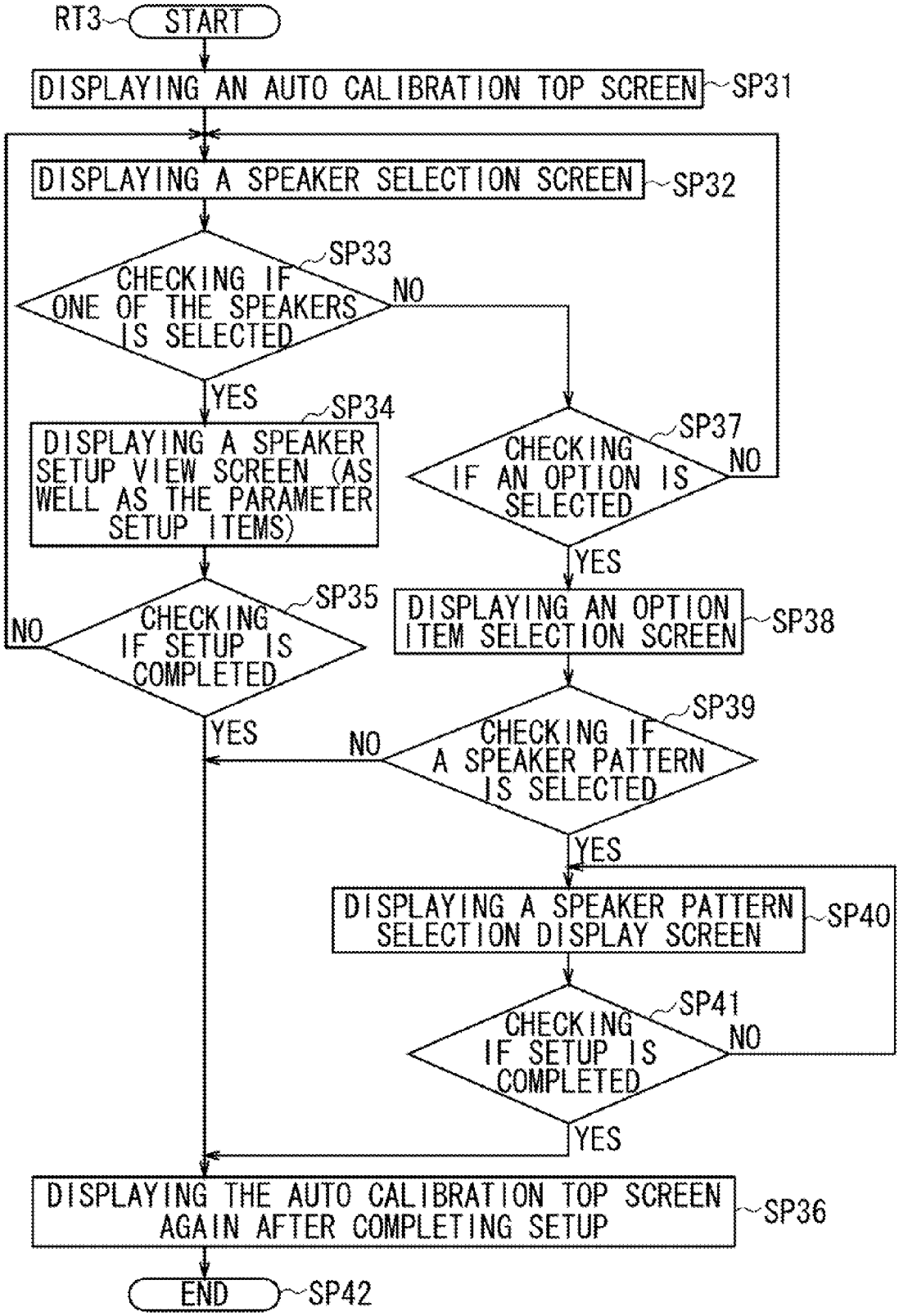
FIG. 51 is a flowchart illustrating a manual acoustic field setting process with GUI for speaker patterns.

As shown in FIG. 51, the control section 10 of the home server 2 executes an application program or the audio setup program to start a routine RT3 from start step and then proceeds to step SP31. At step SP31, after the "Auto Calibration" icon AC4 of the home screen HM (FIG. 3) displayed on the LCD 5 is selected, the control section 10 replaces the home screen HM on the LCD 5 with the auto calibration top screen CT (FIG. 7) and then proceeds to step SP32.

At step SP32, after displaying the auto calibration top screen CT (FIG. 7), the position selection screen PS (FIG. 33) and the manual setup editing screen MSE (FIG. 34), the control section 10 displays one of the speaker selection screens SS1 to SS5 (FIG. 35 to 39) on the LCD 5 and then proceeds to step SP33.

At step SP33, the control section 10 checks if the user has selected one of the speakers 4 for manual setup by choosing one of the speaker selection screens SS1 to SS5 (FIGS. 35 to 39). If the user has chosen the speaker selection screen, the control section 10 proceeds to step SP34.

At step SP34, the control section 10 displays on the LCD 5 one of the following speaker setup view screens if the user has chosen the speaker selection screen SS1 (FIG. 35) at step SP33: the speaker level screen SLV1 (FIG. 40), the speaker distance screen SDM (FIG. 41), the speaker size screen SSZ1 (FIG. 42) or the speaker size screen SSZ2 (FIG. 43). The control section 10 subsequently proceeds to step SP35.

In that manner, after the user selects one of the speaker selection screens SS1 to SS5 (FIGS. 35 to 39), the LCD 5 displays the corresponding speaker setup view screen.

At step SP35, the control section 10 checks if the user has completed the manual setup operation through the speaker setup view screen displayed at step SP34. If the user has not completed the operation yet, the control section 10 returns to step SP32 to retry the above process. Whereas if the user has completed the operation, the control section 10 then proceeds to step SP36.

At step SP36, the control section 10 completes the manual setup process and then displays on the LCD 5 the auto calibration top screen CT (FIG. 7) again. The control section 10 subsequently proceeds to step SP42 to end the process.

If it determines at step SP33 that the user has not chosen the speaker selection screen yet, the control section 10 proceeds to step SP37. At step SP37, the control section 10 checks if an "Option" key of the remote controller RCL has been pushed. If the "Option" key has not been pushed yet, the control section 10 returns to step SP32 to retry the above process. Whereas if the "Option" key has been pushed, the control section 10 proceeds to step SP38.

At step SP38, after the "Option" key of the remote controller RCL was pushed down while the auto calibration top screen CT (FIG. 7) is being displayed, the control section 10 controls the graphic processing section 15 to produce an option item selection screen OIS (FIG. 52) and then displays the option item selection screen OIS on the LCD 5. The control section 10 subsequently proceeds to step SP39.

Figure 52:
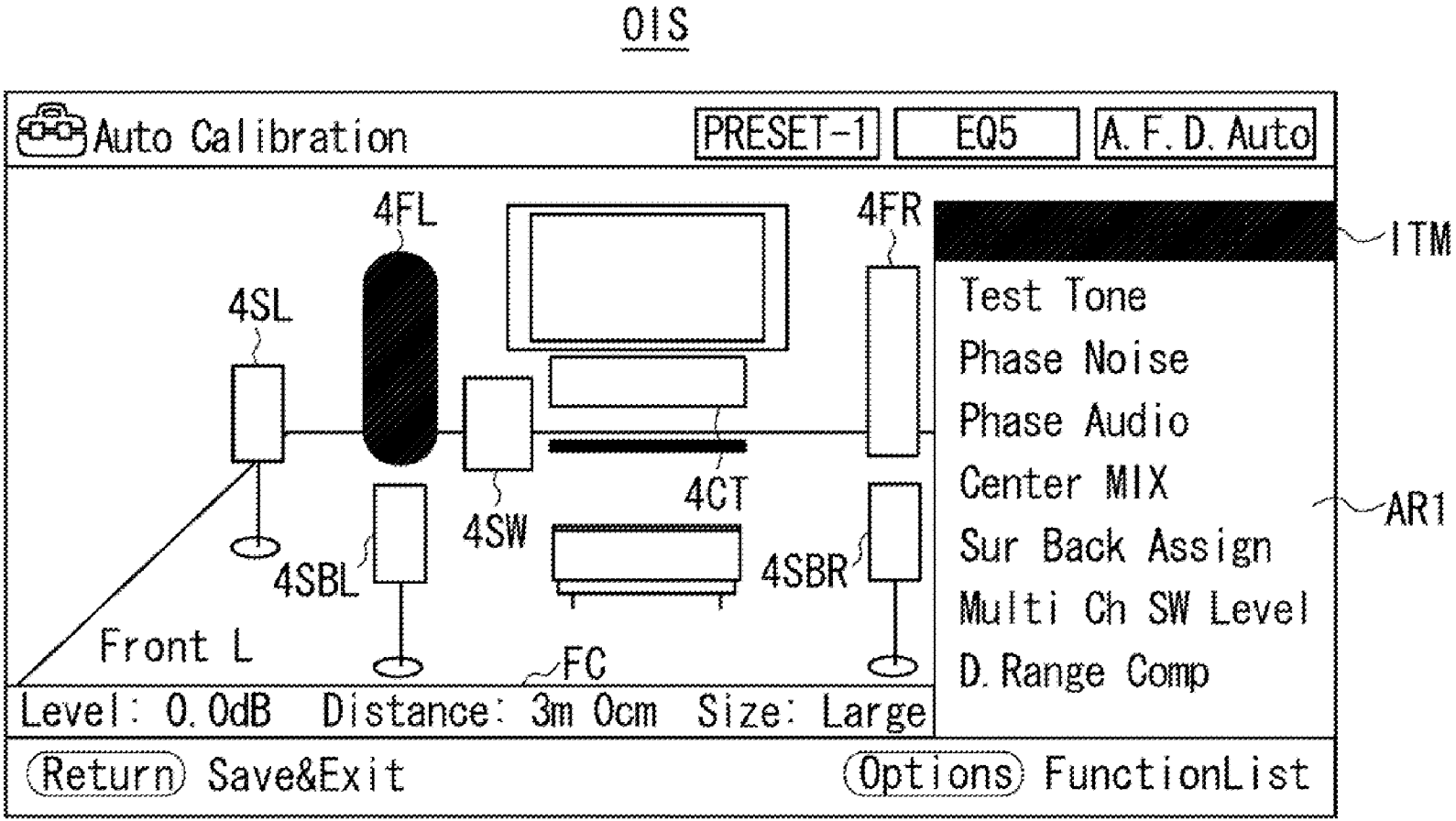
FIG. 52 is a schematic diagram illustrating an option item selection screen.

At step SP39, the control section 10 checks if a speaker pattern item ITM has been selected from an option item column ARI of the option item selection screen OIS (FIG. 52). If the speaker pattern item ITM has not been selected yet, the control section 10 proceeds to step SP36 without having the speaker pattern item ITM selected. At step SP36, the control section 10 displays on the LCD 5 the auto calibration top screen CT (FIG. 7) again and then proceeds to step SP42 to end the process.

Figure 53:
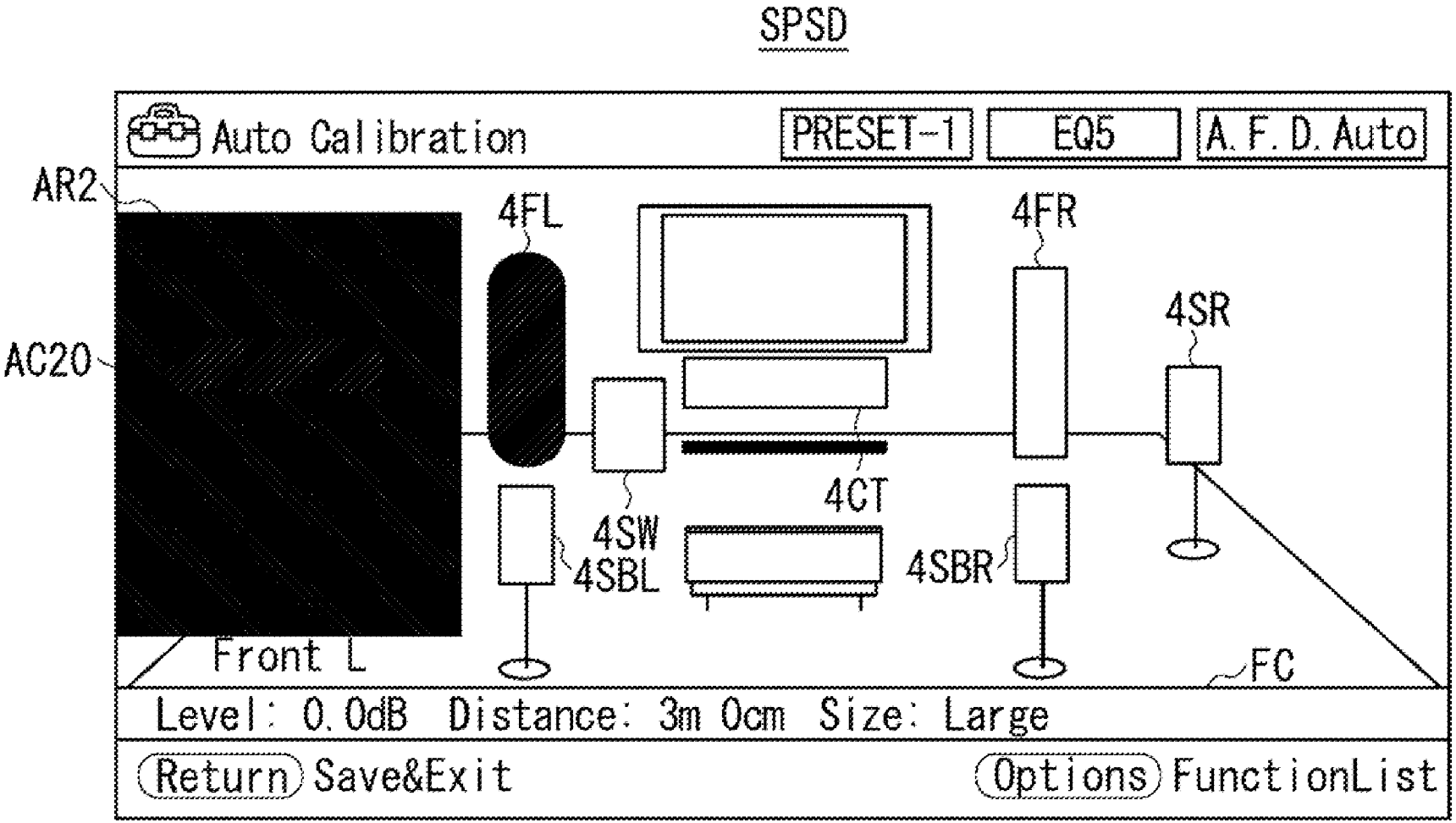
FIG. 53 is a schematic diagram illustrating a speaker pattern selection display screen.

Whereas if it determines at step SP39 that the speaker pattern item ITM has been selected, the control section 10 proceeds to step SP40. At step SP40, since the speaker pattern item ITM was selected, the control section 10 controls the graphic processing section 15 to create a speaker pattern selection display screen SPSD (FIG. 53) and then displays the speaker pattern selection display screen SPSD on the LCD 5. The control section 10 subsequently proceeds to step SP41.

The speaker pattern selection display screen SPSD (FIG. 53) includes a speaker pattern selection column AR2 from which one of the speaker patterns is selected. When the "↑" or "↓" key of the remote controller RCL is operated, a speaker pattern icon AC20 moves along the speaker pattern selection column AR2 to focus on one of the speaker pattern items. For example, when the speaker pattern icon AC20 focuses on "7.1ch", the adjacent area displays the image of the 7.1ch speaker arrangement.

Accordingly, the user can understand what he/she has selected by checking the speaker pattern selection display screen SPSD (FIG. 53), which for example displays the image of the 7.1ch speaker arrangement, and the characters selected by the speaker pattern icon AC20.

When the "Enter" key of the remote controller RCL is pushed down while the speaker pattern of "7.1ch" is selected by the speaker pattern icon AC20 from the speaker pattern selection column AR2 of the speaker pattern selection display screen SPSD (FIG. 53), the control section 10 operates the speaker system in a 7.1 channel mode.

At step SP41, the control section 10 checks if the setup for speaker pattern has been completed. If the setup has not been completed yet, the control section 10 returns to step SP40 to retry the above process. If the setup has been completed, the control section 10 proceeds to step SP36.

At step SP36, the control section 10 completes the manual setting process for speaker pattern and then displays on the LCD 5 the auto calibration top screen CT (FIG. 7) again. The control section 10 subsequently proceeds to step SP42 to end the process.

In that manners when the user selects, by controlling the speaker pattern icon AC20 on the speaker pattern selection display screen SPSD (FIG. 53), the speaker pattern of "7.1ch", the control section 10 of the home server 2 starts operating the speaker system in a 7.1 channel mode. In addition, the control section 10 displays on the LCD 5 the image of that speakers' arrangement. In that manner, the user can set up the speaker system only by controlling the icons while visually checking the arrangement of the speakers.

(5) Operation and Effect

The home server 2 of the AV system 1 is designed to display on the LCD 5 the measurement completion screen MFN (FIG. 19) and the like such that both the arrangement of the speakers 4 and the correlation between the speakers 4 and their setting are displayed on the same screen. Accordingly, the user can visually check both the arrangement of the speakers 4 of the multi-speaker system and the setting of each speaker 4 at once more easily than before, compared to the typical audio system that only has a poor fluorescent display.

If the home server 2 has only the fluorescent display 14 for displaying the setting information of the speakers 4, the user has to set up one at a time. Therefore, the user may need to remember the setting of all the speakers 4. It is too much of a bother to the users. However, the AV system 1, according to an embodiment of the present invention, displays both the arrangement of the speakers 4 and each speaker's setting at once, enhancing its usability. Accordingly, the user can set up each speaker 4 while checking their setting.

In addition, the AV system 1 provides the user with the instructions for setting up the acoustic field of the acoustic field space by sequentially displaying the GUI screens. Accordingly, the user can set up the acoustic field easily. Moreover, the GUI screens display the strings of characters, such as the instructions of operation, errors, waning or the like. Accordingly, the user can find out how to solve the troubles without reading the manual scripts.

Furthermore, the AV system 1 displays various GUI screens in a way that helps the user to easily understand, such as replacing the speaker selection screen SS1 (FIG. 35), in which the arrangement of the speakers 4 is displayed in a three dimensional way, with the speaker level screen SLV1 (FIG. 40), in which it is displayed in a two dimensional way as if the user's line of vision is changed. In that manner, the graphical user interface, provided by the AV system 1, helps the user to understand the information on the GUI screens at once.

Figure 46:
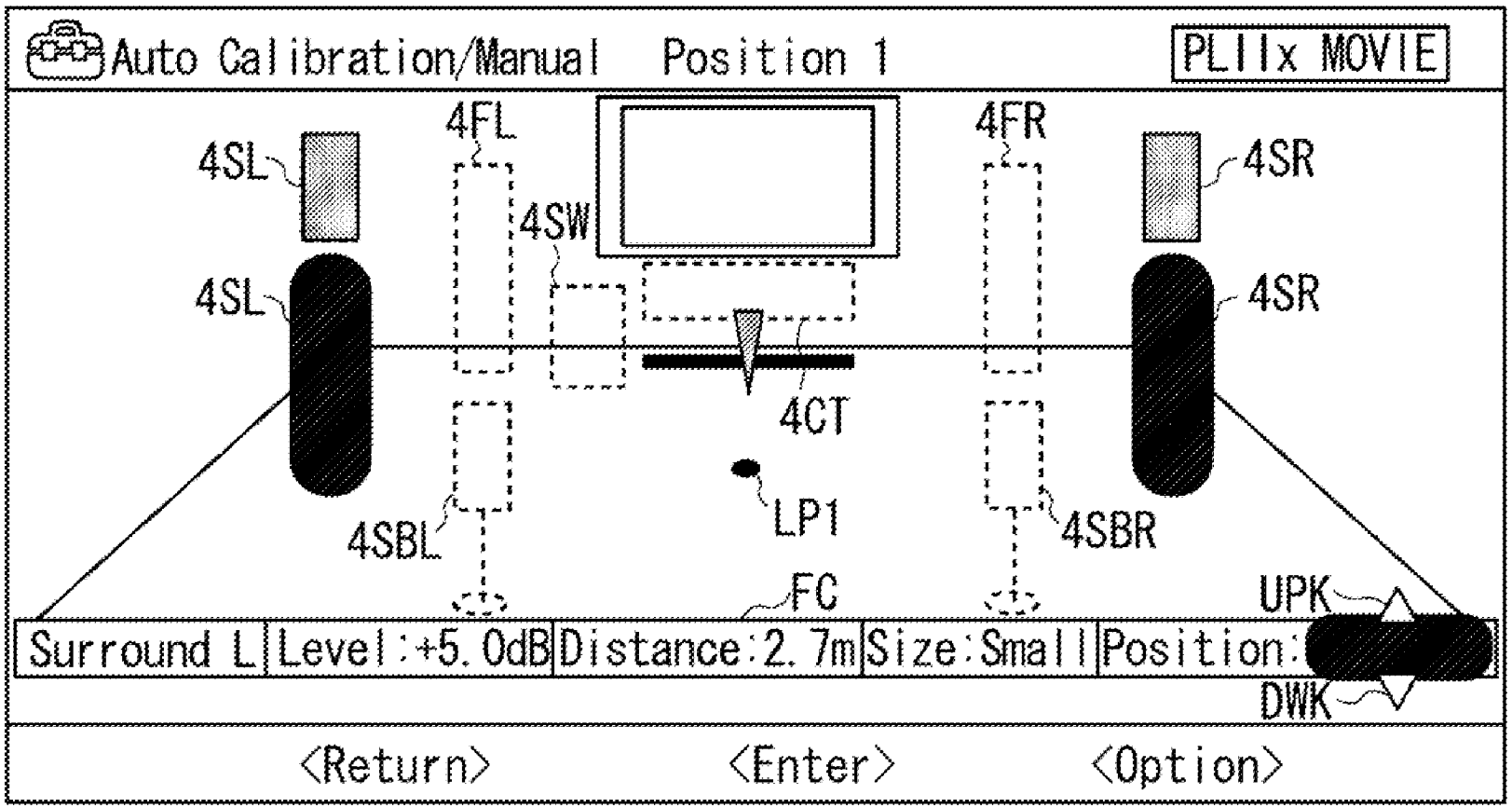

Furthermore, the AV system 1 is designed to display the information, which are considered to be easily understood when they are displayed in a three dimensional manner, in a three dimensional manner from the start, such as the speaker size screen SSZ1 (FIG. 42), the speaker size screen SSZ2 (FIG. 43), the speaker height selection screen SHS1 (FIG. 45) and the speaker height selection screen SHS2 (FIG. 46).

Furthermore, for example, when the left front speaker 4FL is selected from the speaker selection screen SS1 (FIG. 35), the AV system 1 displays the speaker level screen SVL1 (FIG. 40) for manual setup of the left front speaker 4FL. In this case, the speaker level screen SVL1 emphasizes the image of the target left front speaker 4FL by solid lines and hatching while weakly displaying the other speakers 4 which are not allowed to be set up on this screen. This helps the user to set up the speakers 4 correctly.

Furthermore, when there is a plurality of speakers 4 to be set up for the acoustic field characteristic of the acoustic field space, there may be many matrix-like combinations of speaker patterns such as use or nonuse of the speakers 4 or their size. However, the AV system 1 displays the speaker pattern selection screen SPSD (FIG. 53) instead of displaying a matrix table and allows the user to visually check the speaker patterns and to select one of the speaker patterns. Accordingly, the user can easily perform the manual acoustic setting process for speaker patterns.

According to the above configuration, the AV system 1 provides a graphical user interface that helps the user to easily set up the acoustic field.

(6) Other Embodiment

In the above-noted embodiment, one example of the transition of the GUI screens is described. However, the present invention is not limited to this. The transition of the GUI screens can be different in terms of orders or combination.

Moreover, in the above-noted embodiment, the user selects one of the speakers 4 for manual setup from the speaker selection screens SS1 to SS5 (FIGS. 35 to 39). However, the present invention is not limited to this. The user may choose two or more speakers 4 for manual setup.

Furthermore, in the above-noted embodiment, the control section 10 of the home server 2 reads out from the ROM the audio setup program and loads it onto the RAM to execute the program. As a result, the control section 10 performs various processes, such as the automatic acoustic field setting process (FIG. 32), the manual acoustic field setting process (FIG. 50) and the manual acoustic field setting process (FIG. 51). However, the present invention is not limited to this. To perform those processes, the control section 10 may execute the audio setup program, which is installed from storage media (such as Compact Disc (CD), Digital Versatile Disc (DVD) or semiconductor memories) or the Internet.

Furthermore, in the above-noted embodiment, the home server 2 (equivalent to an acoustic apparatus or an information processing apparatus for setting up the multi-channel speakers 4) includes hardware components such as: the control section 10, equivalent to a speaker setup section that sets up each of a plurality of speakers 4; and the graphic processing section 15, equivalent to a display control section that controls display of information regarding the arrangement of the speakers and setting of the speakers on the LCD 5 or a display section. However, the present invention is not limited to this. The software may provide the functions of the control section 10 and graphic processing section 15. The control section 10 and the graphic processing section 15 may be integrated into one unit.

The method according to an embodiment of the present invention can be also applied to various systems for setting up a plurality of speakers, such as a multi-channel DVD multi speaker system, a multi-channel speaker system mounted on vehicles and a multi speaker system for theaters.

It should be understood by those skilled in the art that various modifications, combinations, sub-combinations and alterations may occur depending on design requirements and other factors insofar as they are within the scope of the appended claims or the equivalents thereof.

What is claimed is:

1. An information processing apparatus comprising:

a speaker setup section that sets up a plurality of speakers for multiple listening positions;

a storage section that stores, for each of the multiple listening positions, settings for the plurality of speakers determined by the speaker setup section;

a measurement section allowing a user to visually check the arrangement of the plurality of speakers and the setting of each speaker that measures a distance from a corresponding speaker to one or more of the listening positions using settings for the plurality of speakers determined by the speaker setup section from the storage section;

a surface mount display;

a display control section that generates a graphical user interface for display on an external display, wherein the graphical user interface includes a plurality of speakers and setting information corresponding to the displayed speakers, wherein the setting information includes the measured distance from the corresponding speaker to the listening position, and the setting information, including the measured distance, is displayed on the periphery of the corresponding speaker to notify a user of a relation between each speaker and the speaker's corresponding setting information, wherein the representation of the speakers in the graphical user interface is based on the setting information, wherein the display control section changes the line of vision of the representation of the speakers, and wherein the display control section controls a display of a speaker height selection screen on the graphical user interface for the user to select a speaker height; and a listening position selection section that determines a selected one of the listening positions as determined by the measuring section, wherein the selected listening position and a second listening position of the multiple listening positions are identified on the external display at the same time, and that receive an instruction to switch the selection from the selected listening position to the second listening position, the settings of the multiple speakers associated with the second listening position being stored in the storage section prior to receiving the instruction.

2. The information processing apparatus according to claim 1, wherein the setting information includes a numeric value representing an audio volume of the corresponding speaker and wherein the numeric value can be changed upward or downward in accordance with an instruction from a user while the display control section is displaying the speakers and the setting information, and the numeric value is displayed on the periphery of the corresponding speaker.

3. The information processing apparatus according to claim 2, wherein the graphical user interface includes error or warning information as the setting information and the error or warning information is displayed using characters.

4. The information processing apparatus according to claim 1, wherein the graphical user interface switches between two dimensional and three dimensional displays of the speakers and the setting information.

5. The information processing apparatus according to claim 1, further comprising;

a selection section that selects one of the displayed speakers, wherein the display control section emphasizes an image of the speaker selected by the selection section.

6. The information processing apparatus according to claim 5, wherein the setting information of the emphasized speaker is changeable and the setting information of non-emphasized speakers is not changeable.

7. A method comprising:

setting up a plurality of speakers for multiple listening positions;

storing, for each of the multiple listening positions, settings for the plurality of speakers;

measuring a distance from a corresponding speaker to one or more of the listening positions using an information processing apparatus;

generating a graphical user interface for display on a display external to the information processing apparatus, wherein the graphical user interface includes a plurality of speakers and setting information corresponding to the displayed speakers, wherein the setting information includes the measured distance from the corresponding speaker to the listening position, and the setting information, including the measured distance, is displayed on the periphery of the corresponding speaker to notify a user of a relation between each speaker and the speaker's corresponding setting information, wherein the representation of the speakers in the graphical user interface is based on the setting information, and wherein the display control section changes the line of vision of the representation of the speakers;

determining a selected one of the listening positions, wherein the selected listening position and a second listening position of the multiple listening positions are identified on the external display at the same time;

controlling a display of a speaker height selection screen on the graphical user interface for the user to select a speaker height; and receiving an instruction to switch the selection from the selected listening position to the second listening position, the settings of the multiple speakers associated with the second listening position being stored in the storage section prior to receiving the instruction.

8. The method according to claim 7, wherein the setting information includes a numeric value representing an audio volume of the corresponding speaker and wherein the numeric value can be changed upward or downward in accordance with an instruction from a user while the display control section is displaying the speakers and the setting information, and the numeric value is displayed on the periphery of the corresponding speaker.

9. The method according to claim 8, wherein the graphical user interface includes displaying error or warning information as the setting information and the error or warning information is displayed using characters.

10. The method according to claim 7, further comprising switching between two dimensional and three dimensional displays of the plurality of speakers and the setting information.

11. The method according to claim 7, further comprising:

selecting one of the displayed speakers; and emphasizing an image of the selected speaker.

12. The method according to claim 11, wherein the setting information of the emphasized speaker is changeable and the setting information of non-emphasized speakers is not changeable.

13. A non-transitory computer-readable storage medium, storing a computer program for causing a processor to execute a method, the method comprising:

setting up a plurality of speakers for multiple listening positions;

storing, for each of the multiple listening positions, settings for the plurality of speakers;

measuring a distance from a corresponding speaker to one or more of the listening positions using an information processing apparatus;

generating a graphical user interface for display on a display external to the information processing apparatus, wherein the graphical user interface includes a plurality of speakers and setting information corresponding to the displayed speakers, wherein the setting information includes the measured distance from the corresponding speaker to the listening position, and the setting information, including the measured distance, is displayed on the periphery of the corresponding speaker to notify a user of a relation between each speaker and the speaker's corresponding setting information, wherein the representation of the speakers in the graphical user interface is based on the setting information, and wherein the display control section changes the line of vision of the representation of the speakers;

determining a selected one of the listening positions, wherein the selected listening position and a second listening position of the multiple listening positions are identified on the external display at the same time;

controlling a display of a speaker height selection screen on the graphical user interface for the user to select a speaker height; and receiving an instruction to switch the selection from the selected listening position to the second listening position, the settings of the multiple speakers associated with the second listening position being stored in the storage section prior to receiving the instruction.

14. An information processing apparatus comprising:

speaker setup means for setting up a plurality of speakers for multiple listening positions;

storage means for storing, for each of the multiple listening positions, settings for the plurality of speakers determined by the speaker setup section;

measuring means allowing a user to visually check the arrangement of the plurality of speakers and the setting of each speaker for measuring a distance from a corresponding speaker to one or more of the listening positions using settings for the plurality of speakers determined by the speaker setup section from the storage section;

a surface mount display;

display control means for generating a graphical user interface for display on a display external to the information processing apparatus, wherein the graphical user interface includes a plurality of speakers and setting information corresponding to the displayed speakers, wherein the setting information includes the measured distance from the corresponding speaker to the listening position, and the setting information, including the measured distance, is displayed on the periphery of the corresponding speaker to notify a user of a relation between each speaker and the speaker's corresponding setting information, wherein the representation of the speakers in the graphical user interface is based on the setting information, wherein the display control means changes the line of vision of the representation of the speakers, and wherein the display control means controls a display of a speaker height selection screen on the graphical user interface for the user to select a speaker height; and listening position selection means for determining a selected one of the listening positions using the measuring means, wherein the selected listening position and a second listening position of the multiple listening positions are identified on the external display at the same time, and for receiving an instruction to switch the selection from the selected listening position to the second listening position, the settings of the multiple speakers associated with the second listening position being stored in the storage section prior to receiving the instruction.

* * * * *